US009963278B2

(12) United States Patent
Terayama et al.

(10) Patent No.: US 9,963,278 B2
(45) Date of Patent: May 8, 2018

(54) FUNNEL COMPONENT AND PACKAGING CONTAINER USING FUNNEL COMPONENT

(75) Inventors: Takashi Terayama, Tokyo (JP); Takeshi Saito, Tokyo (JP); Noriyuki Sasaki, Tokyo (JP); Masashi Goto, Tokyo (JP); Jyun Sada, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 320 days.

(21) Appl. No.: 14/342,928

(22) PCT Filed: Sep. 7, 2012

(86) PCT No.: PCT/JP2012/005675

§ 371 (c)(1), (2), (4) Date: Mar. 5, 2014

(87) PCT Pub. No.: WO2013/035339

PCT Pub. Date: Mar. 14, 2013

(65) Prior Publication Data

US 2014/0238543 A1 Aug. 28, 2014

(30) Foreign Application Priority Data

Sep. 9, 2011 (JP) ..... 2011-197665
Sep. 9, 2011 (JP) ..... 2011-197666
(Continued)

(51) Int. Cl.
*B65D 47/10* (2006.01)
*B65D 77/20* (2006.01)
(Continued)

(52) U.S. Cl.
CPC ..... *B65D 47/10* (2013.01); *B65D 3/12* (2013.01); *B65D 3/14* (2013.01); *B65D 3/22* (2013.01);
(Continued)

(58) Field of Classification Search
CPC ..... B65D 47/10; B65D 83/06; B65D 51/185; B65D 3/14; B65D 3/12; B65D 77/2024;
(Continued)

(56) References Cited

U.S. PATENT DOCUMENTS 2,399,545 A * 4/1946 Davis ..... A61F 13/02 602/55
2,721,810 A * 10/1955 Schram ..... G09F 3/10 428/191
(Continued)

FOREIGN PATENT DOCUMENTS

EP 2426080 A1 3/2012
GB 2232141 A * 12/1990 ..... B31D 1/021
(Continued)

OTHER PUBLICATIONS

Japanese Office Action dated May 7, 2015 in corresponding Japanese Patent Application No. 2011-197665.
(Continued)

*Primary Examiner* — Jason K Niesz
*Assistant Examiner* — James Hakomaki

(57) ABSTRACT

A funnel component, and a packaging container using the funnel component are provided. A funnel component includes: a funnel portion having a diameter that is increased from a narrow opening side toward a wide opening side; a discharge portion that connects with an end portion on the narrow opening side; and a side wall portion that surrounds an opening portion, on the wide opening side, of the funnel portion, connects with the funnel portion, and is fitted into the container body. The funnel component is integrally formed by a sheet member including paper and sealant layer. A folded portion is formed, by the sheet member being folded back and welded over entire circumference, at an opening portion of the discharge portion. The packaging container is formed by the funnel component being fitted
(Continued)

into a container body having an open end, a bottom portion, and a side wall.

25 Claims, 39 Drawing Sheets

(30) Foreign Application Priority Data

| | | |
|---|---|---|
| Sep. 9, 2011 | (JP) | 2011-197667 |
| Jan. 31, 2012 | (JP) | 2012-019134 |
| Jan. 31, 2012 | (JP) | 2012-019135 |
| Feb. 2, 2012 | (JP) | 2012-021063 |
| Apr. 13, 2012 | (JP) | 2012-092340 |
| Aug. 3, 2012 | (JP) | 2012-173274 |

(51) Int. Cl.
*B65D 83/06* (2006.01)
*B65D 3/22* (2006.01)
*B65D 3/14* (2006.01)
*B65D 3/12* (2006.01)
*B65D 51/18* (2006.01)

(52) U.S. Cl.
CPC ..... *B65D 51/185* (2013.01); *B65D 77/2024* (2013.01); *B65D 83/06* (2013.01); *B65D 2203/02* (2013.01); *B65D 2251/0031* (2013.01); *B65D 2251/0093* (2013.01)

(58) Field of Classification Search
CPC ..... B65D 3/22; B65D 2203/02; B65D 2251/0093; B65D 2251/0031
USPC ..... 141/332, 337; 229/123.1; 222/565; 220/359.3, 359.2, 359.4
See application file for complete search history.

(56) References Cited

U.S. PATENT DOCUMENTS 2,776,787 A * 1/1957 Nicol ..... B65D 17/502 206/813
2,894,666 A * 7/1959 Campbell, Jr. ..... B65D 5/726 222/528
3,171,449 A 3/1965 Ellms et al.
3,235,165 A * 2/1966 Jackson ..... B65D 17/502 221/302
3,603,358 A 9/1971 Mallindine
3,964,670 A * 6/1976 Amneus ..... B65D 17/502 229/123.1
4,120,420 A * 10/1978 Dirksing ..... B65D 77/02 222/460
4,351,740 A 9/1982 Joshi et al.
4,397,406 A * 8/1983 Croley ..... B65D 5/726 222/105
4,460,634 A * 7/1984 Hasegawa ..... G09F 15/02 156/289
4,534,751 A 8/1985 Fortuna et al.
4,715,528 A * 12/1987 Kjelgaard ..... B65D 5/708 220/359.2
4,735,837 A * 4/1988 Miyasaka ..... C09J 7/0207 428/192
4,743,249 A * 5/1988 Loveland ..... A61K 9/7084 424/447
4,771,937 A * 9/1988 Kamada ..... B65D 77/206 229/123.1
4,863,036 A * 9/1989 Heijenga ..... B65D 77/2036 229/123.1
4,889,234 A * 12/1989 Sorensen ..... B65D 5/708 206/459.5
5,018,695 A * 5/1991 Bishop ..... A47G 23/032 248/346.11
5,081,820 A 1/1992 Nedstedt
5,363,982 A 11/1994 Sadlier
5,487,929 A * 1/1996 Rusincovitch, Jr. .. B44C 5/0461 428/161
5,524,759 A * 6/1996 Herzberg ..... B65D 75/5838 206/233
6,026,953 A * 2/2000 Nakamura ..... B65D 75/5838 206/233
6,146,729 A * 11/2000 Nihda ..... B65D 55/06 215/251
6,165,115 A 12/2000 Rea
6,206,134 B1 * 3/2001 Stark ..... A61B 7/02 181/131
6,283,178 B1 9/2001 Way
6,309,745 B1 * 10/2001 Willms ..... A61F 13/58 428/354
6,495,229 B1 * 12/2002 Carte ..... A61F 13/023 428/40.1
7,789,262 B2 * 9/2010 Niederer ..... B65D 77/2032 220/359.2
7,947,366 B2 * 5/2011 Ishiwatari ..... C09J 7/0207 428/343
8,114,451 B2 * 2/2012 Sierra-Gomez .... B65D 75/5838 206/459.5
2001/0015356 A1 * 8/2001 Jud ..... B65D 77/20 220/359.1
2002/0146115 A1 * 10/2002 Zohn ..... H04M 1/17 379/451
2003/0047277 A1 * 3/2003 Bell ..... B65C 9/2286 156/290
2003/0077414 A1 * 4/2003 Clark ..... G09F 3/02 428/64.1
2005/0077297 A1 * 4/2005 Marshburn ..... B65D 77/2032 220/359.2
2005/0167311 A1 * 8/2005 Tonsfeldt ..... B65D 83/08 206/449
2006/0195053 A1 * 8/2006 Oelund ..... A61F 5/443 602/43
2006/0216451 A1 * 9/2006 Weiner ..... B31D 1/021 428/40.1
2006/0289542 A1 * 12/2006 Schedl ..... B29C 65/48 220/359.2
2008/0073240 A1 * 3/2008 Bowers ..... B65D 75/32 206/532
2011/0036454 A1 * 2/2011 Saito ..... B65B 39/007 141/331
2011/0036868 A1 2/2011 Gotoh et al.
2011/0259887 A1 10/2011 Gotoh et al.
2012/0055941 A1 * 3/2012 Messerschmid ..... B29C 51/082 220/694
2014/0007978 A1 1/2014 Cheikh et al.

FOREIGN PATENT DOCUMENTS

JP 2000255648 A * 9/2000
JP 2001-233318 8/2001
JP 2002240167 * 8/2002
JP 2003341708 A * 12/2003
JP 2004-008341 1/2004
JP 2004-18036 1/2004
JP 2007-316472 12/2007
JP 2009-262955 11/2009
JP 2009-262956 11/2009
JP 2009-280286 12/2009
JP 2010-254322 11/2010
JP 2011-084329 4/2011
JP 2011-093614 5/2011
JP 2011093614 * 5/2011
JP 2011-230787 11/2011
JP 2012-035873 2/2012
JP 2012035873 * 2/2012

OTHER PUBLICATIONS

New Zealand Office Action dated May 18, 2015 in corresponding New Zealand Patent Application No. 622498.

(56) References Cited

OTHER PUBLICATIONS

Chinese Office Action dated Mar. 12, 2015 in corresponding Chinese Patent Application No. 201280043639.7.
Extended European Search Report dated Apr. 23, 2015 in corresponding European Patent Application No. 12830314.6.
Japanese Office Action issued Sep. 19, 2013, corresponding to Japanese Patent Application No. 2012-173274.
Office Action for co-pending U.S. Appl. No. 14/375,249 dated May 9, 2017.

* cited by examiner

17

18

FUNNEL COMPONENT AND PACKAGING CONTAINER USING FUNNEL COMPONENT

CROSS REFERENCE TO RELATED APPLICATIONS

This application is a U.S. National Phase application of PCT/JP2012/005675, filed on Sep. 7, 2012, which claims priority to Japanese Patent Application No. 2011-197665, filed on Sep. 9, 2011, Japanese Patent Application No. 2011-197666, filed on Sep. 9, 2011, Japanese Patent Application No. 2011-197667, filed on Sep. 9, 2011, Japanese Patent Application 2012-019134, filed on Jan. 31, 2012, Japanese Patent Application 2012-019135, filed on Jan. 31, 2012, Japanese Patent Application 2012-021063, filed on Feb. 2, 2012, Japanese Patent Application 2012-092340, filed on Apr. 13, 2012, Japanese Patent Application 2012-173274, filed on Aug. 3, 2012, the disclosure of which are incorporated by reference.

TECHNICAL FIELD

The present invention relates to funnel components for use in packaging containers in which fluid substances such as powdery, granular, and liquid substances are packaged and by which the contents are transferred from one case to another case or the like, and packaging containers in which the funnel components are used.

BACKGROUND ART

In general, powdery or granular food such as instant coffee is sold in a state where the food is packaged in a high-hermetically sealed packaging container such as a capped bottle so as to maintain a sealed state during storage or the like. As such a packaging container, a packaging container, for refilling, which can facilitate transfer of contents is suggested in Patent Literature 1. When the contents are transferred from the packaging container to a storage container or the like, the packaging container is opened and put in an opening portion of the storage container, to gradually transfer the contents.

The packaging container disclosed in Patent Literature 1 includes a cylindrical container body, a funnel component, a sealing lid, and a covering cap. The funnel component includes a funnel portion, and a side wall portion connected with an end portion, on a wide opening side, of the funnel portion. The side wall portion is fitted into the container body, and joined to an inner surface of the container body. The funnel portion has such a shape as to reduce its diameter toward an outer side of an opening portion of the container body. Further, an edge, on a narrow opening side, of the funnel portion and an edge of an open end of the container body are coplanar with each other. The container body is filled with contents, and the edge of the open end of the container body is sealed with the sealing lid. In the sealing lid, a plurality of perforation lines are formed so as to extend radially from the center of the sealing lid. Further, the covering cap for covering the top of the sealing lid during storage, circulation, or the like is mounted to prevent the sealing lid from being cut.

When contents in the packaging container are transferred for refilling, the covering cap is removed from the packaging container, and the sealing lid is put and pressed into an opening of a case to be refilled with the contents. Thus, the sealing lid is cut along the perforation lines, whereby the contents can be easily transferred through the funnel component.

In the packaging container, since sealing between the funnel component and a membrane is not performed, a problem arises that the contents are moved onto the outer side of the funnel component through a gap between the funnel component and the membrane during transportation or the like. In a case where the contents are transferred from a package for refilling to a storage container or the like in a state where the contents have been moved onto the outer side of the funnel component, the contents having been moved onto the outer side of the funnel component are not transferred to a case, such as the storage container, to be refilled, and may scatter (externally) on the outside of the case to be refilled. Therefore, the contents are spilled on/around a refilling work space such as a table, and clearing such as cleaning is necessary. Therefore, in Patent Literature 3, it is suggested that an end portion, on a narrow opening side, of the funnel component projects outward of an open end of the container body such that the membrane and the end portion, on the narrow opening side, of the funnel component are maintained so as to be in close contact with each other, thereby preventing the movement of the contents (see, for example, FIG. 9 of Patent Literature 3).

Such a packaging container may be subjected to an environment where air pressure inside the packaging container becomes different from air pressure outside the packaging container during circulation. In a case where, for example, packaging containers that are filled with contents in summer in which the temperature is high are in shops in winder in which the temperature is low, air pressure inside the packaging containers is reduced relative to air pressure outside the packaging containers, and the side surface portions of the packaging containers are recessed toward the inside of the packaging containers. Therefore, a problem may arise that the design of the packaging containers is degraded. On the other hand, in a case where, for example, packaging containers that are filled with contents in a place such as a flat land in which the altitude is relatively low, are circulated and placed in a place in which the altitude is high, air pressure inside the packaging containers is increased relative to air pressure outside the packaging containers, and the side surface portions of the packaging containers expand outward of the packaging containers. Therefore, problems may arise that the design of the packaging containers is degraded and contents are ejected due to, for example, breakage caused by a small impact. In order to solve the problems, a container is suggested in which a laminated member of the side surface portion of the container is formed so as to be partially separable, and, particularly when an internal pressure is reduced, an inner layer of the laminated member is separated and expanded toward the inside of the container, to alleviate reduction of pressure in the container, thereby preventing the side surface portion of the container from being recessed (see, for example, Patent Literature 4).

CITATION LIST

Patent Literature

Patent Literature 1: Japanese Laid-Open Patent Publication No. 2009-262956

Patent Literature 2: Japanese Laid-Open Patent Publication No. 2009-262955

Patent Literature 3: Japanese Laid-Open Patent Publication No. 2009-280286

Patent Literature 4: Japanese Laid-Open Patent Publication No. 2011-93614

Patent Literature 5: Japanese Laid-Open Patent Publication No. 2011-230787

SUMMARY OF THE INVENTION

Problems to be Solved by the Invention

To date, funnel components have been formed by using resin. However, from the viewpoint of environmental issues, usage of plastics, aluminium foils, and the like is preferably to be reduced for resource saving, and paper, instead of aluminium, needs to be used as main materials of the container bodies, the sealing lids, the funnel components, and the like.

However, when the funnel component is formed by a sheet member containing paper being subjected to pressing process, a problem arises that a strength becomes insufficient. It is effective that the end portion, on the narrow opening side, of the funnel component projects as described above in order to prevent contents from moving onto the outer side of the funnel component. Therefore, it is considered that, also when the funnel component made of paper is used, the end portion on the narrow opening side is formed so as to project from the container body. However, before contents are packaged, a plurality of packaging containers in which the funnel components are mounted to the container bodies are stacked so as to sandwich plate members, and stored. Therefore, when the paper funnel components project from the container bodies, the funnel components are likely to be buckled due to load applied through the plate members. Further, shapes formed by press work are limited, and shaping of the funnel components is difficult. On the other hand, when the funnel components are formed by a pulp molding method, although a strength is obtained, problems arise that cost for introducing facilities is high, and mass productivity is disadvantageous. Further, an optimal projection for paper funnel components is not clearly known.

Further, to the packaging containers, sticker labels, for indicating information or representing design, on which, for example, a trade name, an opening method, explanation of usage of contents and the like, and advertisement for sales promotion are indicated, are often adhered.

In the packaging container disclosed in Patent Literature 5, the sealing lid is pressed and expanded outward of the packaging container by an end portion of the funnel component. FIG. 47 is a perspective view of a packaging container 910 to which a circular sticker label 901 is adhered.

When the sticker label 901 is adhered along a shape of a surface of the sealing lid 1960 that is expanded, the circumferential edge portion of the sticker label 901 is folded and gathered, to be crinkled, whereby appearance is spoiled. A portion of the circumferential edge portion of the sticker label 901 is lifted from the sealing lid 1960, and a gap, called lifting, may be generated between the sticker label 901 and the sealing lid 1960, whereby adhesion may become insufficient. As described above, when a sticker label is adhered to a non-flat surface, in particular, when a circular sticker label is adhered to a concentrically expanded or recessed surface, crinkling or insufficient adhesion may occur. Therefore, it is difficult to adhere a sticker label to such a surface to indicate information and represent design thereon.

In a case where, for example, a circular expansion having a height that is greater than or equal to 1 mm is included in the sealing lid 1960 having a diameter that is greater than or equal to 50 mm, and is not greater than 100 mm, when a sticker label that is formed by using synthetic paper as a main component and has a thickness that is greater than or equal to 50 μm and not greater than 100 μm, is adhered, crinkles are likely to occur. When a sticker label having a thickness greater than 100 μm is adhered, lifting is likely to occur. In a case where a sticker label is formed by using a stretchable material, when the sticker label is adhered with an adhesion surface being flat, crinkles or lifting can be reduced. However, when it is difficult to obtain a flat state as in the sealing lid 1960, reduction in crinkle and lifting is difficult.

An object of the present invention is to provide, at low cost, a funnel component that is formed by using paper as a main material, that maintains a strength sufficient for reducing deformation such as buckled state caused by, for example, load applied during storage, circulation, refilling, and the like, and that addresses environmental issues by, for example, reducing usage of aluminium foils.

Another object of the present invention is to provide a packaging container in which a funnel component formed by using paper as a main material is fitted into a container body, in which contents can be effectively prevented from moving onto an outer surface side of the funnel component, and in which resistance to buckling is also exhibited during storage.

Still another object of the present invention is to provide, at low cost, a sealing lid, for use in the packaging container, which is less likely to be cut during storage, circulation, or the like, and which addresses environmental issues.

Still another object of the present invention is to allow the sealing lid to prevent contents from spilling through perforation lines, and prevent excessive enhancement of cutting strength with which the sealing lid is cut along the perforation lines.

Still another object of the present invention is to provide such a packaging container that does not degrade design such as an outer appearance even when internal pressure is changed relative to external pressure.

Still another object of the present invention is to provide a sticker label that is less likely to generate crinkles or lifting even when such a packing container includes a non-flat surface and the sticker label is adhered to the non-flat surface.

Solution to the Problems

The present invention is directed to a funnel component that is fitted into a cylindrical container body having an open end, a bottom portion, and a side wall, and that forms a packaging container. The funnel component includes: a funnel portion having a diameter that is increased from a narrow opening side toward a wide opening side; a tubular discharge portion that connects with an end portion on the narrow opening side; and a cylindrical side wall portion that surrounds an opening portion, on the wide opening side, of the funnel, connects with the funnel portion, and is fitted into the container body. The funnel, the discharge portion, and the side wall portion are integrally formed by using a sheet member including paper and a sealant layer. A folded portion formed by the sheet member being folded back and welded over an entire circumference is provided at an opening portion of the discharge portion.

The present invention is also directed to a packaging container that includes: a cylindrical container body having an open end, a bottom portion, and a side wall; a funnel component which is fitted into the container body such that a narrow opening side portion is directed toward an open end side of the container body; and a sealing lid that seals the open end of the container body, and is cut by an external pressing force.

An opening portion, on the narrow opening side, of the funnel component preferably projects from a plane of the container body including the open end of the container body, and a projecting distance is preferably greater than 0 mm and less than or equal to 2 mm.

Further, the sealing lid preferably includes: a lower film that has a circumferential edge portion which is sealed to an opening portion of the container body to seal the container body, that has the perforation lines that are provided in a center portion other than the circumferential edge portion so as to radially extend, and that is to be cut by being externally pressed; and an upper film that is adhered to the lower film over the entire circumference of the circumferential edge portion of the lower film and in at least one adhesion region that is partially formed in a region which does not include the perforation lines of the center portion, such that the upper film is separable from the lower film.

An upper film may be adhered to the lower film over the entire circumference of the circumferential edge portion of the lower film and in at least one adhesion region that is partially formed in a region which includes the perforation lines of the center portion, such that the upper film is separable from the lower film.

Further, in the container body, a rigidity of the side wall is preferably higher than a rigidity of the bottom portion, and a plurality of ruled lines are preferably provided on an outer surface portion of the bottom portion so as to radially extend as viewed from a center portion of the bottom portion.

Further, the packaging container may further include a sticker label having, in a part of a circumferential edge portion, a plurality of recesses each formed in a curved line in a planer shape, and the sticker label may be adhered to a surface of the sealing lid, which forms an outer side of the packaging container.

Advantageous Effects of the Invention

According to the present invention, a funnel component that is formed by using paper as a main material and has strength can be provided at low cost.

Further, according to the present invention, an opening portion, on a narrow opening side, of a funnel portion projects from an open end of a container body, whereby contents can be prevented from moving onto an outer side of the funnel component in a state where the contents are packaged and the container body is sealed with a sealing lid. Further, projection of the funnel portion is optimized for paper funnel components, whereby the funnel components can be prevented from being irreversibly deformed when packaging containers are stacked and stored, for example, before contents are packaged.

Furthermore, according to the present invention, a sealing lid, of a packaging container, which is less likely to be cut during storage, circulation, or the like, can be provided. Further, such a sealing lid can prevent contents from spilling through perforation lines, and prevent excessive enhancement of cutting strength with which the sealing lid is cut along the perforation lines.

Moreover, according to the present invention, a packaging container that does not degrade design even when internal pressure is changed relative to external pressure, can be provided. Namely, rigidity of a bottom portion of the packaging container is set so as to be lower than rigidity of a side surface portion, and a plurality of ruled lines that radially extend as viewed from the center portion of the bottom portion are provided, whereby the rigidity of the bottom portion is further reduced. Therefore, even when pressure inside the packaging container is changed relative to external pressure, the bottom portion projects or is recessed to reduce change in pressure, and design such as an outer appearance of the packaging container may not be degraded. In particular, the center portion of the bottom portion is caused to project outward of the packaging container in advance. Therefore, even when pressure inside the packaging container in which contents are packaged is reduced relative to external pressure, the bottom portion having a relatively low rigidity is recessed inward of the packaging container to alleviate reduction in pressure in the container, whereby the side surface portion of the packaging container or the like is not recessed, and design such as an outer appearance of the side surface portion is not degraded. Further, a non-sealed portion is provided at an upper end of a fixing portion which is an outer edge portion of a bottom member forming the bottom portion, whereby stress is prevented from being concentrated on a portion near the outer edge of the bottom portion when the bottom portion is recessed inward, and no crinkles are generated near the outer edge and design of the bottom portion may not be degraded.

Further, according to the present invention, when a sticker label is adhered to the sealing lid, the width of the recesses at a circumferential edge portion of the sticker label is reduced, whereby generation of crinkles or lifting can be reduced.

DESCRIPTION OF EMBODIMENTS (First Embodiment)

Figure 1:
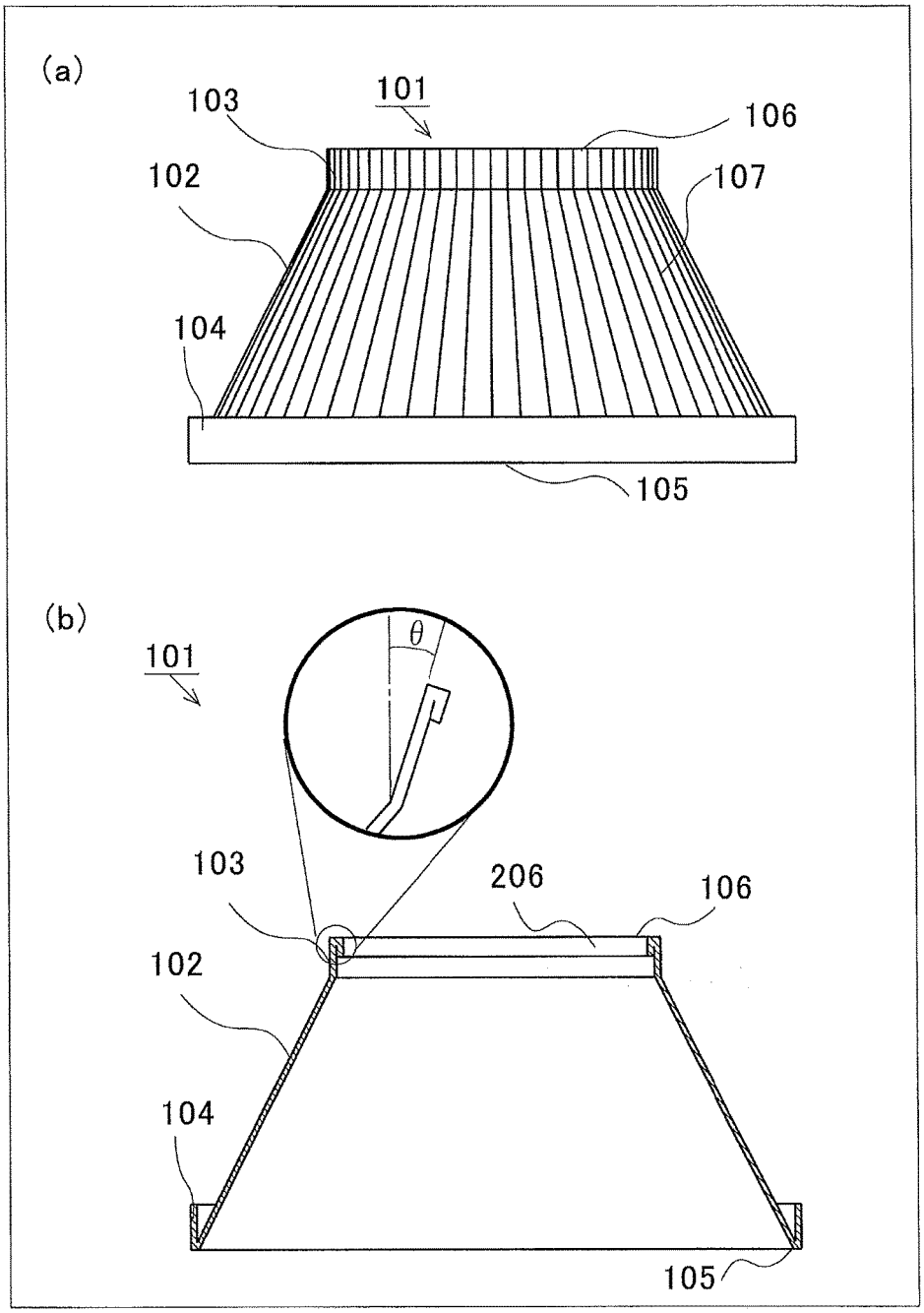
FIG. 1 is a front view and a vertical cross-sectional view of a funnel component according to a first embodiment of the present invention.

A first embodiment of the present invention will be described below. FIG. 1 is a front view (a) and a vertical cross-sectional view (b) of a funnel component 101 according to the present embodiment.

The funnel component 101 is integrally formed by using a sheet member including paper and a sealant layer, and includes a funnel portion 102, a discharge portion 103, and a side wall portion 104. A material of the sheet member is, for example, PE (polyethylene), paper, and PE which form a laminated structure. The funnel portion 102 has a circular truncated cone shape in which the diameter is reduced from a wide opening side toward a narrow opening side. An opening 105, that is, one of openings of the funnel component 101 is formed on the wide opening side. The discharge portion 103 is connected on the narrow opening side. The discharge portion 103 has a cylindrical shape, and has an opening portion 106, that is, the other of the openings of the funnel component 101. The side wall portion 104 has a cylindrical shape in which the diameter is almost uniform, surrounds the outer surface of the funnel portion 102, and is connected with the circumferential edge around the opening 105.

In the discharge portion 103, a folded portion 206 is formed by a portion of the sheet member being folded back inward. The folded portion 206 is welded to another portion of the sheet member of the discharge portion 103. The folded portion 206 allows enhancement of a strength at the opening portion 106. Further, a plurality of ruled lines 107 are provided on the funnel portion 102 and the discharge portion 103. The ruled lines 107 extend radially along lines of intersections between the funnel component 101 and planes including the central axis of the funnel component 101. Each of the ruled lines 107 is welded in a state where the ruled lines are squeezed to have recesses buried as described below. Thus, strength is enhanced in the entirety of the funnel component 101.

As shown in a partially enlarged portion in (b) of FIG. 1, the discharge portion 103 may be tapered so as to have a rotationally symmetrical shape with respect to the central axis of the funnel component 101. A taper angle (θ in (b) of FIG. 1) of the discharge portion 103 is preferably set so as to range from 0° to 15°. Among the range, the taper angle is more preferably set so as to range from 5° to 10°. The greater the taper angle is, the more easily the funnel component can be removed from a die when the funnel component is manufactured as described below. However, when the taper angle is greater than 15°, strength of the discharge portion is reduced. When the taper angle is 0°, although strength, against buckling, of the funnel component 101 is maximum, efficiency for removing the funnel component from a die is reduced as described above. Further, a dimension, along the central axis direction of the funnel component, of the discharge portion 103 is preferably set so as to range from 7 mm to 15 mm. When the height of the discharge portion 103 is less than 7 mm, insertion into a tank of a coffee machine as described below cannot be performed. On the other hand, when the height of the discharge portion 103 is greater than 15 mm, the discharge portion hits against a component of the tank.

Figure 2:
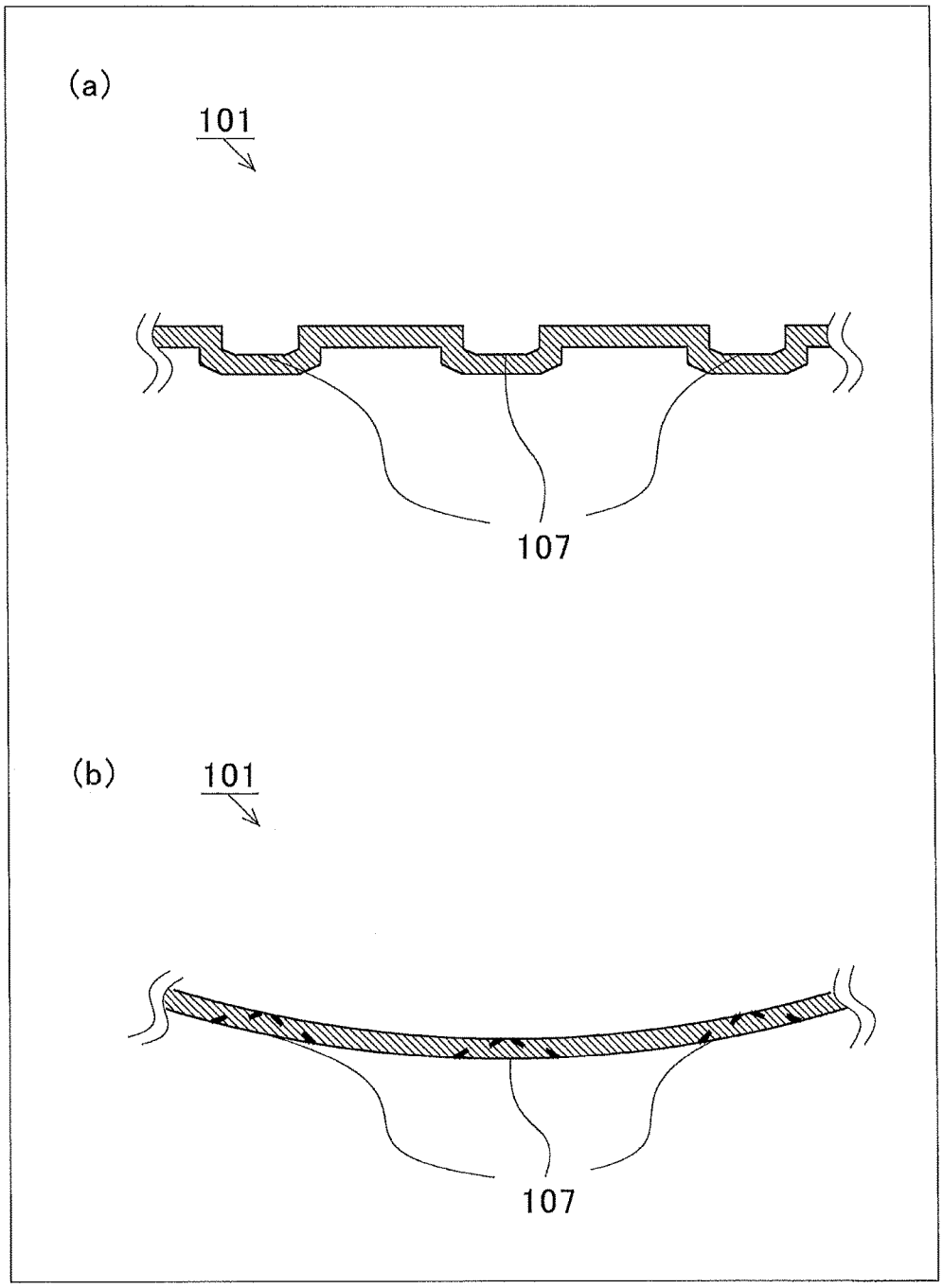
FIG. 2 is a cross-sectional view of a blank material and the funnel component according to the first embodiment of the present invention.

A sector-shaped blank material by which the funnel component 101 is formed is formed by a sheet member in which paper and resins are layered being punched by using a die. The blank material is rolled to overlay and seal linear side edge portions onto each other, thereby temporarily forming a circular-truncated-cone-shaped intermediate product. Thereafter, the intermediate product is subjected to drawing process to form each part of the funnel component 101. The blank material has the plurality of ruled lines 107 as shown in (a) of FIG. 2. When the intermediate product is heated during the drawing process, a sealant layer is welded in a state where recesses and projections of the ruled line 107 portions are squeezed as shown in (b) of FIG. 2. By the recesses and projections of the ruled line 107 portions being thus squeezed, rigidity of the funnel portion 102 is enhanced. Further, this maintains the horizontal cross section so as to be circular. Therefore, instead of conventional funnel components made of resin, this funnel component can be used.

Figure 3:
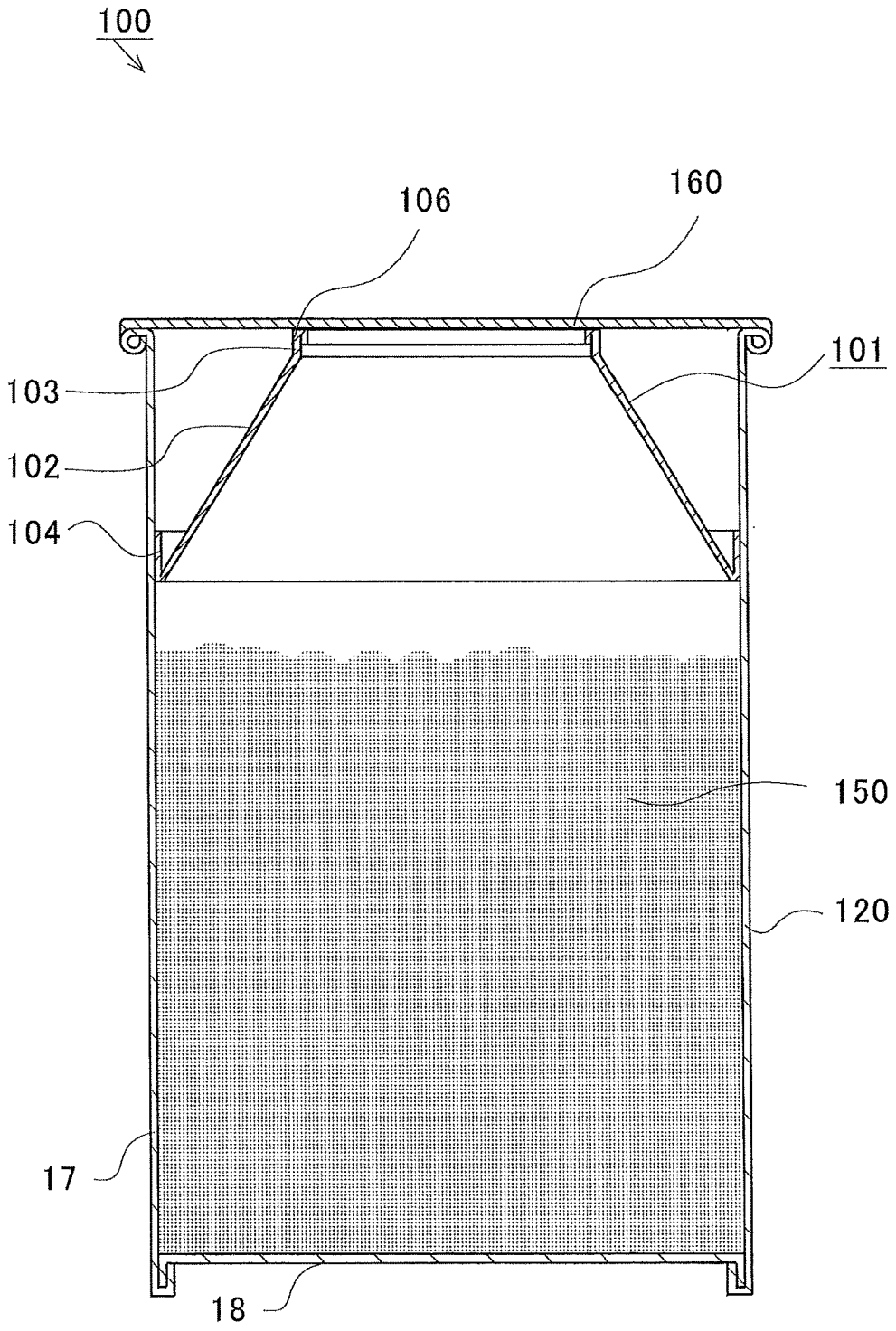
FIG. 3 is a vertical cross-sectional view of a packaging container according to the first embodiment of the present invention.

FIG. 3 is a vertical cross-sectional view of a packaging container 100 that includes the funnel component 101 described above. The packaging container 100 includes a cylindrical container body 120, the funnel component 101, and a sealing lid 160. The side wall portion 104 of the funnel component 101 is fitted into the container body 120 and is joined to the inner surface of the container body 120. Further, an edge of the opening portion 106 of the discharge portion 103 and an edge of an open end of the container body 120 are coplanar with each other. The edge of the opening portion 106 may be formed so as to slightly project from the container body 120 outward of a plane including the edge of the open end of the container body 120. Contents 150 are packaged in the container body 120, and the open end of the container body 120 is sealed with the sealing lid 160. When the contents 150 are packaged therein, a nozzle of a filling machine is inserted into the discharge portion 103. When the contents 150 are powdery, a gap between the nozzle and the opening portion 106 is covered with a lid member of the nozzle, and the entirety of the edge of the discharge portion 103 is slightly pressed by the lid member, in order to prevent the contents from scattering. In the present embodiment, the taper angle of the discharge portion 103 is less than or equal to 15°, and therefore strength of the discharge portion 103 against the pressing is assuredly obtained. Thus, even when the pressing by the lid member is performed, deformation of the funnel component 101 is prevented.

The enhancement of the strength as described above prevents deformation of the funnel component 101 when the funnel component 101 is mounted to the container body 120, or during storage and usage (when the contents are transferred to a storage container) after the contents 150 are packaged. For example, during storage, a state where a position of the edge of the opening portion 106 of the discharge portion 103 is lowered to generate a gap at a contact portion with the sealing lid 160, and the contents 150 are moved through the gap onto the outer side of the funnel component 101, can be prevented. Further, by the ruled lines 107 being squeezed, when the contents 150 are transferred to a storage container, the contents 150 are prevented from being caught and left in the ruled lines 107. As a material of the sheet member, a sealant layer in which a thermoplastic resin or a hot-melt adhesive is used for one of or both of an outermost layer and an innermost layer, may be used. Further, the sheet member may not include paper.

Figure 4:
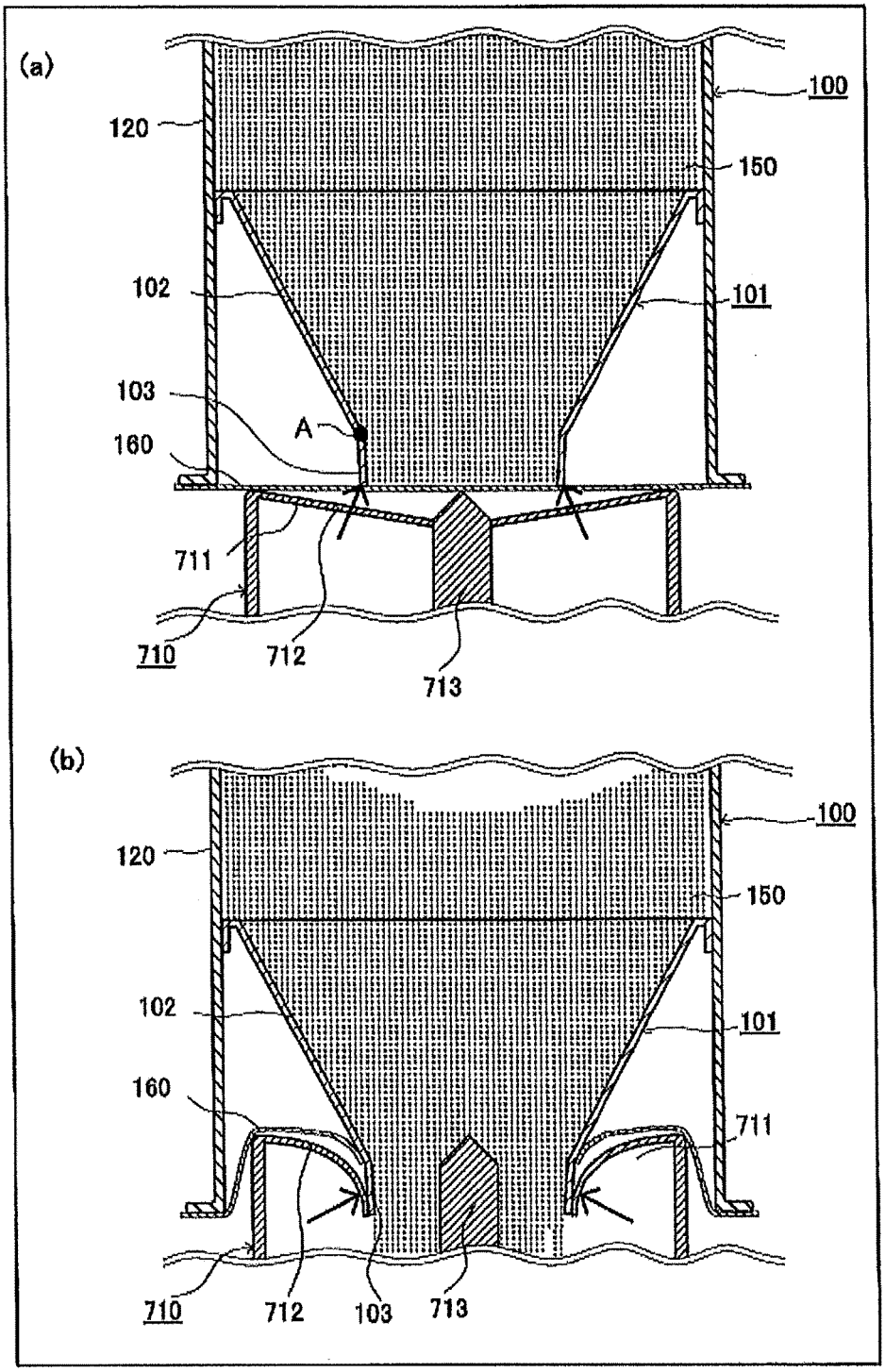
FIG. 4 is a cross-sectional view illustrating a state where the packaging container shown in FIG. 8 is used.

FIG. 4 is a cross-sectional view illustrating a state where the packaging container shown in FIG. 3 is used. A tank 710 shown in FIG. 4 is an exemplary container to be refilled with the contents 150. In FIG. 4, portions other than a filling opening of the tank 710 are not shown.

As shown in (a) of FIG. 4, during transfer and refilling operation, the packaging container 100 is pressed into the tank 710 in a state where the sealing lid 160 opposes an opening 711 of the tank 710.

When the sealing lid 160 is cut by an opening member 713 of the tank 710, the center portion of a rubber member 712 that covers the tank 710 is pressed and widened by the discharge portion 103 of the packaging container 100 as shown in (b) of FIG. 4, and the discharge portion 103 is inserted through the opening 711 into the tank 710. In this state, the contents 150 enter the tank 710 along the inner surface of the funnel component 101.

However, when the packaging container 100 is pressed and inserted in the state shown in (a) of FIG. 4, the packaging container 100 may not be always pressed and inserted vertically downward, and may be pressed and inserted diagonally downward. In a case where the packaging container 100 is pressed and inserted diagonally downward, when the discharge portion 103 contacts with the rubber member 712, pressing force in a diagonal direction (for example, directions indicated by arrows in (a) of FIG. 4) is applied to the discharge portion 103. In the present embodiment, the entirety of the funnel component 101 is not deformed and only the discharge portion 103 is deformed from a boundary A, due to the pressing force applied to the funnel component 101. Therefore, deformation of the funnel portion 102 is effectively reduced.

(Second Embodiment)

Figure 5:
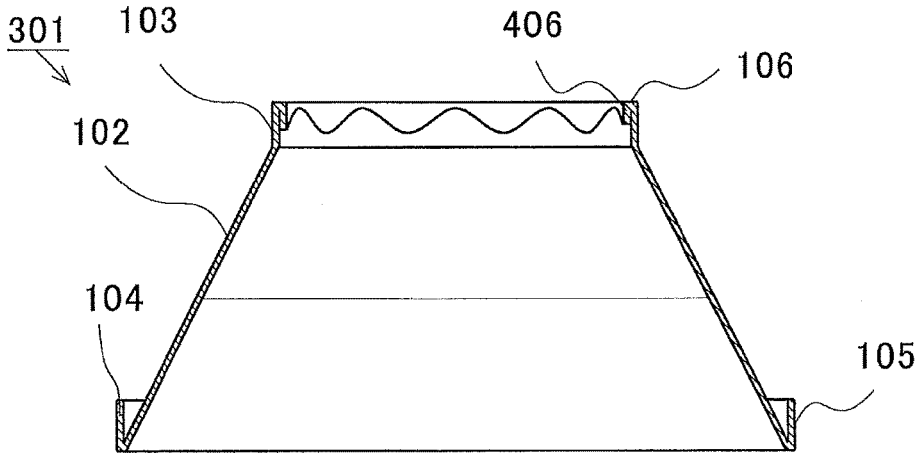
FIG. 5 is a vertical cross-sectional view of a funnel component according to a second embodiment of the present invention.

A second embodiment of the present invention will be described below. FIG. 5 is a vertical cross-sectional view of a funnel component 301 according to the present embodiment. The funnel component 301 is different from the funnel component 101 of the first embodiment in that the funnel component 301 includes a folded portion 406 having a corrugated edge. The other portions are the same between the funnel components 301 and 101, and are denoted by the same reference numerals. The shapes of the folded portions are different due to a shape of a blank material used for manufacturing the funnel component 301 and the shape of the blank material used for manufacturing the funnel component 101 being different from each other.

In the forming process for the funnel component 301, when a narrow opening side portion of a circular-truncated-cone-shaped intermediate product is folded back such that the taper angle is greater than or equal to about 10°, a difference between a circumferential length of a folding line portion and a circumferential length of a portion near the edge of the sheet member is increased, and this difference cannot be absorbed by elongation of the sheet member. Therefore, when folding-back is performed, the edge of the folded portion may be cut due to a high tensile force being applied along the circumferential direction.

Figure 6:
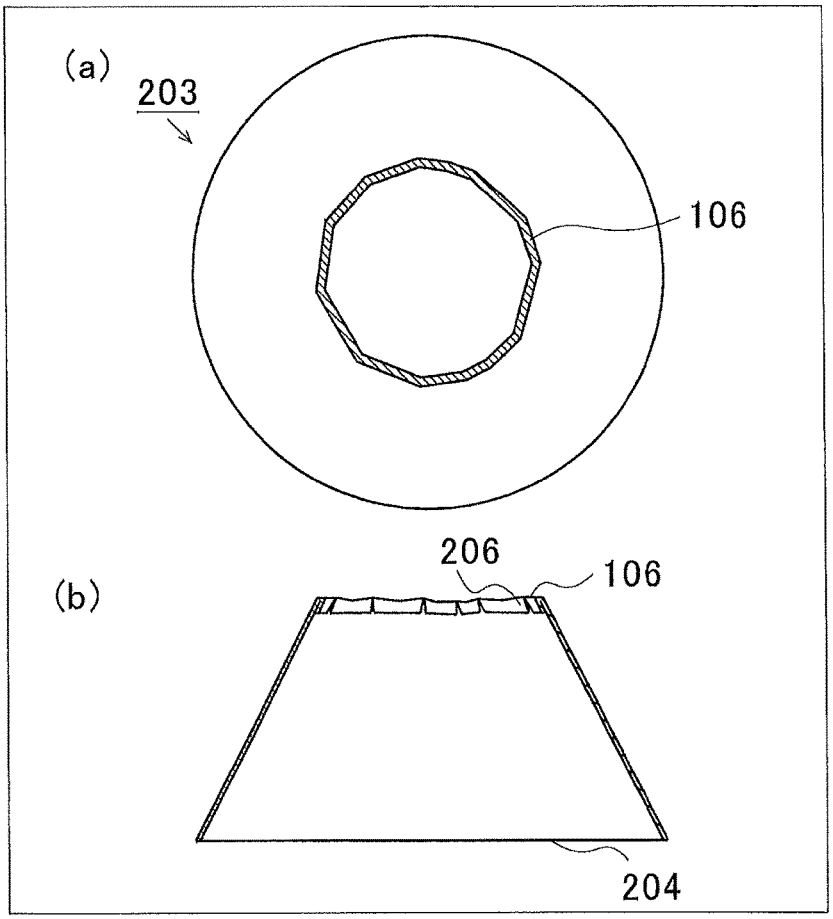
FIG. 6 illustrates a problem to be solved by the present invention.

FIG. 6 is a top view (a) and a front view (b) of an intermediate product 203 in the case of cut being generated due to the folding-back. As shown in FIG. 6, when the folded portion 206 is cut, the opening portion 106 is not circular, but has a polygonal shape in which tips of cut portions are its vertexes, and stress is concentrated on the vertexes, whereby cutting is likely to occur. Further, the heights at the vertexes are not uniform and the top surface of the opening portion 106 is not flat. Therefore, an influence may be exerted when the edge of the open end of the container body 120 is sealed with the sealing lid 160, whereby a quality may be degraded. Further, when slits are previously formed in the folded portion 206, although cut can be prevented from occurring anew during the folding-back, the slits themselves may cause similar degradation in quality.

On the other hand, in the folded portion 406 of the present embodiment, high tensile force is not applied to peak portions (portions that are far from a folding position that is the edge of the opening portion 106) of the corrugated line during folding-back. Further, in valley portions of the corrugated line, stress is likely to be dispersed as compared to a case where slits that are cut portions having acute angles are provided. Therefore, cut is less likely to be generated, whereby degradation in quality as described above can be prevented. Therefore, in the present embodiment, folding-back and welding processes for the folded portion 406 can be performed prior to processes of forming the discharge portion 103 and removing the taper.

Further, high resisting force is not applied to an inward curling die used for forming the folded portion 406, from the edge of the folded portion 406, whereby the folding-back process can be performed by low pressing pressure. Therefore, manufacturing failure where portions other than the folding lines are bent to buckle the funnel component 301 can be reduced even when little fluid paraffin is applied for improving slidability of the die and the sheet member, (Third Embodiment)

Figure 7:
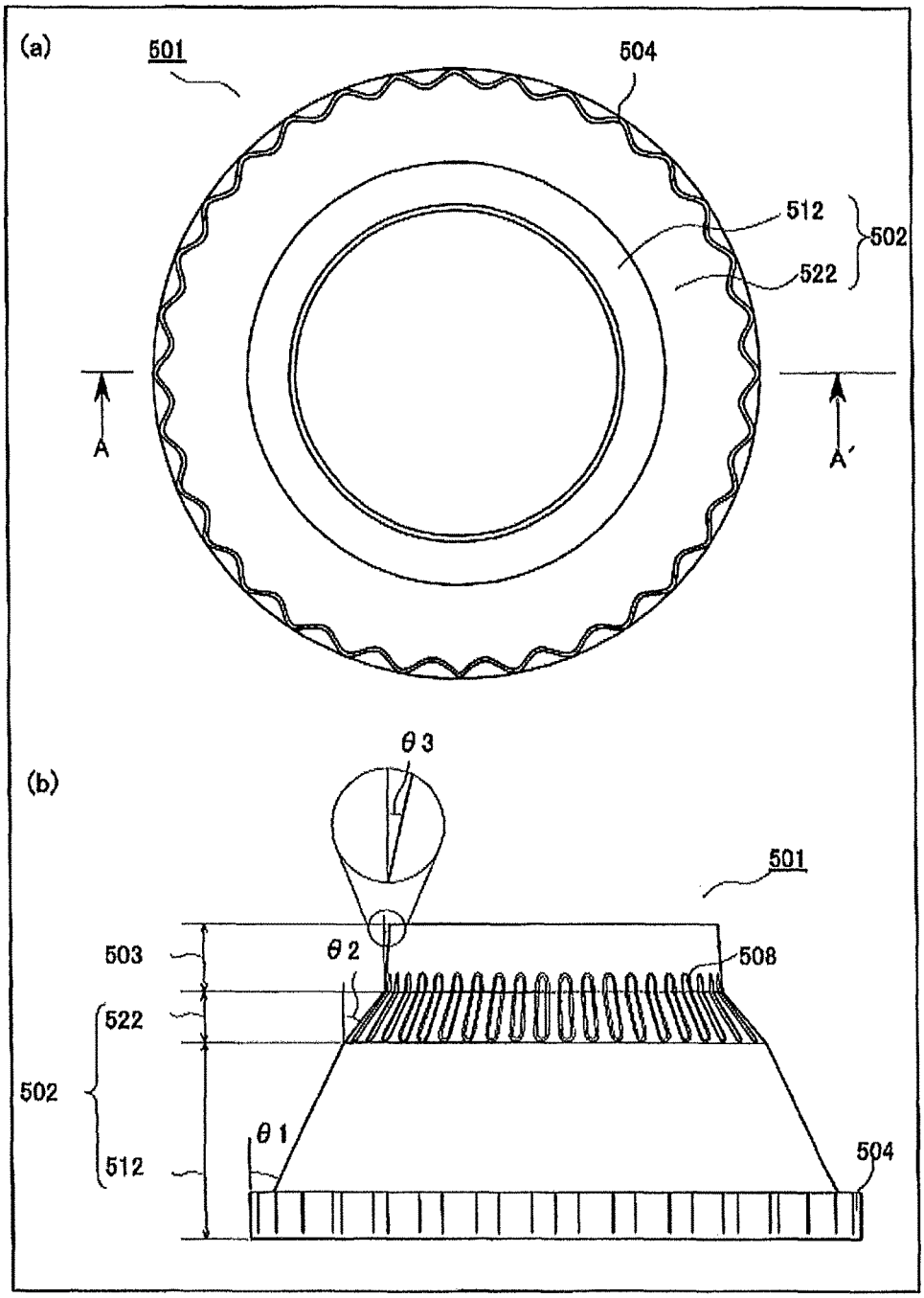
FIG. 7 is a top view and a front view of a funnel component according to a third embodiment of the present invention.
Figure 8:
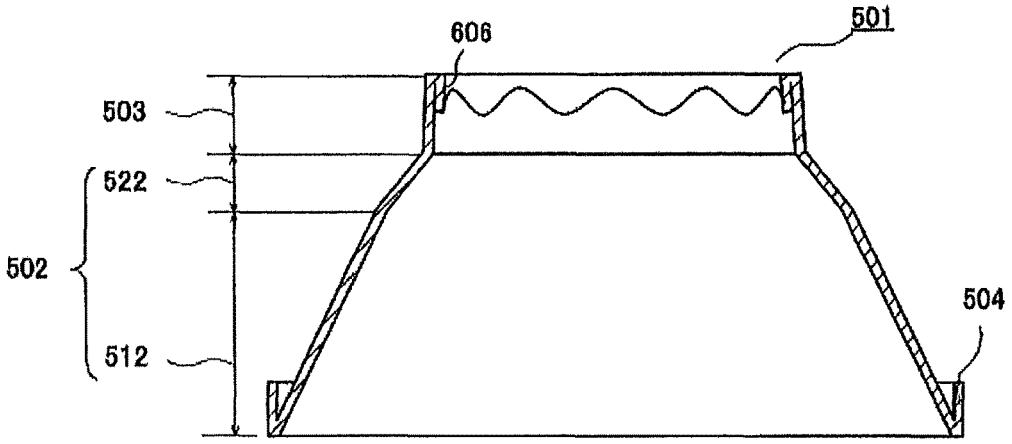
FIG. 8 is a vertical cross-sectional view of the funnel component according to the third embodiment of the present invention.

FIG. 7 is a top view and a front view of a funnel component according to a third embodiment of the present invention. FIG. 8 is a cross-sectional view taken along a line A-A' in (a) of FIG. 7.

A funnel component 501 of the third embodiment is different from the funnel components of the first and second embodiments in shapes of the funnel portion and the side wall portion. In the below description, the same components as described for the first or the second embodiment are not described.

A funnel portion 502 is tapered so as to have a rotationally symmetrical shape with respect to the central axis, and includes a first tapered portion 512 on the wide opening side, and a second tapered portion 522 that is closer to the narrow opening than the first tapered portion 512 is. A taper angle θ2 of the second tapered portion 522 is greater than a taper angle θ1 of the first tapered portion 512. Further, a discharge portion 503 is tapered so as to have a rotationally symmetrical shape with respect to the central axis, and has a taper angle represented as θ3. As in the first embodiment, θ3 is preferably set so as to range from 0° to 15°. Further, as shown in FIG. 8, a folded portion 606 of the discharge portion 503 has a corrugated edge. Further, in an outer surface of the funnel component 501 over the first tapered portion 512 to the discharge portion 503, grooves 508 are formed by embossing process. The grooves 508 extend radially along lines of intersections between the funnel component 501 and planes including the central axis of the funnel component 501. Further, a side wall portion 504 is formed so as to be corrugated such that distances from the central axis of the funnel portion 502 are increased or reduced on a horizontal cross-section orthogonal to the central axis of the funnel component 501, as shown in (a) of FIG. 7. The side wall portion 504 may be corrugated such that at least a portion, of the side wall portion 504 including the upper edge thereof is corrugated.

Figure 10:
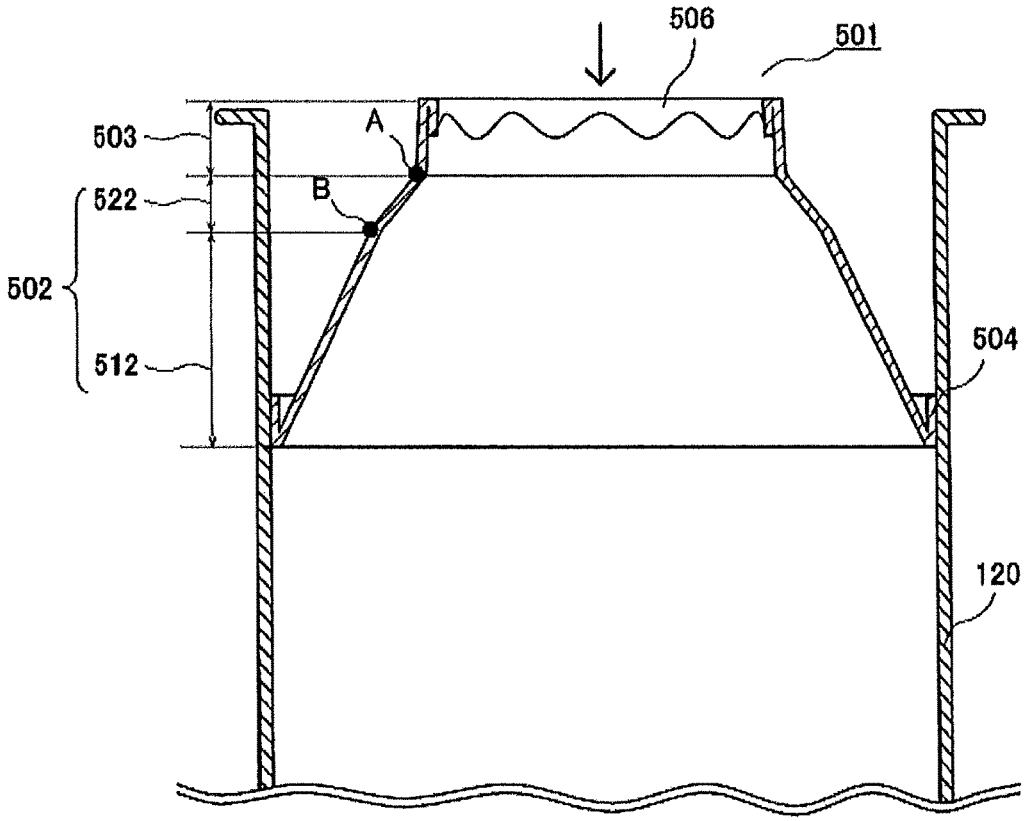
FIG. 10 illustrates a vertical cross-section of a container body to which the funnel component is joined.

The funnel component 501 formed as described above is mounted in the container body 120 as shown in FIG. 10. The funnel component 501 is mounted such that the side wall portion 504 is heated by hot air to melt a sealant, the funnel component 501 is thereafter inserted into the container body 120, and the side wall portion 504 of the funnel component 501 is pressed and widened, to press-bond the funnel component 501 to the inner surface of the container body 120.

Figure 9:
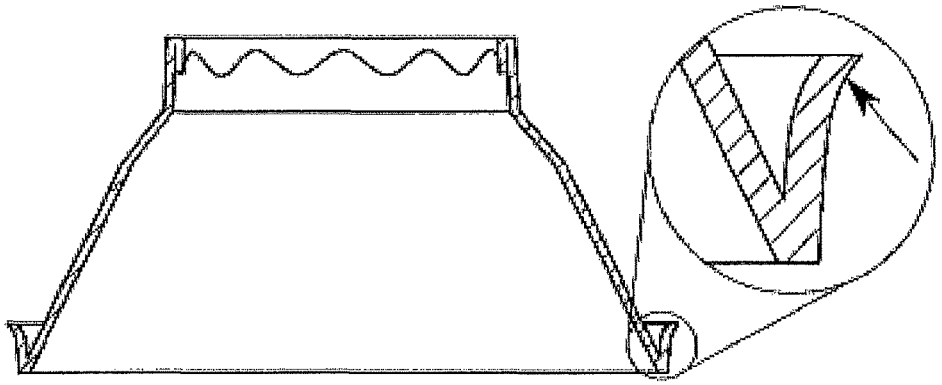
FIG. 9 is a cross-sectional view illustrating warping of a side wall portion of the funnel component.

In a process of forming the funnel component 501, in a case where the edge portion, on the wide opening side, of a circular-truncated-cone-shaped intermediate product is simply folded back to form the side wall portion, warping occurs at the top end of the side wall portion due to difference in circumferential length between a folding portion (namely, a connection portion between the side wall portion and the funnel portion) and the top end of the side wall portion, as shown in FIG. 9. Due to the warping, when the funnel component having been heated by hot air is inserted into the container body, friction may generated between the outer surface of the side wall portion and an open end or an inner surface of the container body, to generate resin dusts, or a strength for adhesion between the side wall portion and the container body may be reduced.

On the other hand, in the funnel component 501 of the third embodiment, the side wall portion 504 has a corrugated horizontal cross-sectional shape, and thus a difference of the circumferential length of the side wall portion 504 as described above can be absorbed, and warping of the top end of the side wall portion 504 can be reduced. Further, since the side wall portion 504 having the corrugated shape is stretchable, the outer diameter of the side wall portion 504 is designed so as to be slightly less than the inner diameter of the container body 120, and the side wall portion 504 is pressed and widened when joined, thereby enabling prevention of friction occurring when the funnel component 501 is inserted into the container body 120.

As shown in FIG. 10, the funnel component 501 of the present embodiment includes the first tapered portion 512 and the second tapered portion 522 that have different taper angles, respectively. In this structure, at a boundary A between the discharge portion 503 and the second tapered portion 522 and a boundary B between the second tapered portion 522 and the first tapered portion 512, deformation of the funnel component 501 is likely to occur, and this deformation enables pressing force applied to the discharge portion 503 to be absorbed. For example, the container bodies shown in FIG. 10 are stacked vertically one on top of another, and conveyed or stored. Further, the discharge portion 503 may be pressed by a sealing lid of a filling nozzle when contents are packaged. In these cases, pressing force applied to the discharge portion 503 is absorbed by the funnel component 501 being deformed, thereby effectively reducing buckling of the funnel component 501. In the third embodiment, cushioning property exhibited by the funnel component 501 can prevent buckling even when a higher external force is applied.

An exemplary case is assumed where the funnel component 501 that was 45 mm high, and had an outer diameter of 94 mm on the wide opening side and an outer diameter of 64 mm on the narrow opening side, was formed by using a sheet in which polyethylene layers having a thickness of 30 μm were layered on both sides of a sheet of paper having a basis weight of 300 g/m$^2$ (thickness was 350 μm). In this case, even when the funnel component 501 was deformed so as to change the height by 3 mm (a load of 120 N was applied to the end of the discharge portion of the funnel component), no buckling occurred.

The funnel component 501 is joined to the inner portion of the container body 120 such that the open end of the discharge portion 503 slightly projects from the container body 120 outward of the plane including the edge of the open end of the container body 120, as shown in FIG. 10. Thus, after an opening portion 506 is sealed with a sealing lid (not shown), the sealing lid is constantly pressed by the edge of the discharge portion 503, and therefore the contents (not shown) are less likely to move onto the outer side of the funnel component 501.

(Modification of Third Embodiment)

The funnel component of the third embodiment may include a side wall portion having a corrugated horizontal cross-section that is formed by embossing process.

(Fourth Embodiment)

Figure 11:
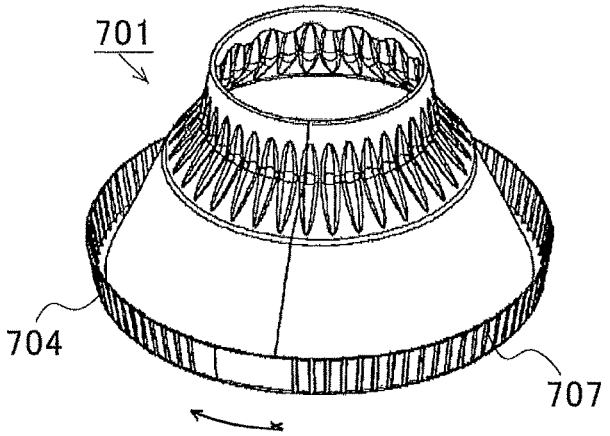
FIG. 11 is a perspective view of a funnel component according to a fourth embodiment.

FIG. 11 is perspective view of a funnel component according to a fourth embodiment.

A funnel component 701 of the fourth embodiment includes the same funnel portion and discharge portion as described for the funnel component 501 of the third embodiment, and includes a side wall portion 704 which is different from the side wall portion of the third embodiment. The side wall portion 704 is formed by the end portion, on the wide opening side, of the opening portion being folded back outward, and the side wall portion 704 has a plurality of ruled lines 707 that extend parallel to the central axis of the funnel portion.

In a process step of forming the side wall portion 704, the folded portion on the wide opening side is drawn by using a die, whereby the folded portion is compressed in the circumferential direction. The outer diameter of the side wall portion 704 is designed so as to be less than the inner diameter of the container body, as a result of the drawing process, before the funnel component 701 is mounted to the container body. After the funnel component 701 is inserted into the container body, the side wall portion 704 is pressed and widened by using a die, and welded to the inner surface of the container body. In a case where the ruled lines 707 are provided, and expanded and contracted at the side wall portion 704 as described above, when a sealant on the outer surface of the side wall portion 704 is melted and insertion in to the container body is performed, generation of resin dusts due to friction between the sealant and the inner surface of the container body, or reduction in adhering strength can be prevented, as in the third embodiment.

As described above, a sheet member containing paper is punched and is thereafter subjected to press work, whereby the funnel component in which strength is maintained can be provided at low cost. Further, resource saving can be made as compared to a case where a conventional funnel component made of resin is provided. Such a method for manufacturing the funnel component can be applied in various manners to other products, such as paper cups, which are thus formed. Further, the method can be applied to products which are thus formed and have polygonal horizontal cross-sections as well as products that are thus formed and have circular horizontal cross-sections.

An example of the fourth embodiment of the present invention will be described.

In the present example, the container body 120 includes a side wall 17 formed into a cylindrical shape by using a rectangular sheet member, and a bottom portion 18 formed by using a circular bottom member. Further, a flange portion 12 is formed, at an open end of the container body 120, by a portion of the side wall 17 being folded outward. The flange portion 12 may be a curled portion formed by the end portion of the side wall 17 being folded back outward over the entirety of the circumference so as to have a curved surface. Alternatively, the flange portion 12 may be formed by the curled portion being squeezed and flattened.

The container body 120 is made of a material including paper as a main component, in consideration of reduction in weight of the container, facilitation of disposal, and resource saving. For example, a laminated film formed by paper and resin may be used. When gas barrier property is required, a gas barrier layer, such as a transparent deposition film, an aluminium foil, or the like, is included in the laminated structure.

Figure 12:
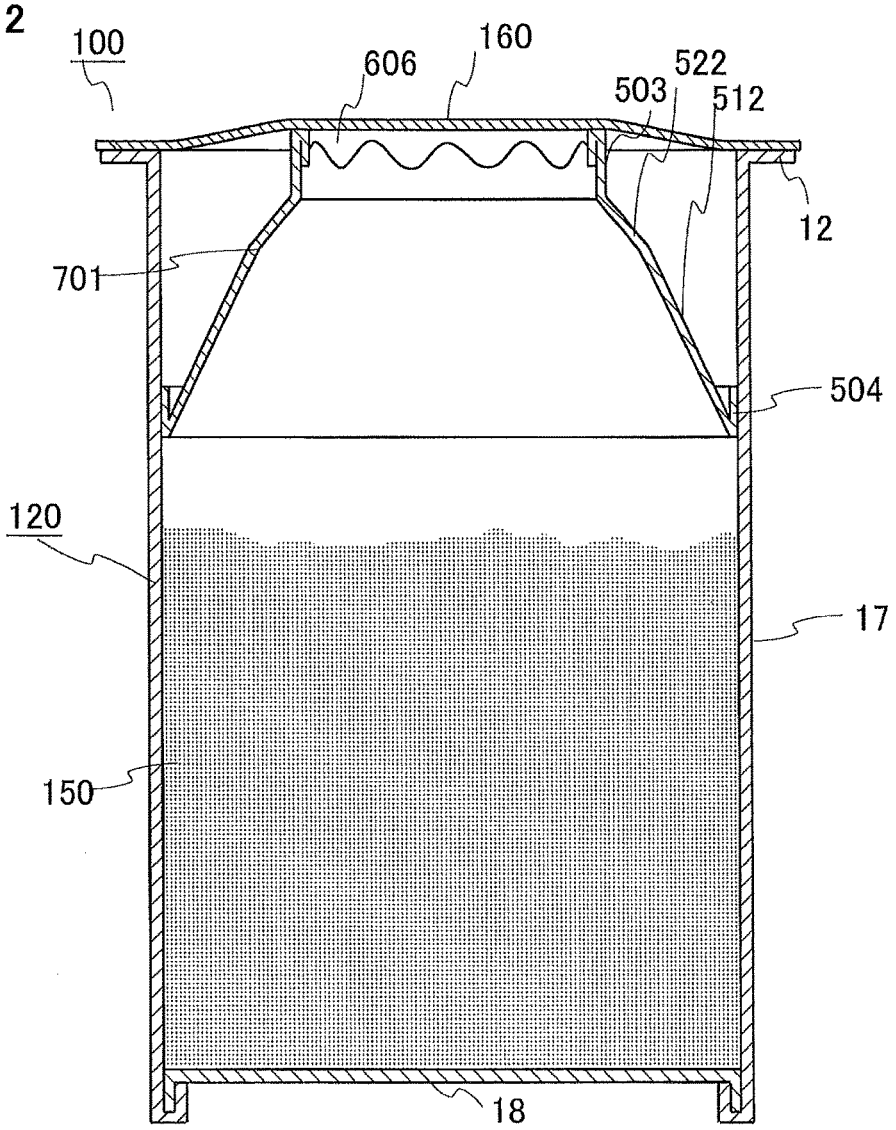
FIG. 12 is a cross-sectional view illustrating a state where an open end of a packaging container shown in FIG. 10 is sealed.
Figure 13:
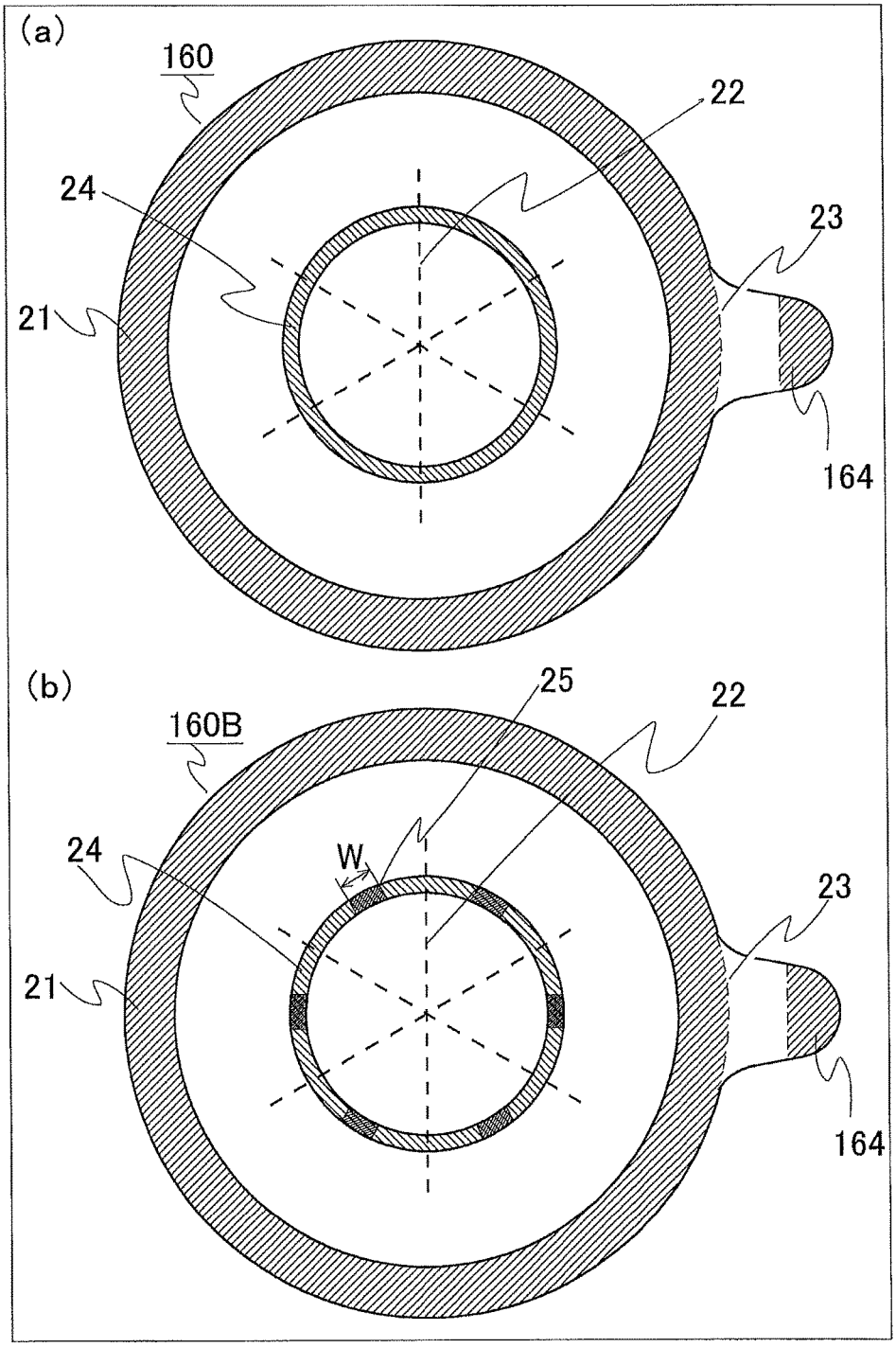
FIG. 13 is a top view of a sealing lid according to an example of the fourth embodiment and a fifth embodiment of the present invention.

FIG. 12 is a cross-sectional view illustrating a state where the open end of the packaging container 100 of the present example is sealed with the sealing lid 160. (a) of FIG. 13 is a top view of the sealing lid 160 according to the present example. A circumferential portion 21 of the sealing lid 160 is heat-sealed to the flange portion 12 of the container body 120. Further, a plurality of perforation lines 22 are formed at the center portion of the sealing lid 160 so as to radially extend, and the perforation lines 22 are cut by a pressing force being applied to the sealing lid 160 from a container to be refilled during usage.

As described above, since the opening portion, on the narrow opening side, of the funnel component 701 projects from the open end of the container body, the opening portion, on the narrow opening side, of the funnel component 701 and the sealing lid 160 are maintained so as to be in close contact with each other at a contact portion 24 in a state where the contents 150 are packaged and sealing with the sealing lid 160 is performed. As a result, even when the packaging container 100 turns over and lies on its side, or is turned upside down when used, the contents 150 are prevented from moving onto the outer side of the funnel component 701.

Figure 14:
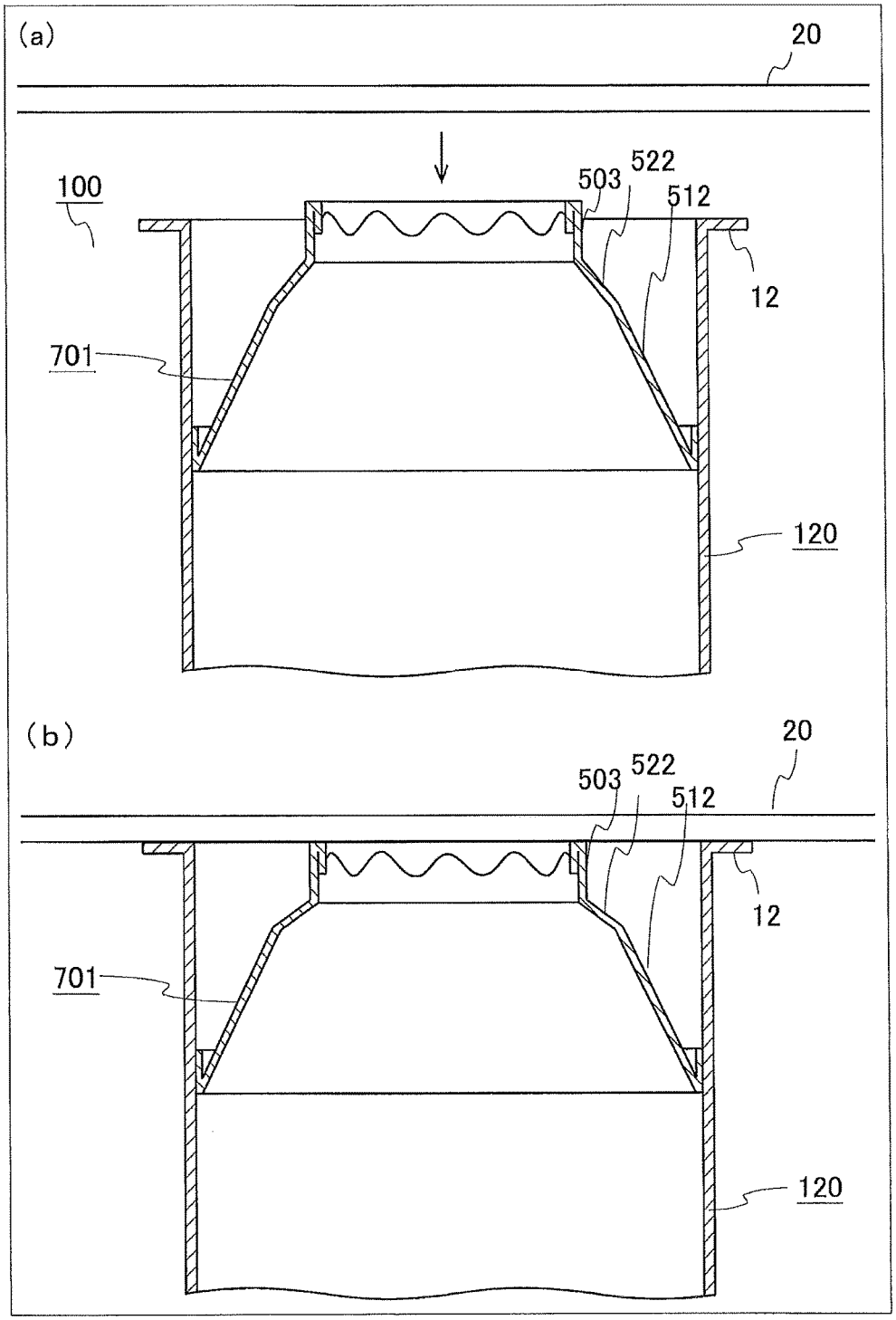
FIG. 14 is a cross-sectional view illustrating a method by which packaging containers according to the example of the fourth embodiment of the present invention are stacked.

FIG. 14 is a cross-sectional view illustrating a method for stacking the packaging containers before contents are packaged according to the present example.

When the packaging containers 100 are transported or stored, a plate member 20 such as a laminated board or laminated paper is put, at the open end portion of the container body 120, on a plurality of the packaging containers 100 aligned and erected on a pallet, and, on the plate member 20, a plurality of the packaging containers 100 and the plate member 20 are further stacked alternately. When the plate member 20 is put on the packaging container 100 as shown in (a) of FIG. 14, a connection portion between the first tapered portion 512 and the second tapered portion 522 and a connection portion between the second tapered portion 522 and the discharge portion 503 are bent and deformed as shown in (b) of FIG. 14, whereby the funnel portion 502 is compressed. When, as in the funnel component 701 of the present example, the first tapered portion 512 and the second tapered portion 522 having a taper angle greater than the first tapered portion 512 are provided from the wide opening side toward the narrow opening side, the second tapered portion 522 can be elastically deformed. Therefore, even when pressing force is applied from the plate member 20, the funnel portion 502 and the discharge portion 503 can be prevented from being irreversibly buckled.

A distance by which the funnel component 701 projects when the funnel component 701 is formed by a material including paper as a main component, will be described.

Figure 15:
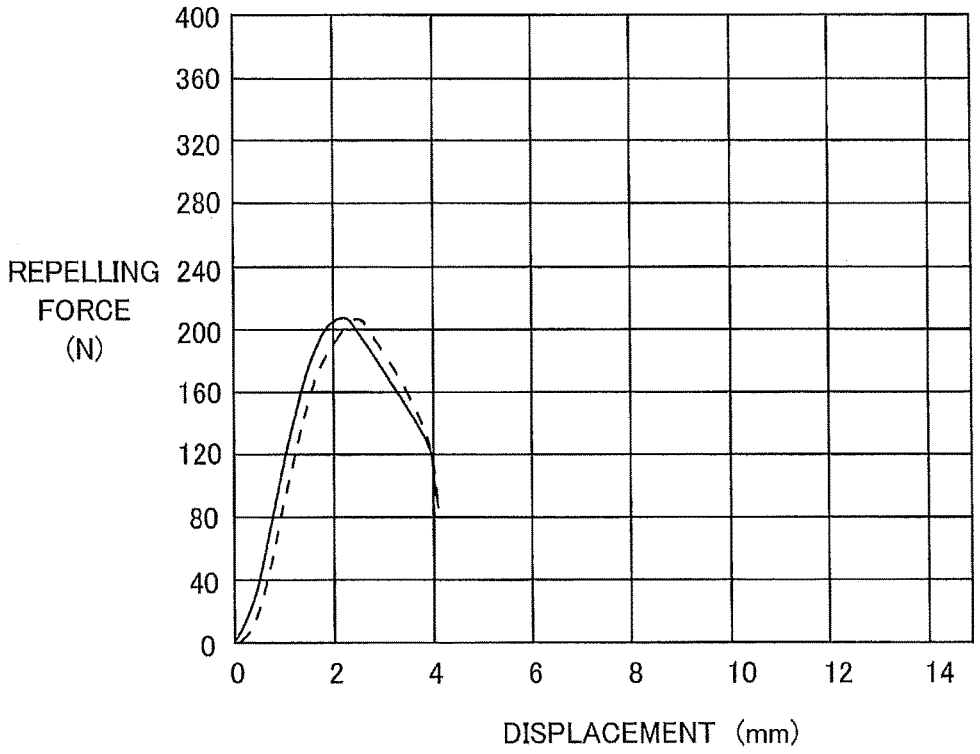
FIG. 15 shows a graph representing a relationship between load applied to the funnel component and displacement thereof.

FIG. 15 shows a graph representing a relationship between loads applied to the funnel component and displacements. In FIG. 15, a solid line and a dashed line represent test results from two samples, respectively.

More specifically, FIG. 15 shows a result obtained when samples in each of which the funnel component 701 was mounted to the container body 120 in a state where the opening portion, on the narrow opening side, of the funnel component 701 was caused to project from a plane including an open end of the container body 120, by a few millimeters (however, a value greater than 2 mm), were prepared and a load was applied to each opening portion on the narrow opening side, to measure a relationship between displacement of the opening portion on the narrow opening side, and repelling force from the opening portion on the narrow opening side. According to the result shown in FIG. 15, when a displacement of the opening portion on the narrow opening side ranges from 0 to about 2.2 mm (in a range from the originating point to the vertex of the graph), repelling force from the opening portion on the narrow opening side is increased, whereas when a displacement becomes greater than 2 mm, repelling force from the opening portion on the narrow opening side is reduced. This result indicates that, when a displacement of the opening portion on the narrow opening side ranges from 0 to 2.2 mm, the funnel portion 502 and the discharge portion 503 are elastically deformed, whereas, when a displacement becomes greater than about 2.2 mm, the funnel portion 502 and the discharge portion 503 are irreversibly buckled.

According to the result shown in FIG. 15, in a case where a distance by which the opening portion, on the narrow opening side, of the funnel component 701 projects is set so as to be greater than 0 mm and less than or equal to 2 mm, the funnel portion 502 and the discharge portion 503 are not buckled even when the packaging containers 100 are stacked in the state shown in (b) of FIG. 14, and the funnel portion 502 and the discharge portion 503 are restored to original positions when load on the opening portion, on the narrow opening side, of the funnel component 701 is removed. In practice, it was confirmed that, in a case where load was applied to the opening portion, on the narrow opening side, of the funnel component 701 in the state shown in (b) of FIG. 14 for two weeks, and the load was thereafter removed, the funnel portions 502 and the discharge portions 503 of 70% or more of the packaging containers 100 were restored soon. Since load from the plate member 20 is received at the flange portion 12 in the state shown in (b) of FIG. 14, the funnel portion 502 and the discharge portion 503 are not deformed so as to exceed an originally determined distance by which the opening portion on the narrow opening side projects.

As described above, it is advantageous that the funnel component 701 is fitted into the container body 120 such that the opening portion on the narrow opening side projects from a plane including the open end of the container body 120, and a distance d by which the opening portion, on the narrow opening side, of the funnel component 701 projects from the plane including the open end of the container body 120 is set so as to be greater than 0 mm and less than or equal to 2 mm. In particular, when the distance d by which the opening portion on the narrow opening side projects is greater than or equal to 0.5 mm, and not greater than 1.5 mm, positioning of the funnel component 701 relative to the container body 120 is facilitated, whereby the packaging container 100 can be easily manufactured.

As described above, in the present example, since the opening portion, on the narrow opening side, of the funnel component 701 projects from the open end of the container body 120, the contents 150 can be prevented from moving onto the outer side of the funnel component 701 in a state where the container body 120 is filled with the contents 150 and sealed with the sealing lid 160. Further, since a distance by which the opening portion, on the narrow opening side, of the funnel component 701 projects is optimized for the funnel component 701 made of paper, the funnel component 701 can be prevented from being irreversibly deformed when the packaging containers 100 are stacked and stored.

Since the funnel component 701 of the present example can be elastically deformed due to the first tapered portion 512 and the second tapered portion 522, even when force applied from the sealing lid 160 to the funnel component 701 is changed due to internal pressure being changed after the open end of the container body 120 is sealed with the sealing lid 160 as shown in FIG. 12, the sealing lid 160 and the opening portion, on the narrow opening side, of the funnel component 701 can be maintained so as to be in close contact with each other.

In the present example, the sealing lid 160 has a tab 164 that extends from a portion of the circumferential portion of the sealing lid 160. However, the sealing lid 160 may not have the tab 164.

(Fifth Embodiment)

A fifth embodiment of the present invention will be described. Description of the same contents as described for the example of the fourth embodiment is omitted as appropriate.

(b) of FIG. 13 is a top view of a sealing lid 160B according to the present embodiment. In the sealing lid 160B, the opening portion, on the narrow opening side, of the funnel component 701 and the contact portion 24 to be adhered to the opening portion, on the narrow opening side, of the funnel component 701 as described in the example of the fourth embodiment, are partially adhered to each other at adhesion portions 25 in regions, other than the perforation lines 22, each of which is sandwiched by the perforation lines. The adhesion portions 25 can be formed by heat-sealing being performed simultaneously when the circumferential portion 21 of the sealing lid 160B is heat-sealed to the flange portion 12. When the number of the adhesion portions 25 is excessively small, or a width W of each adhesion portion 25 is excessively small, separation occurs in adhesion. When the number of the adhesion portions is excessively great or the width W of each adhesion portion 25 is excessively great, opening of the sealing lid 160B becomes difficult. Therefore, when a diameter of the sealing lid 160B ranges from 60 mm to 120 mm, the number of the adhesion portions 25 is preferably in a range from 3 to 18, and the width W of each adhesion portion 25 is preferably in a range from 1 mm to 7 mm. When the number of the adhesion portions 25 and the width W of each adhesion portion 25 are appropriately selected so as to be within the above ranges according to the diameter of the sealing lid 160B, the adhesion portions 25 are sufficiently adhered and opening can be favorably performed.

Table 1 indicates a result of comparison as to the sealing lid 160B in sealing property (adhesiveness), pressing strength required for opening operation, openability, and opened state among the packaging containers according to the present embodiment that had the adhesion portions 25 having the width W of 2 mm, 3 mm, 4 mm, and 5 mm, and the adhesion portion 25 in which the opening portion, on the narrow opening side, of the funnel component 701 was adhered to the entirety of the circumference of the contact portion 24. In this case, the diameter of each sealing lid 160B was 85 mm. For the adhesion portions 25 having the width W of 2 mm, 3 mm, 4 mm, and 5 mm, the number of the adhesion portions 25 between the perforation lines 22 was one and the total number of the adhesion portions 25 was six, in each packaging container. In this case, when the width W ranges from 2 mm to 5 mm, it is confirmed that, although there is a slight difference in the sealing property (adhesiveness) and openability, opening operation is favorably performed in each packaging container.

TABLE 1

| Width W | 2 mm | 3 mm | 4 mm | 5 mm | Adhesion to the entirety of circumference |
|---|---|---|---|---|---|
| Sealing property (adhesiveness) | Slightly weak | Standard | Standard | Slightly strong | — |
| Pressing strength | 107 N | 111 N | 118 N | 131 N | — |
| Openability | Slightly loose | Standard | Standard | Slightly hard | — |
| Opened state | Favorable | | | | Cannot be opened |

When the adhesion portions 25 as described above are provided, generation of a gap between the opening portion, on the narrow opening side, of the funnel component 701 and the sealing lid 160B due to the sealing lid 160B being expanded according to change of air pressure or temperature, can be prevented. Thus, movement of the contents 150 onto the outer side of the funnel component 701 in the case of, for example, the contents being transported is more assuredly prevented, and resistance to buckling during storage can be obtained.

In the present embodiment, the sealing lid 160B has the tab 164 that extends from a portion of the circumferential portion of the sealing lid 160B. However, the sealing lid 160B may not have the tab 164.

(Sixth Embodiment)

Figure 16:
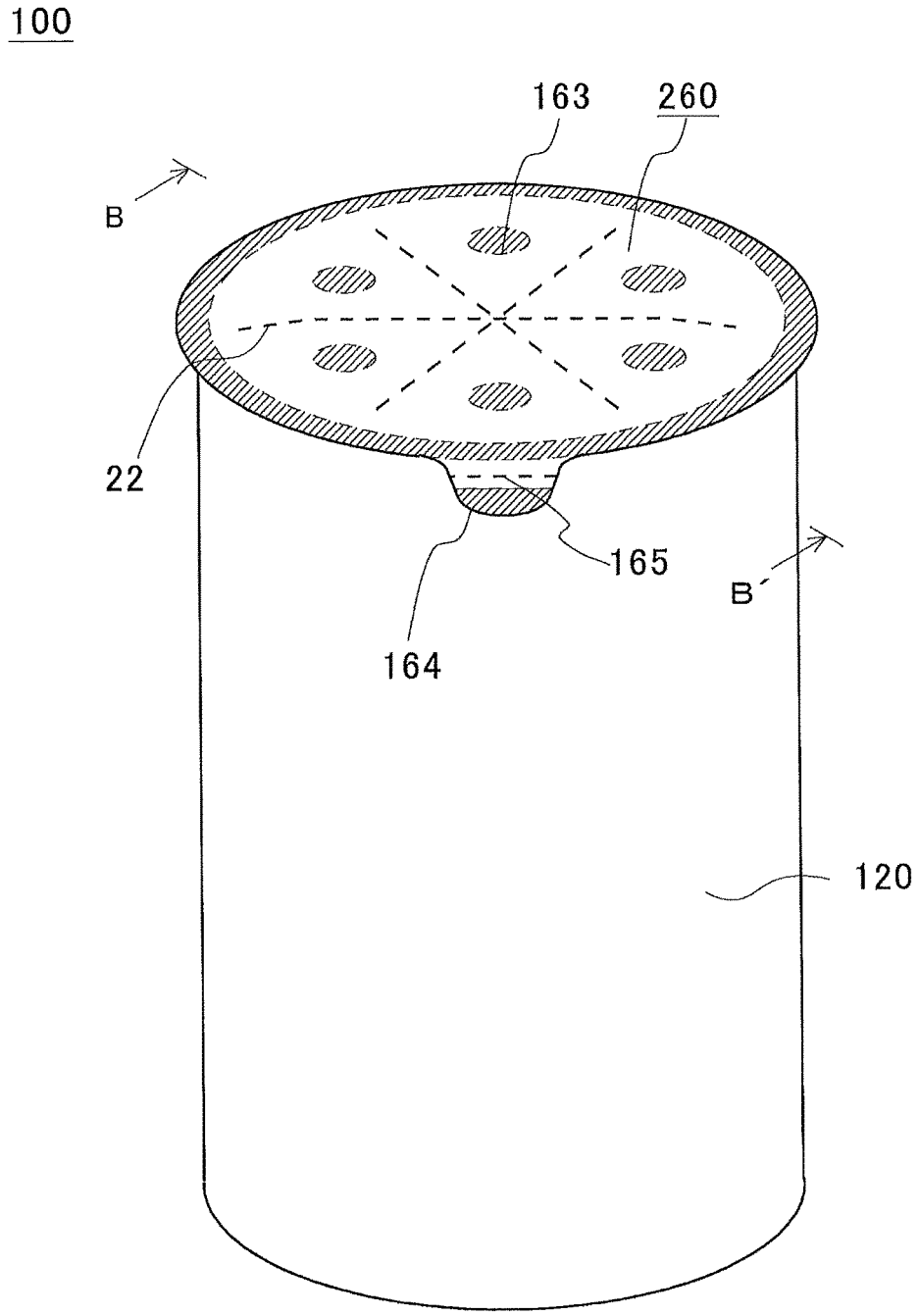
FIG. 16 is a perspective view of a packaging container according to a sixth embodiment of the present invention.
Figure 17:
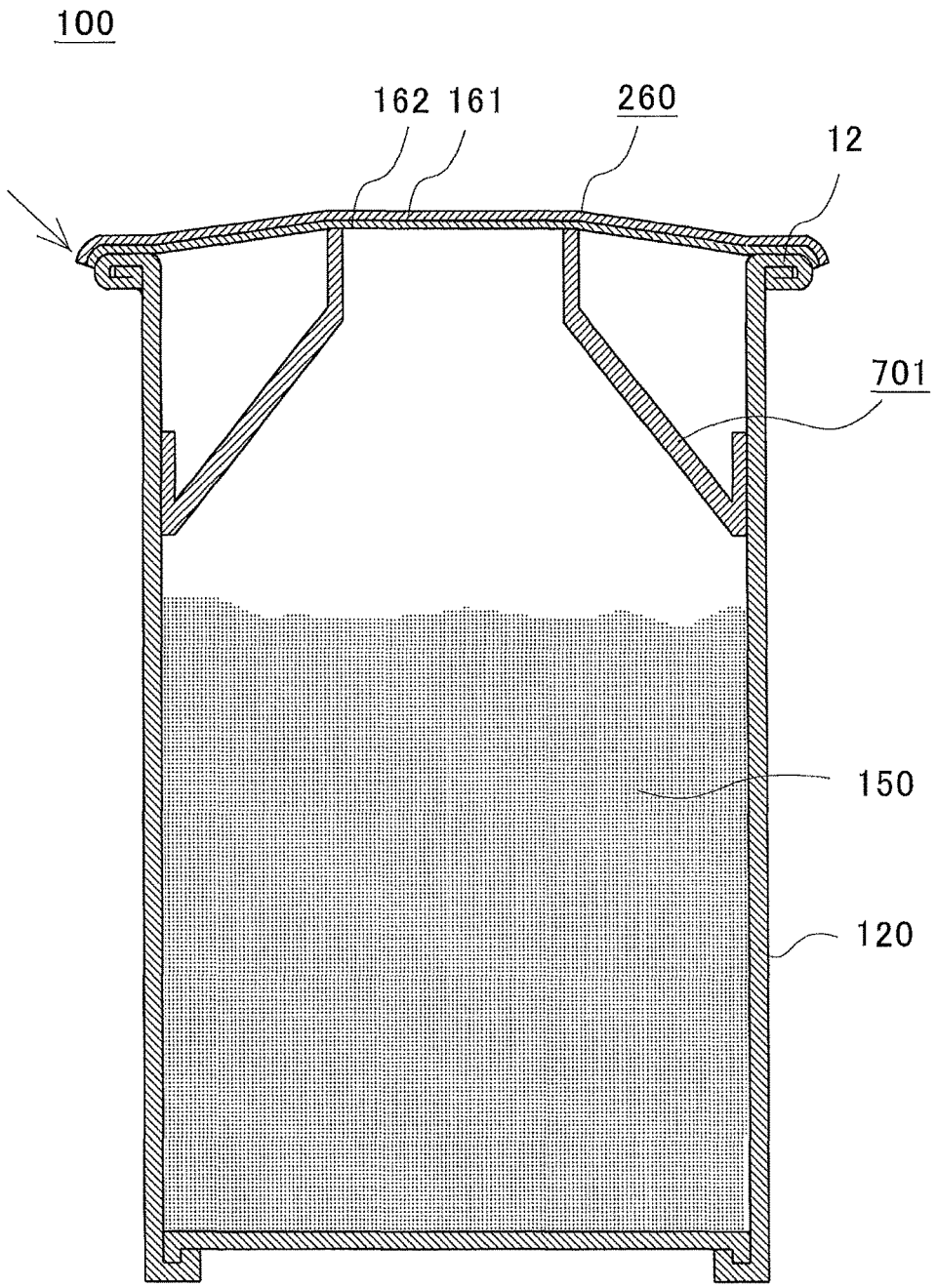
FIG. 17 is a vertical cross-sectional view of the packaging container according to the sixth embodiment of the present invention.

A sixth embodiment of the present invention will be described below. Description of the same contents as described for the example of the fourth embodiment is omitted as appropriate. FIG. 16 is perspective view of the packaging container 100 according to the present embodiment. FIG. 17 is a cross-sectional view taken along a line B-B' shown in FIG. 16.

Figure 18:
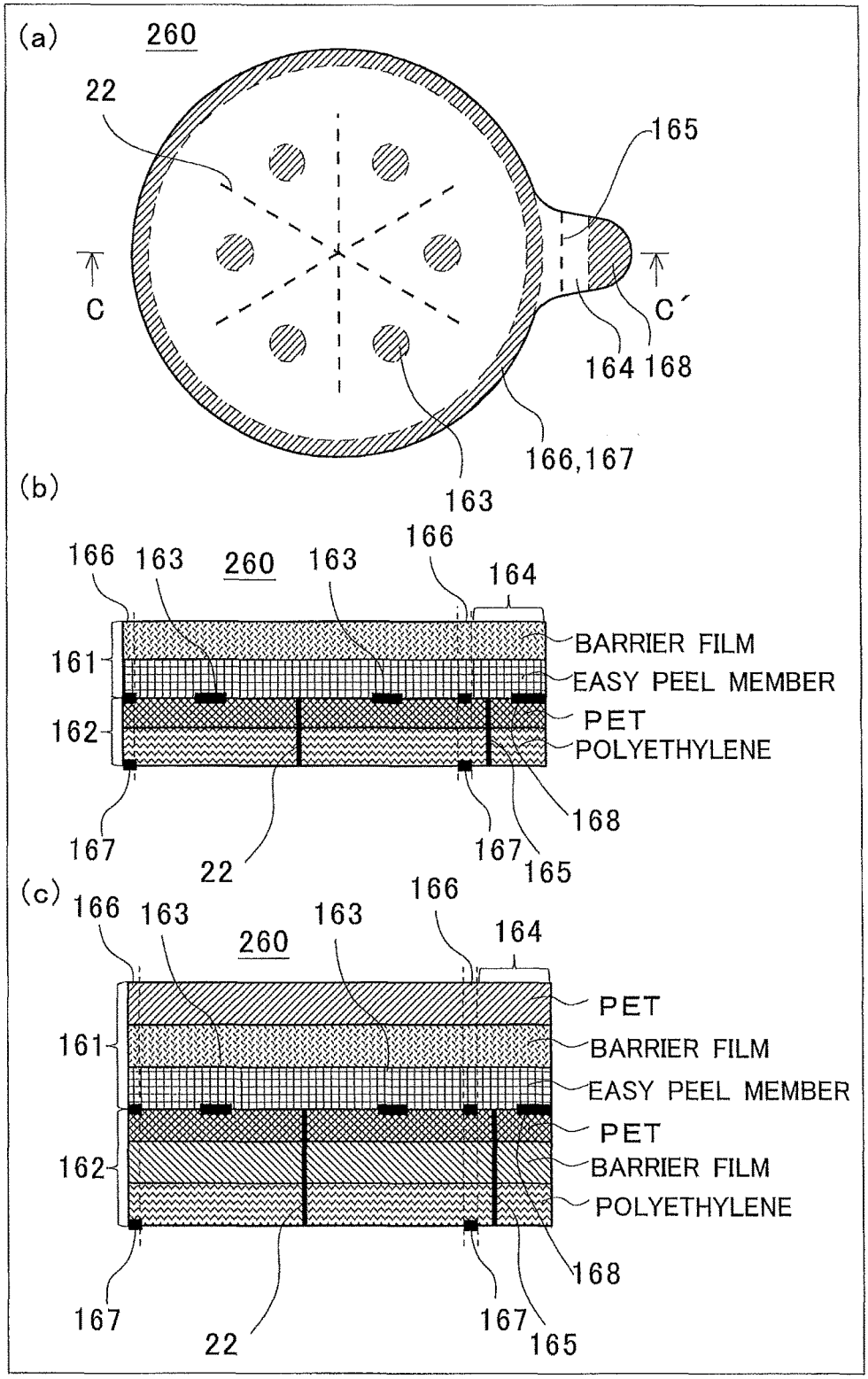
FIG. 18 is a plan view and a cross-sectional view of a sealing lid according to the sixth embodiment of the present invention.

(a) of FIG. 18 is a plan view of a sealing lid 260 according to the present embodiment. (b) of FIG. 18 schematically illustrates a cross-section taken along a line C-C' of (a) of FIG. 18. The sealing lid 260 includes an upper film 161 disposed on the outer side and a lower film 162 disposed on the inner side such that the upper film 161 and the lower film 162 are layered. The upper film 161 has a laminated structure including a barrier film (having a thickness ranging from 12 μm to 100 μm) and an easy peel member (having a thickness ranging from 1 μm to 150 μm) that are layered in order, respectively, from the outer side of the packaging container 100. The lower film 162 has a laminated structure including a PET (polyethylene terephthalate) layer (having a thickness of 12 μm) and a polyethylene layer (having a thickness ranging from 30 μm to 200 μm) that are layered in order, respectively, from the outer side of the packaging container 100. As the barrier film, a film having an inorganic oxide vapor deposition film or a metal deposition film, or a film formed by an ethylene-vinylalcohol copolymer (EVOH), a polyvinyl alcohol (PVA), or the like can be used.

Alternatively, as illustrated in a cross-sectional view of (c) of FIG. 18, the upper film 161 may further include a PET layer (having the thickness of 12 μm) on a side closer to the outer side of the packaging container 100. The lower film 162 may further include a barrier film (having a thickness ranging from 12 μm to 100 μm) between the PET layer and the polyethylene layer. In particular, when food is stored as contents, the PET layer on which printing with ink is performed is layered over the barrier film layer in the upper film 161 and the lower film 162, whereby printing can be performed with enhanced safety from the viewpoint of food hygiene.

In the lower film 162, the perforation lines 22 are formed so as to extend radially from the center over a predetermined length. Namely, the perforation lines 22 are formed so as not to reach a portion in the vicinity of the end portion of the outer circumferential edge of the sealing lid 260. Further, the upper film 161 and the lower film 162 are partially sealed to each other in regions each of which is between the perforation lines 22, and a plurality of circular adhesion regions 163 are formed. The upper film 161 acts to protect the lower film 162 that is easily cut by the perforation lines 22.

When the container body 120 is sealed with the sealing lid 260, a circumferential edge portion 167 of the lower film 162 and the flange portion 12 of the container body 120 are heat-sealed to each other, and the upper film 161 and the lower film 162 are simultaneously heat-sealed to each other at a circumferential edge portion 166. The heat-sealing is performed in not only the top surface of the flange portion 12 but also a region outward of the top surface of the flange portion 12 as indicated by an arrow in FIG. 17. Namely, an outer circumferential portion of the circumferential edge portion 167 of the lower film 162 is pressed and heat-sealed along the region outward of the top surface of the flange portion 12. The heat-sealed portions and the adhesion regions 163 are indicated by diagonal lines in FIG. 16 and (a) of FIG. 18, and are indicated by thick lines in (b) of FIG. 18.

Further, the tab 164 is formed so as to connect with a portion of the circumferential edge portions of the upper film 161 and the lower film 162. At the tab 164, the upper film 161 and the lower film 162 are adhered to each other in a region 168 that is a portion, of the tab 164, including the tip of the tab 164. Another region at which no adhesion is performed is provided so as to extend across the tab 164. The lower film 162 includes, in the region where no adhesion is performed, a cut 165 that extends across the tab 164. Namely, the lower film 162 is separated by the cut 165, and the tab 164 is connected by only the upper film 161.

In the present embodiment, an exemplary case is described in which the diameter of the sealing lid 260 is 88 mm and the perforation lines 22 are formed as six straight lines that extend radially from the center of the sealing lid 260. The length of each perforation is 1.5 mm, and the length of a portion connecting between adjacent perforations is 2 mm. The number of the adhesion regions 163 is six, and each adhesion region 163 is formed between the perforation lines 22.

Figure 19:
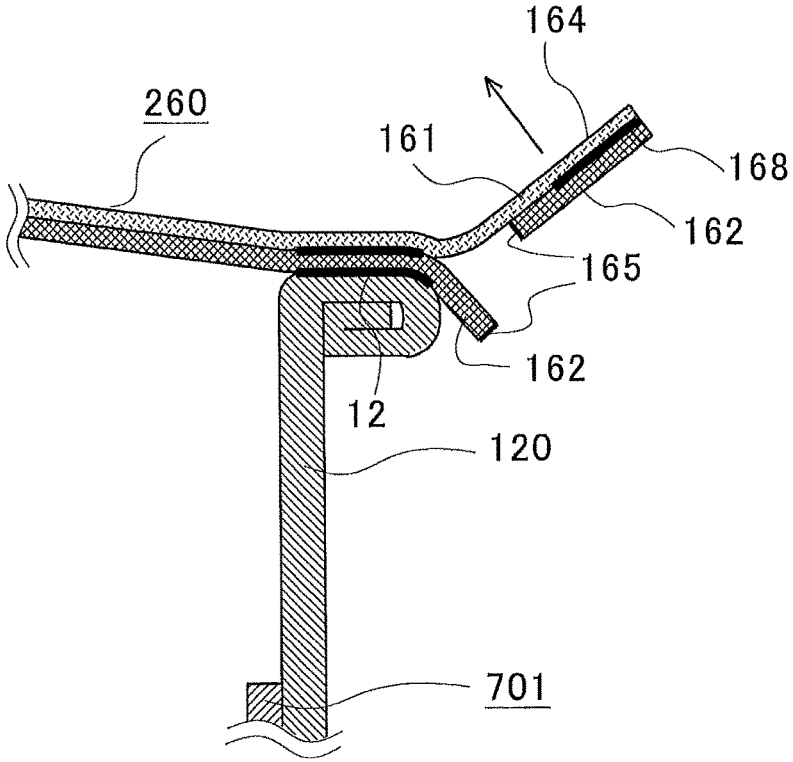
FIG. 19 is an enlarged cross-sectional view of the packaging container according to the sixth embodiment of the present invention.

A procedure for refilling will be described. Firstly, the tab 164 is pinched to pull the sealing lid 260 so as to be removed from the container body 120. FIG. 19 is an enlarged cross-sectional view of a portion near the tab 164 in this state. The lower film 162 includes the cut 165. Further, since, in the sealing lid 260, the upper film 161 is layered over the lower film 162 through the layer of the easy peel member of the upper film 161, a region between the flange portion 12 and the cut 165 includes a region where the flange portion 12 and the lower film 162 are sealed to each other, but the upper film 161 and the lower film 162 are not sealed to each other. Therefore, tensile force is transmitted through the upper film 161 only, and is not directly transmitted to the portion in which the lower film 162 and the flange portion 12 of the container body 120 are heat-sealed to each other. Namely, tensile force is concentrated on a portion where the upper film 161 and the lower film 162 are adhered to each other on the flange portion 12. Adhesion between the easy peel member of the upper film 161 and the PET film of the lower film 162 is lower than adhesion by heat-sealing between the polyethylene layer of the lower film 162 and the flange portion 12 of the container body 120. Therefore, the upper film 161 is separated from the lower film 162 due to the tensile force. Next, as in conventional arts, the lower film 162 is placed and pressed into an opening of a container to be refilled, to cut the sealing lid 260 along the perforation lines 22, whereby contents are transferred through the funnel component 701 for refilling.

The sealing lid 260 needs to maintain the container body 120 in a sealed state even when the flange portion 12 is deformed due to a force applied externally to the container body 120. The upper film 161 and the lower film 162 are adhered to each other at not only the circumferential edge portions 166 and 167 but also the adhesion regions 163. Therefore, even when the flange portion 12 is deformed in the radial direction due to falling or the like, and tensile force is applied to the surface of the sealing lid 260 in a direction parallel to the surface of the sealing lid 260, the upper film 161 is not separated from the lower film 162, and concentration of the tensile force on the perforation lines 22 of the lower film 162 is avoided, to prevent the lower film 162 from being cut. In general, when adhering strength is evaluated, test for separation is performed by generating tensile force in a direction perpendicular to an adhesion surface. However, the adhesion regions 163 need to prevent separation due to tensile force in a direction parallel to the surface of the sealing lid 260. Therefore, the adhering strength of the adhesion regions 163 is appropriately evaluated in the test for separation by generating tensile force in a direction parallel to the surface of the sealing lid 260. An adhering strength of the adhesion regions 163 is advantageously such a strength that prevents separation even when a tensile force ranging from 30N to 70N is applied in a direction parallel to the surface of the sealing lid 260. It is confirmed that, in a case where the adhering strength is higher than or equal to 30N, even when deformation of the flange portion 12 of the container body 120 reaches 25 mm, separation of the upper film 161 from the lower film 162 can be prevented and the lower film 162 can be prevented from being cut. On the other hand, when the adhering strength is higher than or equal to 70N, it is difficult to separate the upper film 161 from the lower film 162 for refilling.

Further, since the circumferential edge portion 166 is heat-sealed, air sealing property of the sealing lid 260 can be assuredly obtained by the layer of the barrier film of the upper film 161.

Figure 20:
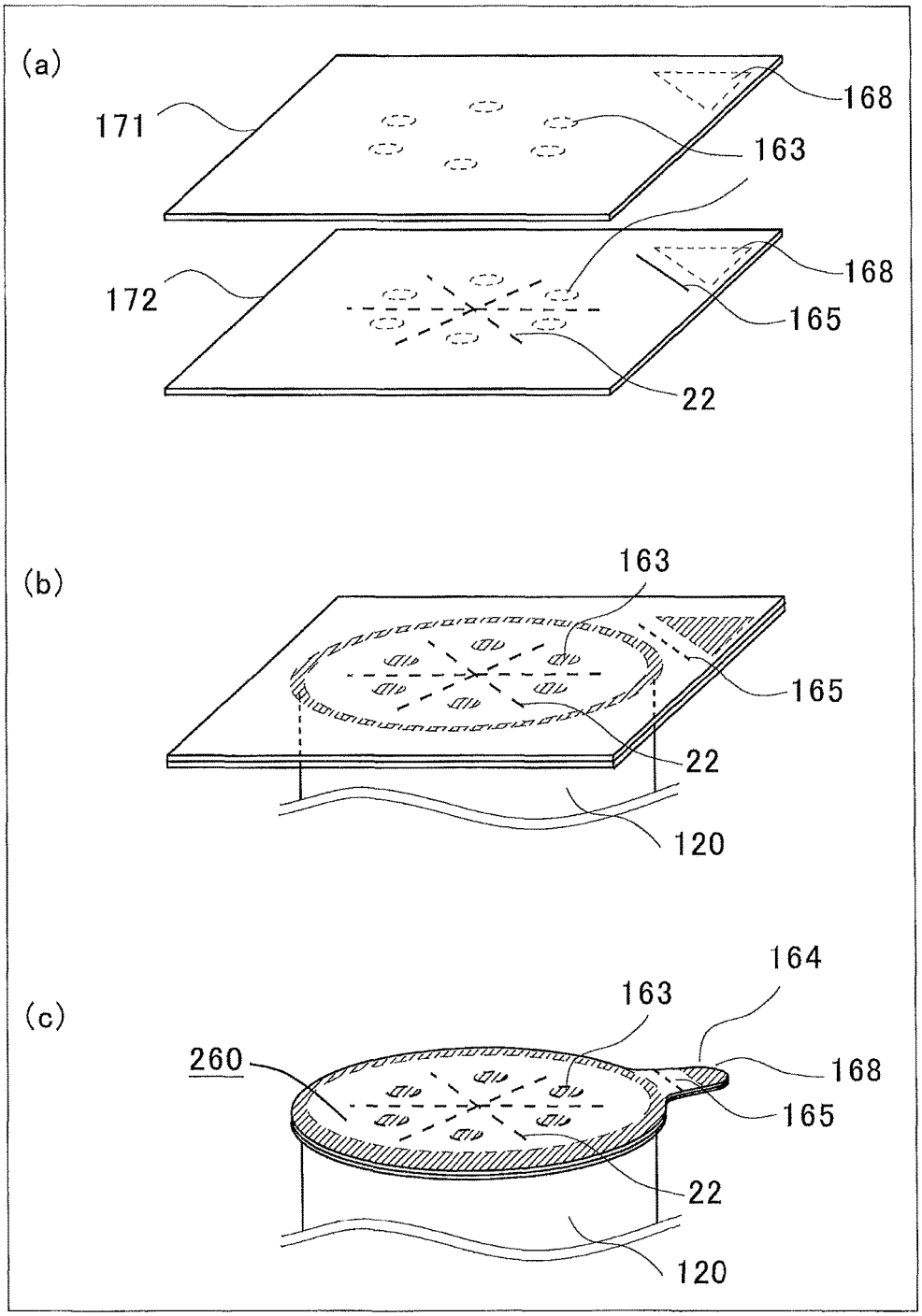
FIG. 20 illustrates a method for manufacturing the packaging container according to the sixth embodiment of the present invention.

A method for manufacturing the sealing lid 260 and the packaging container 100 will be described with reference to FIG. 20. Firstly, as shown in (a) of FIG. 20, the perforation lines 22 and the cut 165 are formed in a sheet-like lower-side film member 172 that is to be formed into the lower film 162. Thereafter, a sheet-like upper-side film member 171 that is to be formed into the upper film 161 is layered over the lower-side film member 172. Thereafter, the adhesion regions 163 between the upper-side film member 171 and the lower-side film member 172, and the region 168, including a portion, of the tab 164, forming the tip portion are adhered by heat-sealing process. Next, as shown in (b) of FIG. 20, the opening portion of the container body 120 is covered with the upper-side film member 171 and the lower-side film member 172 that have been layered, and the upper-side film member 171, the lower-side film member 172, and the flange portion 12 of the container body 120 are subjected to heat-sealing process. Thus, heat-sealing process for the circumferential edge portion 167 of the lower film 162 and the flange portion 12 of the container body 120, and heat-sealing process for the circumferential edge portion 166 of the upper film 161 and the circumferential edge portion 167 of the lower film 162 are simultaneously performed. The alignment in the heat-sealing process may be performed such that the perforation lines 22 formed in the lower-side film member 172 are positioned at almost the center of the opening portion of the container body 120, and the cut 165 is positioned outward of the flange portion 12 of the container body 120, and the alignment need not be performed with accuracy higher than the above-described alignment. The same process as described above is performed for the upper-side film member 171 and the lower-side film member 172 that are continuously supplied, and the sealing lid 160 is rolled. Thus, they are temporarily stored. Thereafter, as shown in (c) of FIG. 20, the upper-side film member 171 and the lower-side film member 172 are punched so as to have the shape of the sealing lid 260, thereby completing the packaging container 100 with the container body 120 being sealed with the sealing lid 260. Further, the outer circumferential portion of the circumferential edge portion 167 of the lower film 162 is preferably heat-sealed to the flange portion 12 in a state where the outer circumferential portion is pressed along a region outward of the top surface of the flange portion 12. The methods for manufacturing the sealing lid 260 and the packaging container 100 are not limited to the above methods. The methods can be modified in various manners. For example, the order in which the heat-sealing process and the punching process are performed may be reversed.

Figure 21:
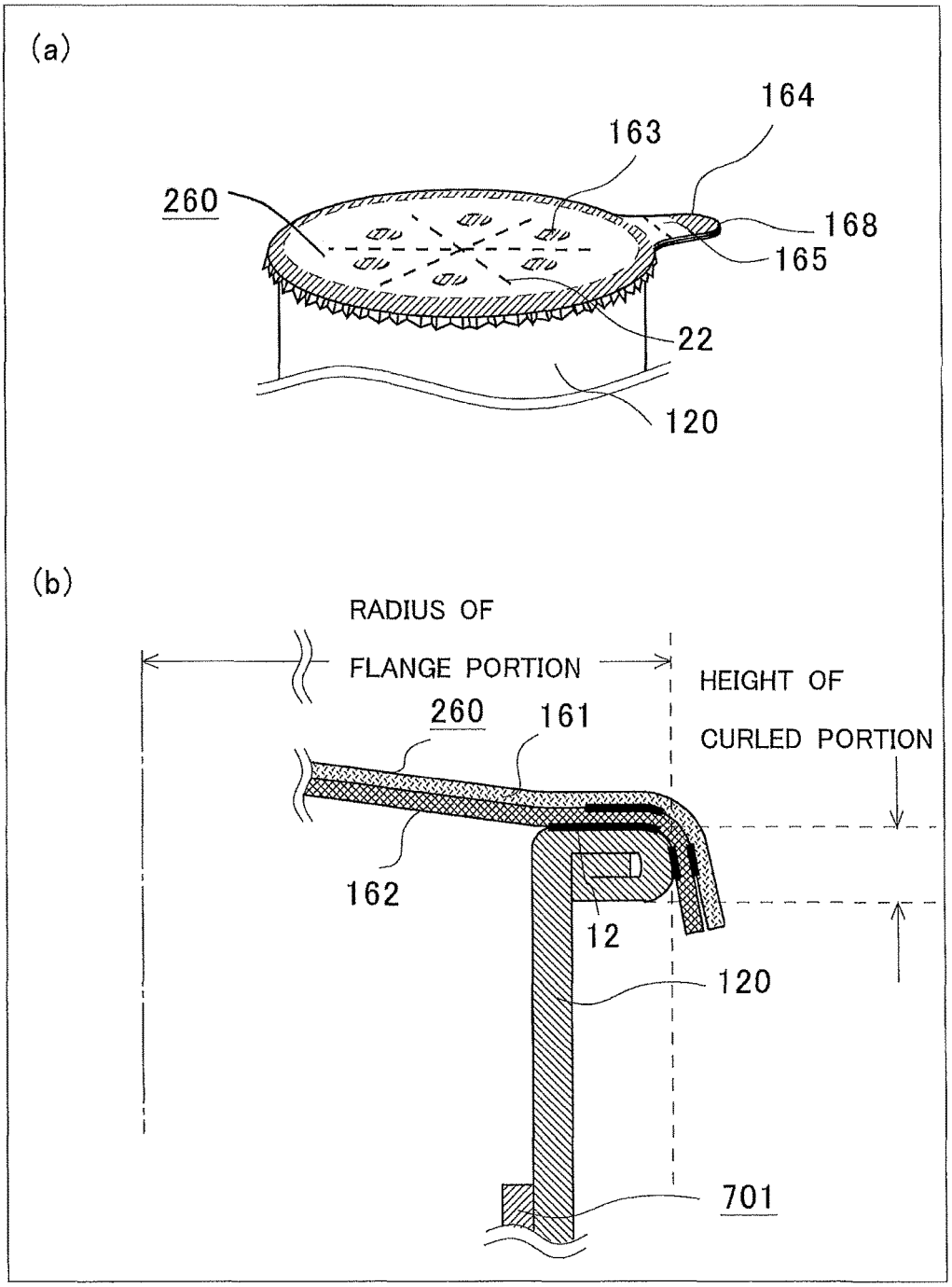
FIG. 21 is a perspective view and a vertical cross-sectional view of the packaging container according to the sixth embodiment of the present invention.

As shown in the perspective view of (a) of FIG. 21, in a case where the outer circumferential portion of the circumferential edge portion 167 of the lower film 162 is heat-sealed and crinkled in a state where the outer circumferential portion is pressed along the outer edge of the flange portion 12, the shape of the packaging container 100 becomes compact, its outer appearance is improved, and separation of the sealing lid 260 due to, for example, contact between the end portions of the sealing lids 260 during storage, circulation, or the like, is less likely to occur. In this case, a polyester-based material is preferably used for the easy peel member of the upper film 161. Thus, a heating temperature for the heat-sealing process can be appropriately set, whereby a region where the lower film 162 is adhered to a portion outward of the top surface of the flange portion 12 of the container body 120, but the upper film 161 and the lower film 162 are not adhered to each other, can be formed in the crinkled portion. Thus, when the upper film 161 is separated from the lower film 162, separation can be prevented from becoming difficult.

Further, in a case where crinkling is performed, as further illustrated in a cross-sectional view of (b) of FIG. 21, the radius of the sealing lid 260 may be set so as to be greater than a sum of the outer radius of the flange portion 12 and the height of the curled top portion of the flange portion 12. Thus, even if the upper film 161 and the lower film 162 are pseudo-adhered to each other at the outer edge portion of the flange portion 12, a region in which no adhesion is performed can be provided outside the sealing lid 260. Thus, the sealing lid 260 can be prevented from being cut from the outer circumferential portion when opened. The radius of the sealing lid 260 is preferably set so as to extend beyond the lower end of the curled top portion of the flange portion 12 by about 1 mm to about 3 mm. Further, the radius of the sealing lid 260 may not be increased over the entirety of the circumference of the sealing lid 260. The radius may be increased over at least half the entire circumference of the sealing lid 260 including the tab 164 at the center such that the cutting can be avoided in a range in which the cutting of the sealing lid 260 is likely to be increased due to tensile force from the tab 164.

By the above manufacturing method, a position at which the circumferential edge portion 167 of the lower film 162 and the flange portion 12 of the container body 120 are heat-sealed to each other, and a position at which the upper film 161 and the lower film 162 are heat-sealed to each other become almost the same as viewed from a direction orthogonal to the surface of the sealing lid 260 even when alignment is not performed with enhanced accuracy. Thus, when the tab 164 is pinched and the sealing lid 260 is pulled so as to be separated from the container body, a portion of the lower film 162 closer to the center of the sealing lid 160 than the cut 165 is prevented from moving upward together with the upper film 161, as shown in FIG. 19, and tensile force transmitted from the tab 164 is likely to be concentrated on the end portion of the position at which the upper film 161 and the lower film 162 are heat-sealed to each other. Further, an adhering strength with which the easy peel member of the upper film 161 and the lower film 162 are adhered to each other is lower than an adhering strength with which the lower film 162 and the flange portion 12 of the container body 120 are adhered to each other, and therefore the upper film 161 is separated from the lower film 162, and the lower film 162 is not separated from the flange portion 12 of the container body 120. In this case, the adhering strength is a normal adhering strength that is evaluated by generating tensile force in the direction perpendicular to the adhesion surface.

On the other hand, in a case where the upper film 161 and the lower film 162 are previously adhered to each other at the circumferential edge portion 166, and thereafter the circumferential edge portion 167 of the lower film 162 and the flange portion 12 of the container body 120 are heat-sealed to each other, alignment needs to be performed with enhanced accuracy in order to align a heat-sealing position at which the lower film 162 and the flange portion 12 are heat-sealed to each other, with an adhesion position at which the upper film 161 and the lower film 162 are adhered to each other, as viewed from a direction orthogonal to the surface of the sealing lid 260. When the accuracy for the alignment is low, the adhesion position may be displaced outward of the heat-sealing position as shown in (a) of FIG. 22. In this case, when the tab 164 is pinched up, the lower film 162 is moved upward together with the upper film 161, and tensile force transmitted from the tab 164 is less likely to be concentrated on an end portion, as a separation starting position, of an adhesion portion at which the upper film 161 and the lower film 162 are adhered to each other, and separation of the upper film 161 from the lower film 162 becomes difficult.

Figure 22:
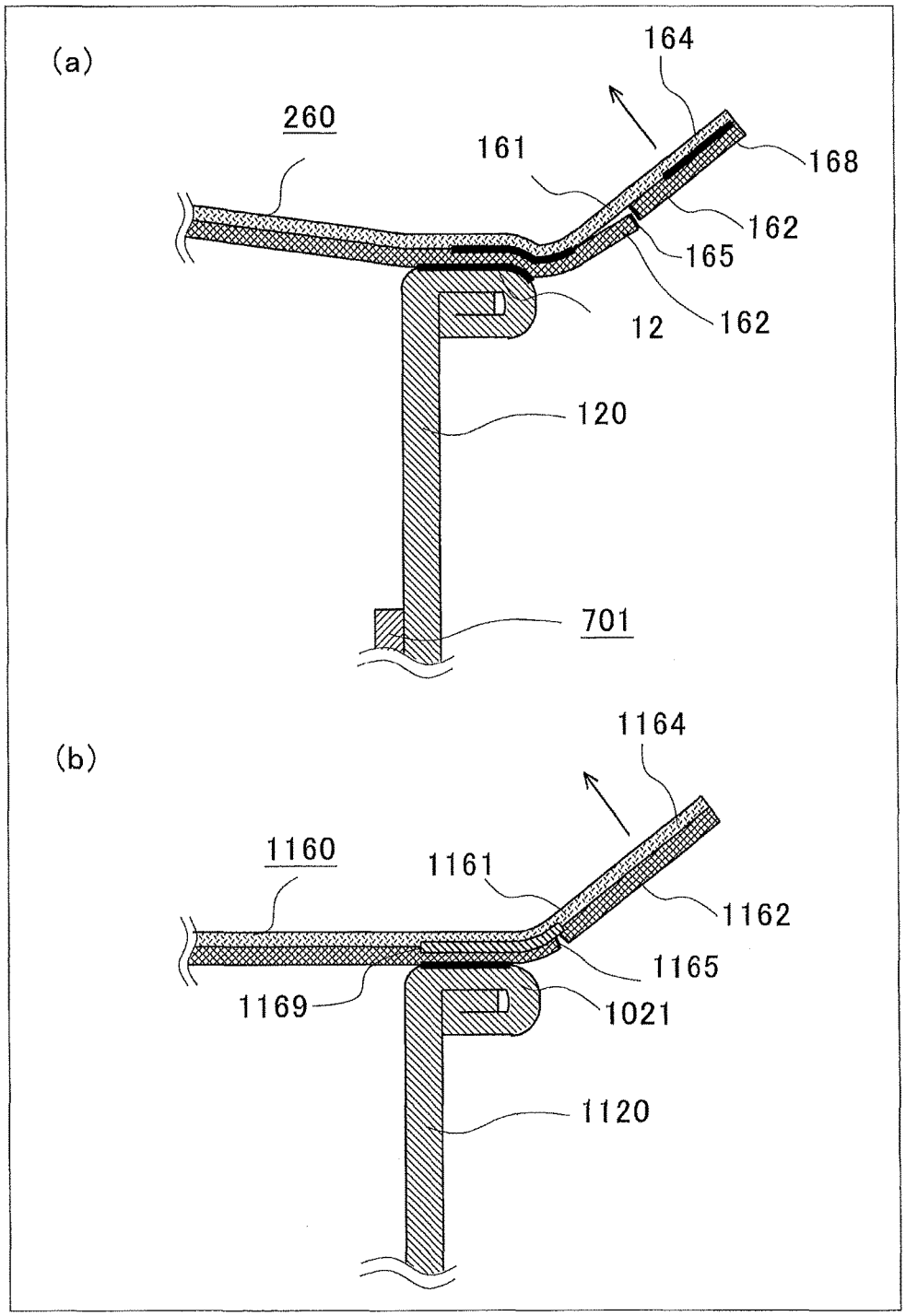
FIG. 22 illustrates a problem to be solved by the present invention.

In general, the same problem arises in a general packaging container in which a sealing lid having an upper film and a lower film that are layered is used and only the upper film is separated when used. (b) of FIG. 22 shows an example of a cross-section of a packaging container in which a container body 1120 is sealed with a sealing lid 1160 in which an upper film 1161 and a lower film 1162 are layered. In this example, a separation layer 1169 is provided between the upper film 1161 and the lower film 1162. Further, a half cut 1165 is formed in a tab 1164 on the lower film 1162 side. In such an exemplary case, in a case where the lower film 1162 is sealed to a flange portion 1012 in a state where the half cut 1165 is distant from an outer edge of the flange portion 1012 in the outward direction by a predetermined distance or longer, since the upper film 1161 and the lower film 1162 are adhered to each other over the entirety of their surfaces, the lower film 1162 is moved upward together with the upper film 1161 by pinching up the tab 1164. Therefore, tensile force is less likely to be concentrated on the half cut 1165 corresponding to the separation starting position, and separation of the upper film 1161 from the lower film 1162 becomes difficult. Further, in a case where the lower film 1162 is sealed to the flange portion 1012 in a state where the half cut 1165 overlaps the upper portion of the flange portion 1012, the separation starting position is lost. Therefore, even when the tab 1164 is pulled, the upper film 1161 cannot be separated from the lower film 1162. For these reasons, the half cut 1165 needs to be positioned with an enhanced accuracy so as to be distant from the outer edge of the flange portion 1012 of the container body 1120 in the outward direction within a predetermined range.

Figure 23:
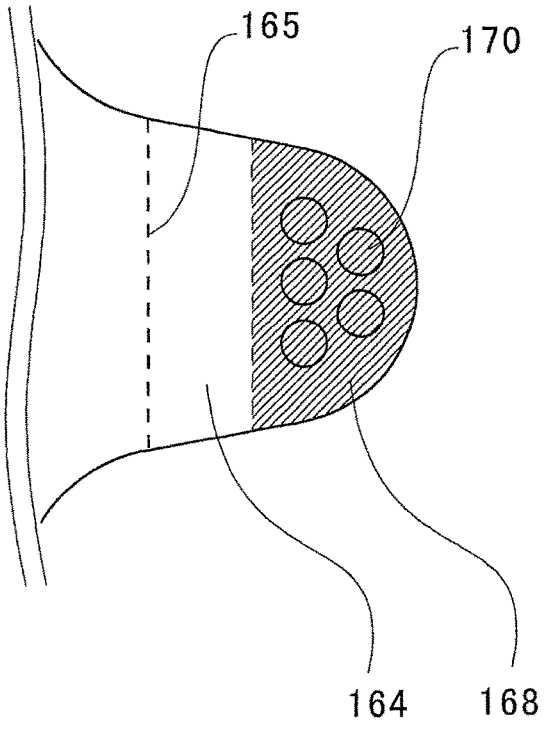
FIG. 23 is an enlarged view of a tab portion of the sealing lid according to the sixth embodiment of the present invention.

In the present embodiment, separation of the upper film 161 is facilitated without performing alignment between the sealing lid 260 and the flange portion 12 with an enhanced accuracy, and the upper film 161 can protect the lower film 162 having the perforation lines 22. Therefore, strength of the sealing lid 260 itself is enhanced to reduce the number of components, thereby enabling reduction of production cost. As shown in FIG. 23, recesses 170 may be formed in the tab 164 by embossing process after the upper film 161 and the lower film 162 are sealed to each other, whereby the tab 164 may have such a shape that sliding is less likely to occur and pinching is facilitated. Further, the shape of the tab 164 is not limited thereto, and may be changed as appropriate.

(Seventh Embodiment)

Figure 24:
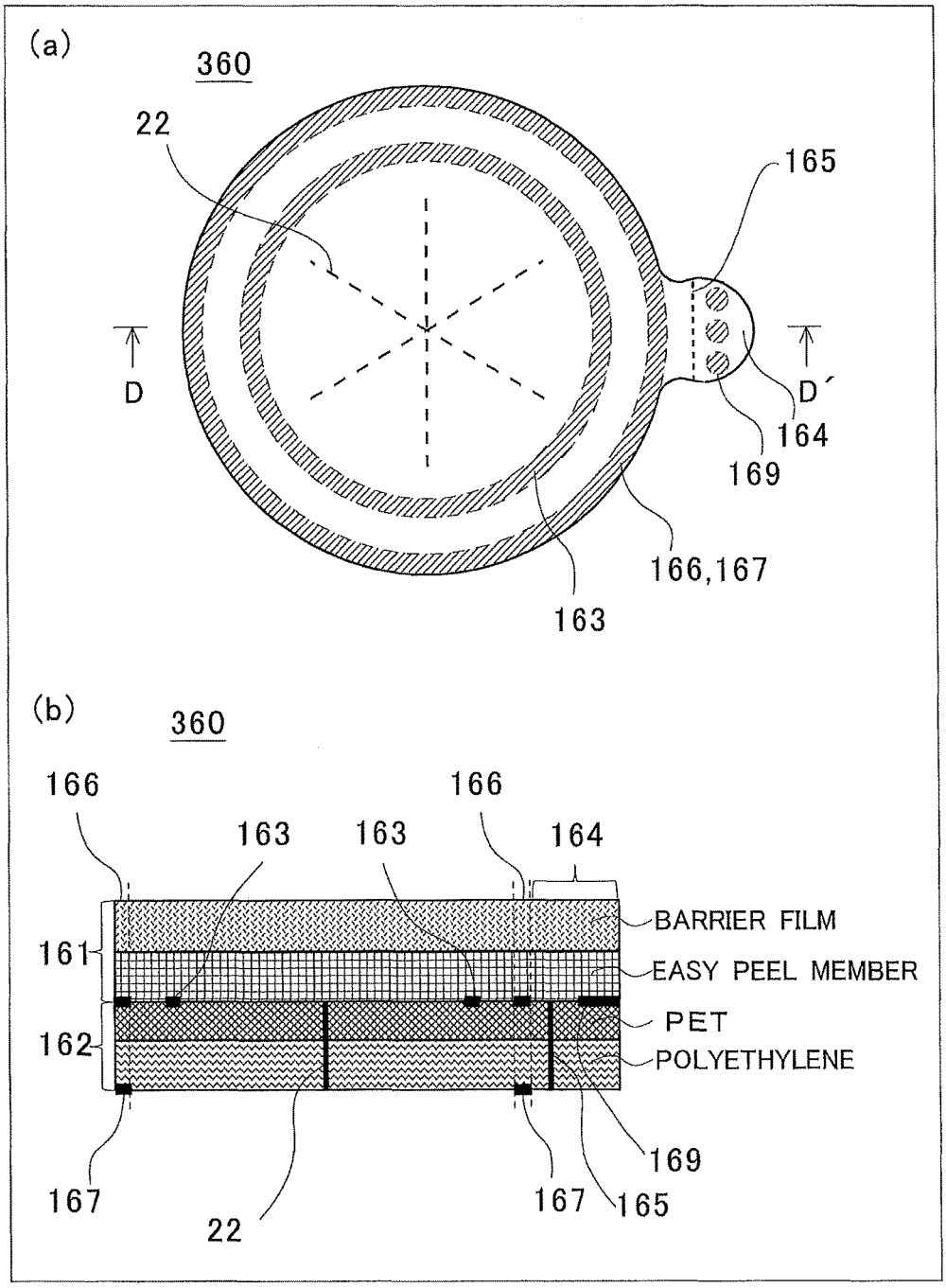
FIG. 24 is a plan view and a cross-sectional view of a sealing lid according to a seventh embodiment of the present invention.

A seventh embodiment of the present invention will be described. FIG. 24 is a plan view of a sealing lid 360 according to the present embodiment and schematically illustrates a cross-section thereof taken along a line D-D'. The sealing lid 360 is formed by the adhesion region 163 of the sealing lid 260 of the sixth embodiment being formed into an annular shape instead of the adhesion regions 163 being formed as a plurality of circular regions. The center of the annular shape corresponds to the center of the sealing lid 360. Further, the tip portion of the tab 164 is partially adhered in a plurality of circular adhesion regions 169. Description of the same contents as described for the sixth embodiment is omitted as appropriate.

In the present embodiment, an exemplary case is described where the diameter of the sealing lid 360 is 86.8 mm, and the length of each perforation line 22 is 55 mm. Further, the inner diameter for the annular adhesion region 163 is 60 mm, and the outer diameter is 66 mm. The diameter of each adhesion area of the adhesion regions 169 in the tip portion of the tab 164 is 2 mm, and the adhesion areas are provided at intervals of 6 mm.

An adhering strength of the adhesion region 163 preferably ranges from 30N to 70N in the direction parallel to the surface of the sealing lid 360. Since the adhesion region 163 is provided over the entirety of the circumference of an annular portion surrounding the perforation lines 22, an adhering strength can be enhanced in the direction parallel to the surface of the sealing lid 360. In particular, in a case where the adhering strength ranges from 50N to 70N, it was confirmed that, even in the case of the atmospheric pressure or pressure inside the packaging container 100 being changed, separation of the upper film 161 from the lower film 162 was able to be prevented and the lower film 162 was able to be prevented from being cut, and transportation by air for about 10 hours was able to be performed under an external pressure of 0.8 atm.

Since ink, varnish, or the like is not used for adhesion in the sealing lids 260 and 360 of the above embodiments, no odor is generated. Further, since a transparent film is used, printing can be performed with excellent outer appearance, and printing can be also performed on the upper film 161 or the lower film 162 so as to obtain transparent visibility.

Figure 25:
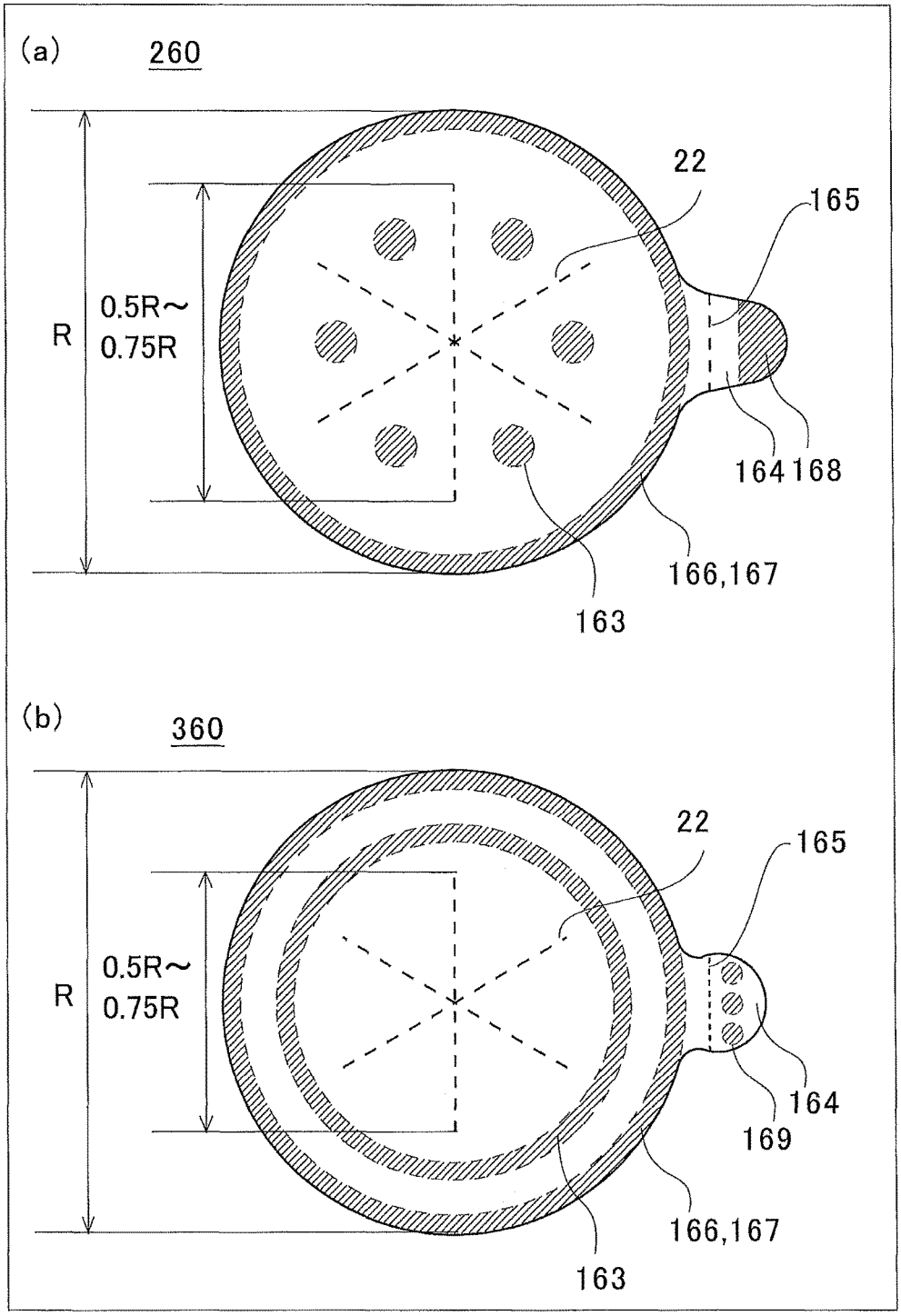
FIG. 25 is a plan view of the sealing lid according to the seventh embodiment of the present invention.

In the sealing lid 260, as shown in (a) of FIG. 25, the length of each perforation line 22 preferably ranges from 50% of the diameter of the sealing lid 260 to 75% thereof. When the perforation lines 22 are distant from the circumferential edge portion of the sealing lid 260, resistance to falling impact can be enhanced. Further, also in the sealing lid 360, as shown in (b) of FIG. 25, under the condition that the perforation lines 22 are distant from the inner edge of the circular adhesion region 163, the length of each perforation line 22 preferably ranges from 50% of the diameter of the sealing lid 360 to 75% thereof. Thus, even when falling occurs during storage, circulation, or the like, the sealing lids 260 and 360 can be prevented from being cut. For example, when the diameter of the sealing lid was 100 mm and the length of each perforation line 22 was 78 mm, the sealing lid was cut at a rate of about 10% in a falling test in which the height was 60 cm and the angle was 45°. However, when the length of each perforation line 22 was 68 mm, cutting of the sealing lid was not confirmed in the falling test.

Figure 26:
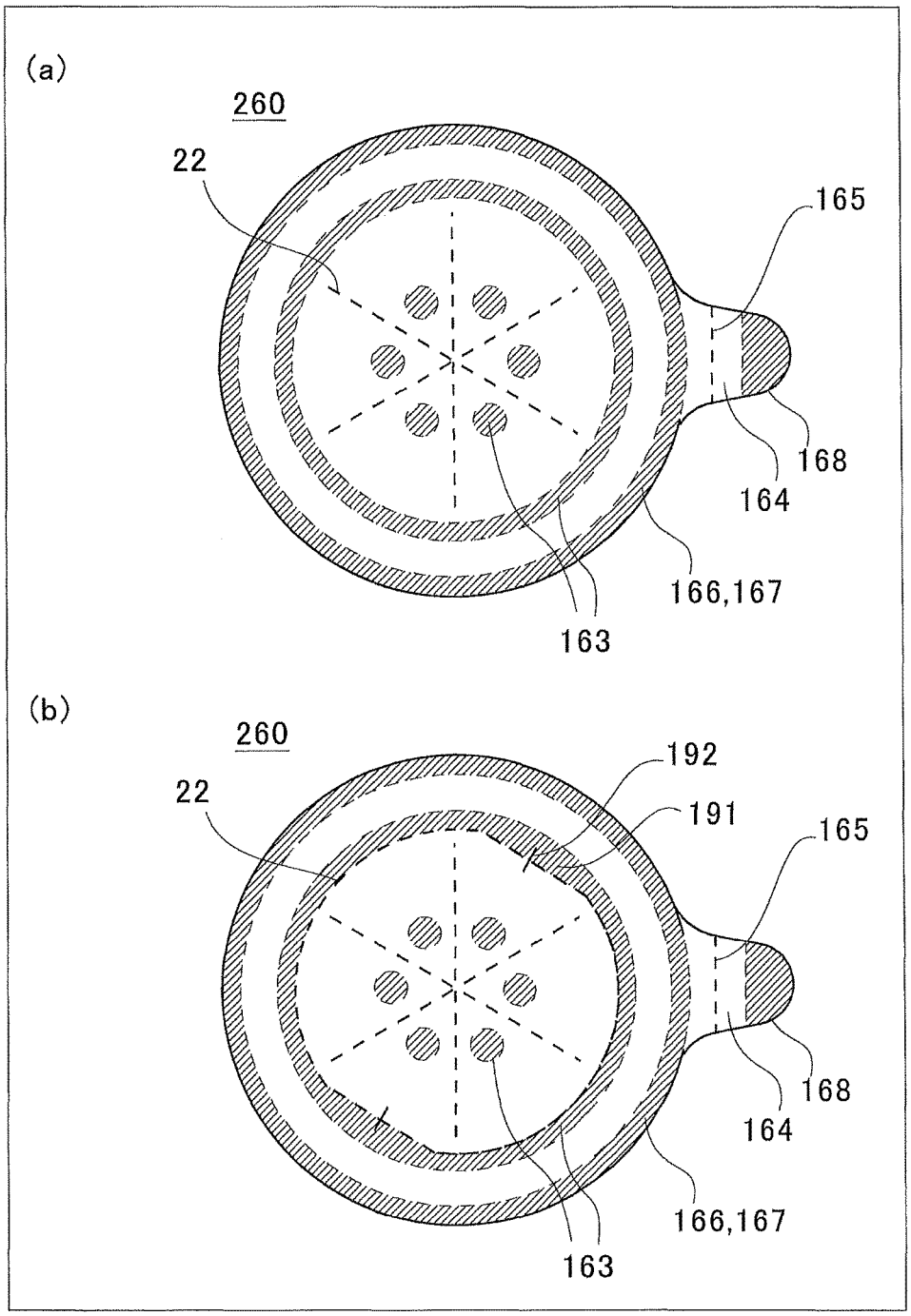
FIG. 26 is a plan view of a sealing lid according to a modification of the seventh embodiment of the present invention.

Further, the sealing lid 260 according to a first modification of the present embodiment where, as shown in a plan view of (a) of FIG. 26, the adhesion regions 163 include an annular region in addition to a plurality of circular regions to enhance adhesiveness, may be implemented. Further, as shown in a plan view of (b) of FIG. 26, a part of the annular adhesion region 163 may be formed as an increased width portion 191 having an increased width, and an air slit 192 may be formed in the upper film 161 so as to extend from an inner region surrounded by the annular adhesion region 163 through the inner circumferential edge of the increased width portion 191 to the inside of the adhesion region 163. The increased width portion 191 and the air slit 192 are formed near a starting end and a finishing end in the heat-sealing process for the adhesion region 163. Thus, when the rolling into a roll shape or the like is performed after the heat-sealing process, air accumulated in the adhesion region 163 (in-between portion between the upper film 161 and the lower film 162) can be vented through the air slit 192, to prevent the seal from being cut. Further, by the air slit 192 being formed in the increased width portion 191, even when positioning accuracy is low, the air slit 192 can be prevented from extending across the adhesion region 163, to prevent degradation of the quality in the sealing.

Figure 27:
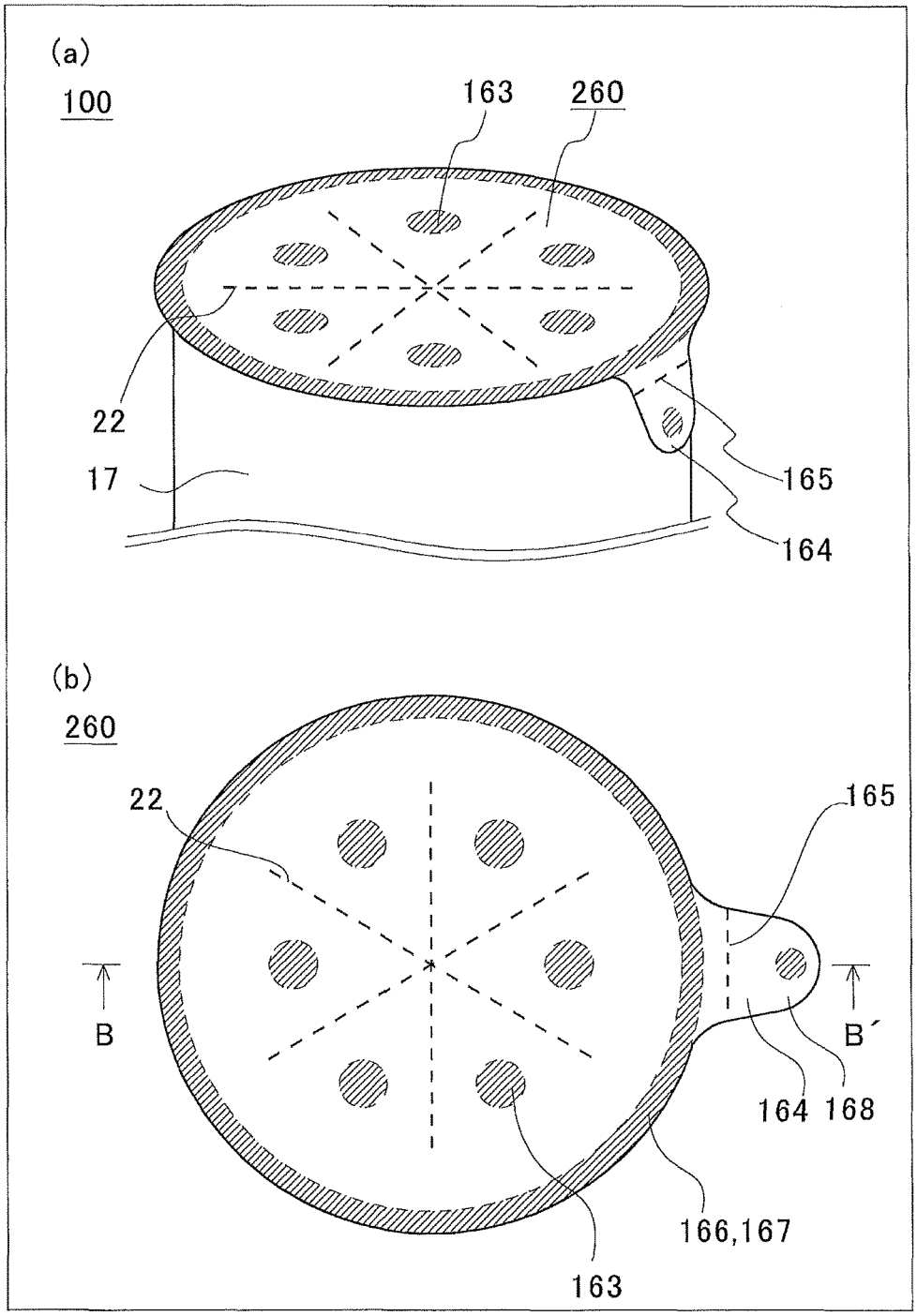
FIG. 27 is a perspective view of a packaging container and a plan view of the sealing lid according to the seventh embodiment of the present invention.

Furthermore, in the sealing lid 260 according to a second modification of the present embodiment, as shown in (a) of FIG. 27, the tab 164 may be welded to the side wall 17 of the container body 120. In this case, at the tab 164, simultaneously when the lower film 162 and the side wall 17 are welded to each other, the upper film 161 and the lower film 162 are welded to each other. The welded region of the tab 164 is only the center portion on the tip side as shown in a plan view of (b) of FIG. 27. In a case where the tab 164 is welded to the side wall 17 of the container body 120, when the tab 164 is removed from the side wall 17 in the case of opening being attempted by using the tab 164, for example, a resin of the surface of the side wall 17 is also removed and a trace of opening operation is left, to prevent harassment at shops and the like.

Further, the following scope of the present invention based on the sixth to the seventh embodiments can be considered.

A packaging container in which the length of the perforation line ranges from 50% of the diameter of the sealing lid to 75% thereof.

(Eighth Embodiment)

Figure 28:
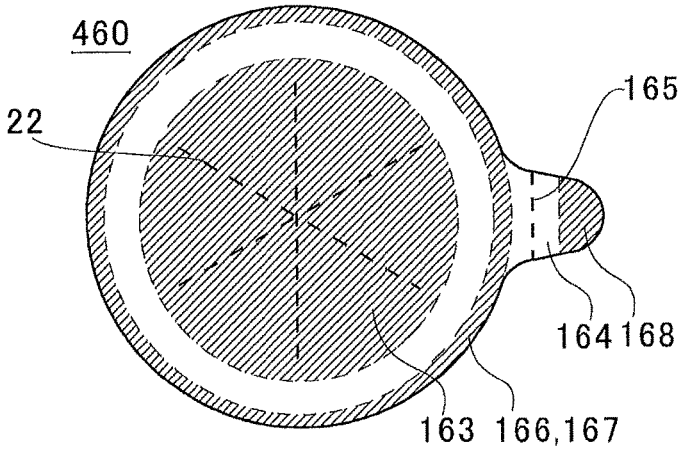
FIG. 28 is a plan view of a sealing lid according to an eighth embodiment of the present invention.

An eighth embodiment of the present invention will be described below. The present embodiment is different from the seventh embodiment in sealing lid. Also for the sealing lid, description of the same contents as described for the seventh embodiment is omitted as appropriate. FIG. 28 is a plan view of a sealing lid 460 according to the present embodiment. The sealing lid 460 is formed by the upper film 161 and the lower film 162 being layered, similarly to the sealing lid 360. This laminated structure of the films is the same as that described for the seventh embodiment.

In the lower film 162, the perforation lines 22 extend radially from the center over a predetermined length. Namely, the perforation lines 22 are formed so as not to reach a portion near the end portion of the outer circumference edge of the sealing lid 460. Further, the upper film 161 and the lower film 162 are sealed so as to cover the perforation lines 22 in a circular region, to form the circular adhesion region 163. When the adhesion region 163 having such a structure is provided, contents are prevented from spilling through the perforation lines 22 to enhance its outer appearance and hygiene.

The following scope of the present invention based on the present embodiment can be considered.

A packaging container in which the adhesion region of the sealing lid includes a circular region that covers the perforation lines.

(Ninth Embodiment)

Figure 29:
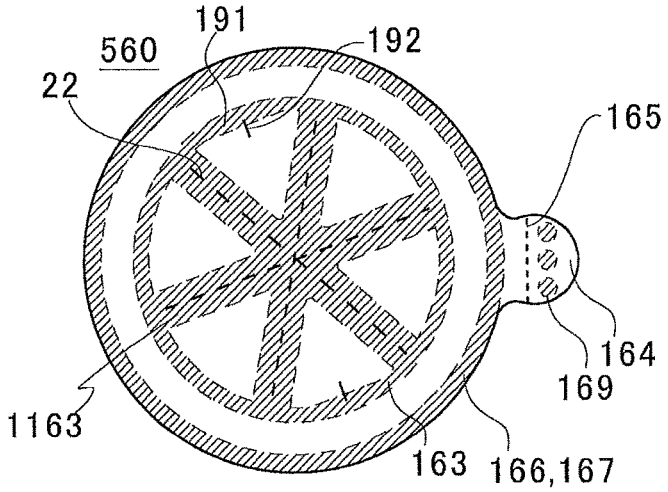
FIG. 29 is a plan view of a sealing lid according to a ninth embodiment of the present invention.

A ninth embodiment of the present invention will be described. The present embodiment is different from the seventh embodiment in sealing lid. Also for the sealing lid, description of the same contents as described for the seventh embodiment is omitted as appropriate. FIG. 29 is a plan view of a sealing lid 560 according to the present embodiment. The sealing lid 560 is formed such that the sealing lid 360 of the seventh embodiment includes: the increased width portion 191 formed by a part of the annular adhesion region 163 having an increased width; and the upper film 161 having the air slit 192 that extends from an inner region surrounded by the adhesion region 163 through the inner circumferential edge of the increased width portion 191 to the inside of the adhesion region 163. The increased width portion 191 and the air slit 192 are formed near a starting end and a finishing end in the heat-sealing process for the adhesion region 163. Further, by the air slit 192 being formed in the increased width portion 191, even when positioning accuracy is low, the air slit 192 can be prevented from extending across the adhesion region 163, to prevent degradation of the quality in the sealing. Further, an adhesion region 1163 is provided so as to extend along the perforation lines 22 from some portions of the adhesion region 163. The center for the annular portion corresponds to the center of the sealing lid 560. When the adhesion regions 163 and 1163 having such structures are provided, contents are prevented from spilling through the perforation lines 22 to enhance its outer appearance and hygiene, and generation of air accumulation in a region surrounded by the adhesion regions 163 and 1163 can be reduced. Further, when, for example, the rolling into a roll shape or the like is performed after the heat-sealing process, air accumulated, in an in-between region between the upper film 161 and the lower film 162, inside the adhesion region 163 can be vented through the air slit 192, to prevent the seal from being cut. The tip portion of the tab 164 is partially adhered in a plurality of circular adhesion regions 169.

In the present embodiment, an exemplary case is described where the diameter of the sealing lid 560 is 86.8 mm, and the length of each perforation line 22 is 55 mm. Further, the inner diameter for the annular adhesion region 163 is 60 mm, and the outer diameter is 66 mm. The diameter of each adhesion area of the adhesion regions 169 in the tip portion of the tab 164 is 2 mm, and the adhesion areas are provided at intervals of 6 mm.

The adhering strength of the adhesion regions 163 and 1163 preferably ranges from 30N to 70N in a direction parallel to the surface of the sealing lid 560. The adhesion region 163 is provided over the entirety of the circumference of the annular portion surrounding the perforation lines 22, and the adhesion region 1163 is provided over the entirety of the region of the perforation lines 22. Therefore, the adhering strength can be enhanced in the direction parallel to the surface of the sealing lid 560.

The following scope of the present invention based on the present embodiment can be considered.

A packaging container in which the adhesion region of the sealing lid further includes a region formed so as to cover the perforation lines and extend up to the annular region.

(Tenth Embodiment)

Figure 30:
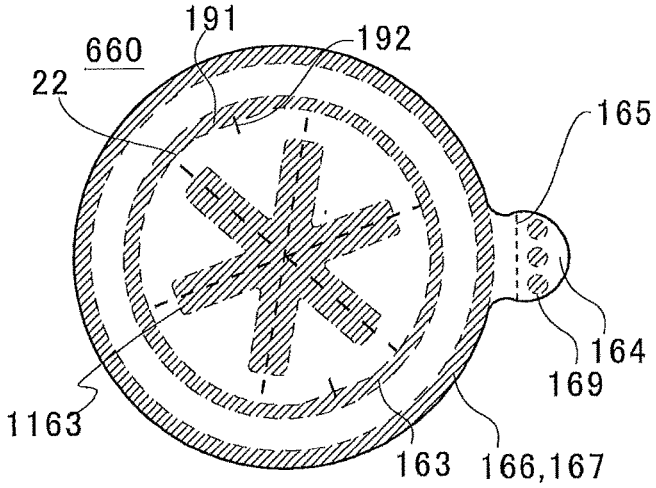
FIG. 30 is a plan view of a sealing lid according to a tenth embodiment of the present invention.

A tenth embodiment of the present invention will be described. The present embodiment is different from the seventh embodiment in sealing lid. Also for the sealing lid, description of the same contents as described for the seventh embodiment is omitted as appropriate. FIG. 30 is a plan view of a sealing lid 660 according to the present embodiment. The sealing lid 660 is formed such that, in the sealing lid 360 of the seventh embodiment, the adhesion region 1163 along the perforation lines 22 does not contact with the annular adhesion region 163. Further, the increased width portion 191 and the air slit 192 are formed. When the adhesion region 1163 having such a structure is provided, contents are prevented from spilling through the perforation lines 22, its outer appearance and hygiene are enhanced, and air accumulated in the adhesion region 1163 can be more assuredly vented, whereby rolling can be performed without trouble when the sealing lid 660 is rolled and stored. Further, the tip portion of the tab 164 is partially adhered in the plurality of circular adhesion regions 169.

The adhering strength of the adhesion regions 163 and 1163 preferably ranges from 30N to 70N in a direction parallel to the surface of the sealing lid 660. The adhesion region 163 is provided over the entirety of the circumference of the annular portion surrounding the perforation lines 22, and the adhesion region 1163 is provided in a portion of the region of the perforation lines 22. Therefore, the adhering strength can be enhanced in the direction parallel to the surface of the sealing lid 660.

The following scope of the present invention based on the present embodiment can be considered.

A packaging container in which the adhesion region of the sealing lid further includes a region formed so as to cover the perforation lines and so as not to contact with the annular region.

(Eleventh Embodiment)

Figure 31:
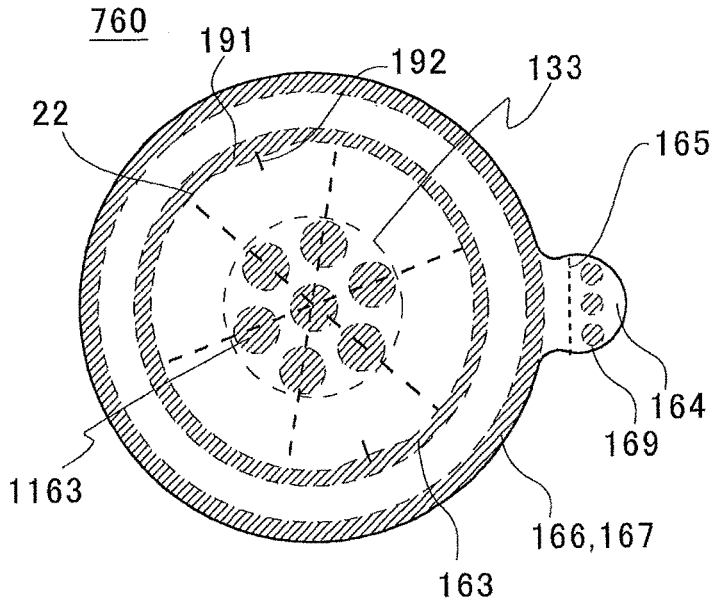
FIG. 31 is a plan view of a sealing lid according to an eleventh embodiment of the present invention.

An eleventh embodiment of the present invention will be described. The present embodiment is different from the seventh embodiment in sealing lid. Also for the sealing lid, description of the same contents as described for the seventh embodiment is omitted as appropriate. FIG. 31 is a plan view of a sealing lid 760 according to the present embodiment. The sealing lid 760 is formed such that, in the sealing lid 360 of the seventh embodiment, the adhesion region 1163 is formed as plural circular regions which are point-symmetric with respect to the center meeting portion of the perforation lines 22, and the plural circular regions are provided in a circular region including, as its center, the center meeting portion of the perforation lines 22, so as to be on the perforation lines 22 inside a funnel inner diameter 133. Further, the increased width portion 191 and the air slit 192 are formed. When the adhesion region 1163 having such a structure is provided, contents can be prevented from spilling through the perforation lines 22, its outer appearance and hygiene can be enhanced, air accumulation in the adhesion region 1163 can be prevented, and air can be sufficiently vented. Therefore, when the sealing lid 760 is rolled and stored, removal of the seal due to air accumulation can be prevented. Further, the tip portion of the tab 164 is partially adhered in the plurality of circular adhesion regions 169.

The adhering strength of the adhesion regions 163 and 1163 preferably ranges from 30N to 70N in a direction parallel to the surface of the sealing lid 760. Since the adhesion region 163 is provided over the entirety of the circumference of the annular portion surrounding the perforation lines 22, and the adhesion region 1163 is provided over the perforation lines 22 as a plurality of circular regions, adhering strength can be enhanced in the direction parallel to the surface of the sealing lid 760.

(Twelfth Embodiment)

Figure 32:
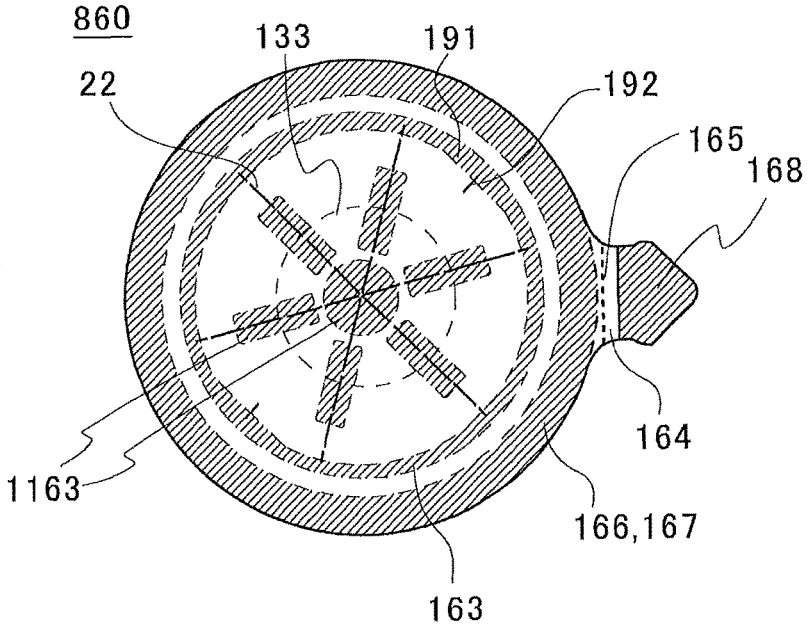
FIG. 32 is a plan view of a sealing lid according to a twelfth embodiment of the present invention.

A twelfth embodiment of the present invention will be described. The present embodiment is different from the seventh embodiment in sealing lid. Also for the sealing lid, description of the same contents as described for the seventh embodiment is omitted as appropriate. FIG. 32 is a plan view of a sealing lid 860 according to the present embodiment. The sealing lid 860 is formed such that, in the sealing lid 360 of the seventh embodiment, the adhesion region 1163 is formed so as to include: a circular region including, as its center, the center meeting portion of the perforation lines 22; and regions which cover the perforation lines 22, and extend outward from portions inside the inner diameter of the funnel component so as not to contact with the annular region. Further, the increased width portion 191 and the air slit 192 are formed. When the adhesion region 1163 having such a structure is provided, contents can be prevented from spilling through the perforation lines 22, its outer appearance and hygiene can be enhanced, and air accumulation can be prevented, thereby facilitating rolling and storage of the sealing lid 860. Further, in the present embodiment, at the tab 164, the upper film 161 and the lower film 162 are adhered to each other in the region 168 that is a portion, of the tab 164, including the tip portion thereof. However, another region in which no adhesion is performed is provided so as to extend across the tab 164. The tip portion of the tab 164 may be partially adhered in a plurality of circular adhesion regions. The shape of the tip portion of the tab 164 is not limited to the shape shown in FIG. 32. The same shape as described for the eighth to the eleventh embodiments may be used.

In the present embodiment, an exemplary case where the diameter of the sealing lid 860 is 92 mm, and the length of each perforation line 22 is 67 mm, is described. Further, the center meeting portion of the perforation lines 22 corresponds to the center of the sealing lid 860. An angle formed by the adjacent perforation lines 22 that extend radially from the center of the sealing lid 860, is 60°. The perforation lines 22 are formed as three straight lines. The lengths of the perforations are 2 mm, 6 mm, 7 mm, 7 mm, 7 mm, 7 mm, 7 mm, 7 mm, 6 mm, and 2 mm in order, respectively, from the outer side. The length of a portion connecting between adjacent perforations is 1 mm. The inner diameter for the annular adhesion region 163 is 65 mm and the outer diameter is 71 mm. Furthermore, the length of the air slit 192 is 4 mm. The adhesion region 1163 is formed so as to include: one circular area that includes, as its center, the center meeting portion of the perforation lines 22 and has the diameter of 15 mm; and two adhesion areas which are on each perforation line 22 and each of which is 16 mm long in the direction along the perforation line 22 and 9 mm long in the direction orthogonal to the perforation line 22, such that the total number of the adhesion areas of the adhesion region 1163 is seven.

The adhering strength of the adhesion regions 163 and 1163 preferably ranges from 30N to 70N in a direction parallel to the surface of the sealing lid 860. The adhesion region 163 is provided over the entirety of the circumference of the annular portion surrounding the perforation lines 22, and the adhesion region 1163 is provided in regions that cover the perforation lines 22, and extend from portions inside the inner diameter of the funnel component so as not to contact with the annular region. Therefore, the adhering strength can be enhanced in the direction parallel to the surface of the sealing lid 860.

The following scope of the present invention based on the present embodiment can be considered.

A packaging container in which the adhesion region of the sealing lid further includes: a circular region including, as its center, the center meeting portion of the perforation lines; and regions which cover the perforation lines and extend outward from portions inside the inner diameter of the funnel component so as not to contact with the annular region.

(Thirteenth Embodiment)

Figure 33:
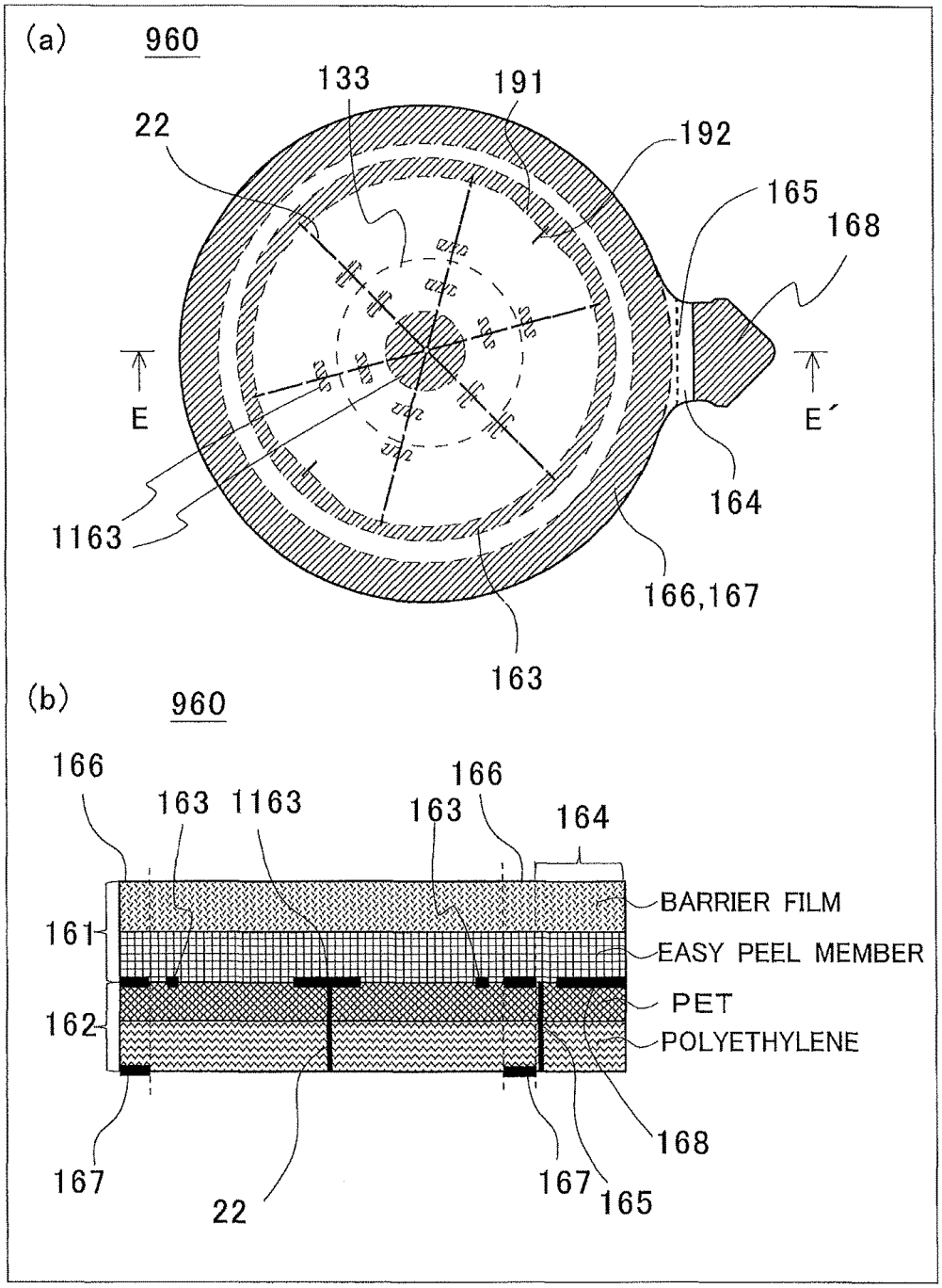
FIG. 33 is a plan view and a cross-sectional view of a sealing lid according to a thirteenth embodiment of the present invention.

A thirteenth embodiment of the present invention will be described. The present embodiment is different from the twelfth embodiment in sealing lid. Also for the sealing lid, description of the same contents as described for the twelfth embodiment is omitted as appropriate. (a) of FIG. 33 is a plan view of a sealing lid 960 according to the present embodiment, and (b) of FIG. 33 schematically illustrates a cross-section taken along a line E-E' shown in (a) of FIG. 33. The sealing lid 960 is formed such that, in the sealing lid 860 of the twelfth embodiment, one adhesion region 1163 is provided, over each perforation line 22, inside the inner diameter of the funnel component, and one adhesion region 1163 is provided, over each perforation line 22, outside the inner diameter of the funnel component, instead of regions being provided, in the sealing lid 860 of the twelfth embodiment, so as to cover the perforation lines 22 of the adhesion region 1163, and extend from portion inside the inner diameter of the funnel component so as not to contact with the annular region, and further the adhesion regions 1163 of the present embodiment are point-symmetric with respect to the center of the sealing lid 960. When the adhesion region having such a structure is provided, contents are prevented from spilling through the perforation lines 22, its outer appearance and hygiene are enhanced, and the opening strength at the perforation lines 22 is prevented from being excessively enhanced. In the present embodiment, at the tab 164, the upper film 161 and the lower film 162 are adhered to each other in the region 168 that is a portion, of the tab 164, including the tip portion thereof. However, another region in which no adhesion is performed is provided so as to extend across the tab 164. The tip portion of the tab 164 may be partially adhered in the plurality of circular adhesion regions. Further, the shape of the tip portion of the tab 164 is not limited to the shape shown in FIG. 33, and may be the same shape as described for the eighth to the eleventh embodiments.

In the present embodiment, an exemplary case where the diameter of the sealing lid 960 is 92 mm, and the length of each perforation line 22 is 67 mm, is described. The center meeting portion of the perforation lines 22 corresponds to the center of the sealing lid 960. An angle formed by the adjacent perforation lines 22 that extend radially from the center of the sealing lid 960 is 60°. The perforation lines 22 are formed as three straight lines. The lengths of the perforations are 2 mm, 6 mm, 7 mm, 7 mm, 7 mm, 7 mm, 7 mm, 7 mm, 6 mm, and 2 mm in order, respectively, from the outer side. The length of a portion connecting between adjacent perforations is 1 mm. The inner diameter for the annular adhesion region 163 is 65 mm and the outer diameter is 71 mm. The funnel inner diameter 133 is 35.4 mm. The length of the air slit 192 is 4 mm. The adhesion region 1163 is formed so as to include: one circular area that includes, as its center, the center meeting portion of the perforation lines 22 and has the diameter of 15 mm; and two areas provided on each perforation line 22 inside the funnel inner diameter, and two areas provided on each perforation line 22 outside the funnel inner diameter, such that the total number of the areas of the adhesion region 1163 is thirteen.

The adhering strength of the adhesion regions 163 and 1163 preferably ranges from 30N to 70N in a direction parallel to the surface of the sealing lid 960. The adhesion region 163 is provided over the entirety of the circumference of the annular portion surrounding the perforation lines 22, and the adhesion region 1163 is provided over the perforation lines 22 inside and outside the inner diameter of the funnel component. Therefore, the adhering strength can be enhanced in the direction parallel to the surface of the sealing lid 660.

(Fourteenth Embodiment)

Figure 34:
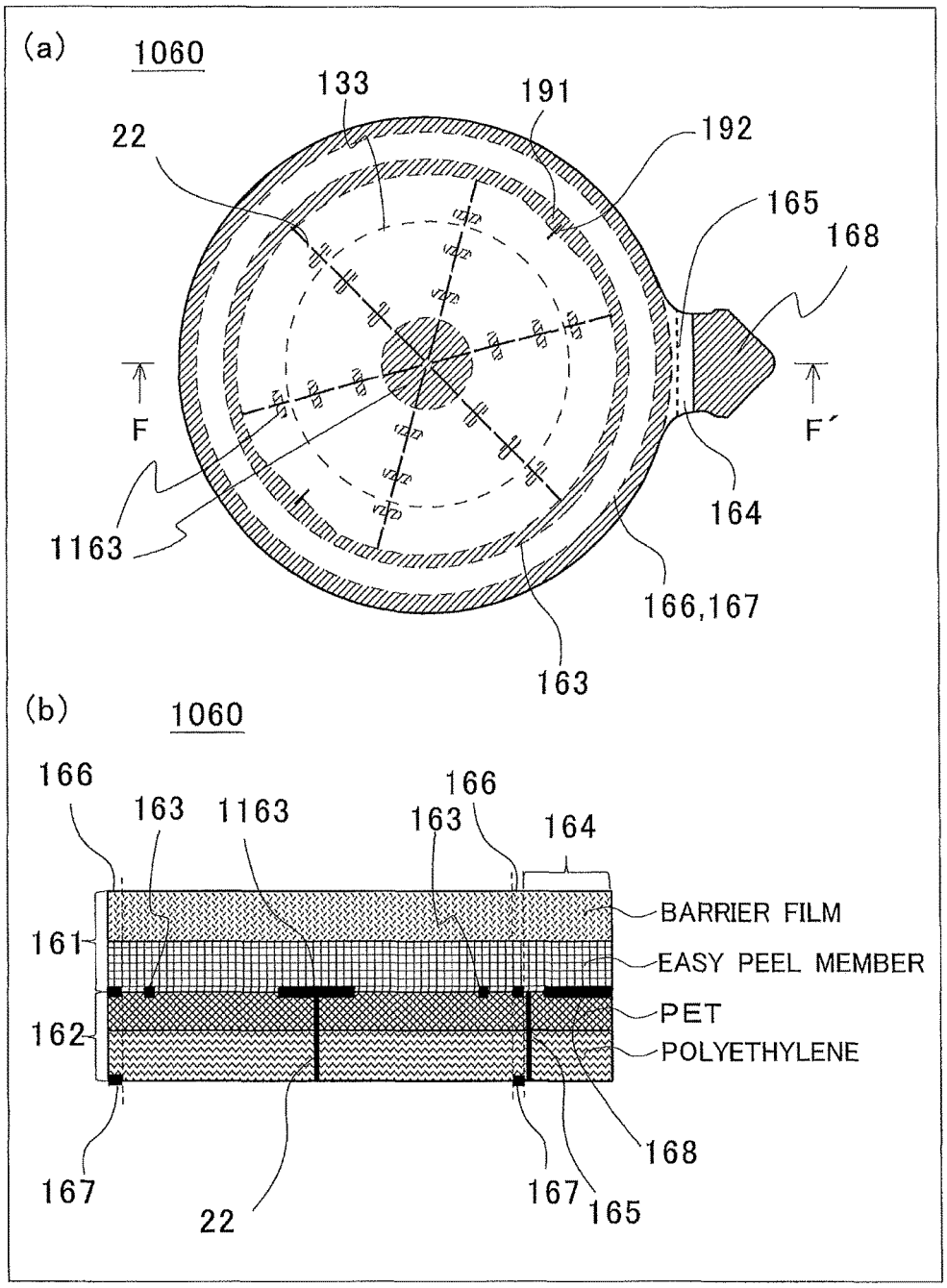
FIG. 34 is a plan view and a cross-sectional view of a sealing lid according to a fourteenth embodiment of the present invention.
Figure 38:
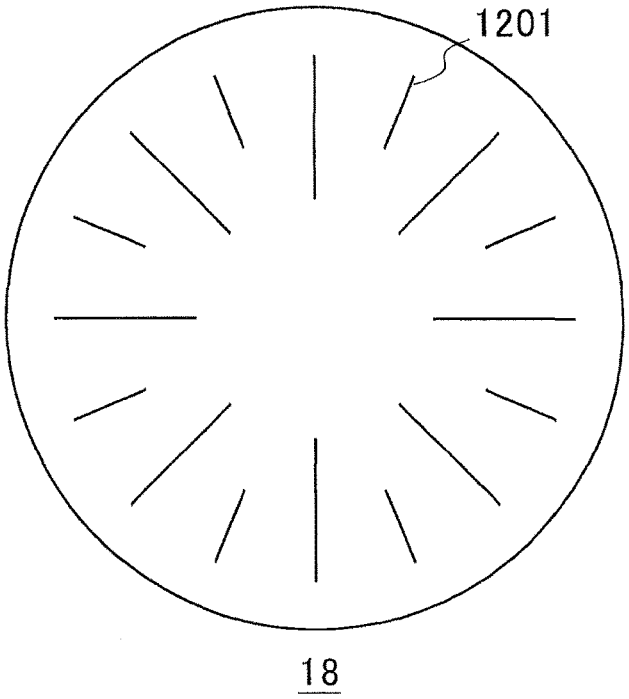
FIG. 38 is an external view of a bottom portion of a packaging container according to a third modification of the fifteenth embodiment of the present invention, as viewed from the outside of the packaging container.

A fourteenth embodiment of the present invention will be described. The present embodiment is different from the thirteenth embodiment in sealing lid. Also for the sealing lid, description of the same contents as described for the thirteenth embodiment is omitted as appropriate. (a) of FIG. 34 is a plan view of a sealing lid 1060 according to the present embodiment. (b) of FIG. 38 schematically illustrates a cross-section taken along a line F-F' shown in (a) of FIG. 38. The sealing lid 1060 is formed such that, in the sealing lid 960 of the thirteenth embodiment, one more adhesion region 1163 is provided over each perforation line 22 inside the inner diameter of the funnel component. In a case where the adhesion region having such a structure is provided, even when the diameter of the sealing lid is increased, contents are prevented from spilling through the perforation lines 22, its outer appearance and hygiene are enhanced, and the opening strength at the perforation lines 22 is prevented from being excessively enhanced. In the present embodiment, at the tab 164, the upper film 161 and the lower film 162 are adhered to each other in the region 168 that is a portion, of the tab 164, including the tip portion thereof. However, another region in which no adhesion is performed is provided so as to extend across the tab 164. The tip portion of the tab 164 may be partially adhered in the plurality of circular adhesion regions. Further, the shape of the tip portion of the tab 164 is not limited to the shape shown in FIG. 34, and may be the same shape as described for the eighth to the eleventh embodiments.

In the present embodiment, an exemplary case where the diameter of the sealing lid 1060 is 108 mm and the length of each perforation line 22 is 84 mm, is described. The center meeting portion of the perforation lines 22 corresponds to the center of the sealing lid 1060. An angle formed by the adjacent perforation lines 22 that extend radially from the center of the sealing lid 1060, is 60°. The perforation lines 22 are formed as three straight lines. The lengths of the perforations are 5 mm, 5 mm, 9 mm, 9 mm, 9 mm, 9 mm, 9 mm, 9 mm, 5 mm, and 5 mm in order, respectively, from the outer side. The lengths of portions each connecting between adjacent perforations are 1 mm, 1 mm, 1 mm, 1 mm, 2 mm, 1 mm, 1 mm, 1 mm, and 1 mm in order, respectively, from the outer side. The inner diameter for the annular adhesion region 163 is 83 mm and the outer diameter is 89 mm. The length of the air slit 192 is 5 mm. The adhesion region 1163 is formed so as to include: one circular area that includes, as its center, the center meeting portion of the perforation lines 22 and has the diameter of 20 mm; and four adhesion areas provided over each perforation line 22 inside the funnel inner diameter and two adhesion areas provided over each perforation line 22 outside the funnel inner diameter, such that the total number of the adhesion areas of the adhesion region 1163 is 19. Further, each of the adhesion areas provided inside and outside the funnel inner diameter is 2 mm long in the direction along the corresponding perforation line 22, is 6 mm long in the direction orthogonal to the corresponding perforation line 22, and has corners each chamfered so as to have a curved surface with R0.5. The adhesion areas provided over each perforation line 22 inside and outside the funnel inner diameter are distant from the center of the sealing lid 1060 by 14.5 mm, 24.5 mm, and 32.5 mm so as to be point-symmetric with respect to the center of the sealing lid 1060.

The adhering strength of the adhesion regions 163 and 1163 preferably ranges from 30N to 70N in a direction parallel to the surface of the sealing lid 760. The adhesion region 163 is provided over the entirety of the circumference of the annular portion surrounding the perforation lines 22, and the adhesion region 1163 is provided over the perforation lines 22 inside and outside the inner diameter of the funnel component. Therefore, the adhering strength can be enhanced in the direction parallel to the surface of the sealing lid 1060.

In the sealing lids 460 to 1060 according to the above embodiments, since ink, varnish, and the like are not used for adhesion, no odor is generated. Further, a transparent film is used, and printing can be performed with excellent outer appearance, and printing can be also performed on the upper film 161 or the lower film 162 so as to obtain transparent visibility. In the sealing lids 360 to 1060 according to the above embodiments, the upper film 161 may further include a PET layer (having the thickness of 12 μm) on a side closer to the outer side of the packaging container 100. Further, the lower film 162 may further include a barrier film (having a thickness ranging from 12 μm to 100 μm) between the PET layer and the polyethylene layer. In particular, when food is stored as contents, the PET layer on which printing with ink is performed is layered over the barrier film layer in the upper film 161 and the lower film 162, whereby printing can be performed with enhanced safety from the viewpoint of food hygiene.

In the sixth to the fourteenth embodiments, when the upper film 161 is separated from the lower film 162, the perforation lines 22 gradually become exposed while the separation progresses. When the sealing lid is protected by a conventional shrink film or covering cap, perforation lines become exposed soon by removing the shrink film or covering cap. In a high land or at a high temperature, pressure inside the packaging container is higher than the external pressure. Therefore, in conventional arts, the perforation lines may be cut simultaneously when the perforation lines become exposed, and the sealing lid may be cut and the contents may be dispersed. On the other hand, in the present embodiment, the separation gradually progresses with the lower film 162 being protected by the upper film 161. Therefore, air passes through the perforation lines 22 without cutting, and difference between air pressure inside the packaging container 100 and air pressure outside the packaging container 100 is eliminated. Thus, the lower film 162 can be prevented from being cut.

Furthermore, the size of each of the sealing lids 260 to 1060, the number of the perforation lines 22 of the lower film 162, the length of each perforation line 22 thereof, the position of the adhesion region 163 and the number of the adhesion regions 163, and the like are not limited to the exemplary ones described in each embodiment, and may be changed as appropriate.

An exemplary modification of each embodiment in which the tab 164 of the sealing lid may be welded to the side wall 17 of the container body 120 may be implemented, similarly to the second modification of the seventh embodiment. Further, in each embodiment, the tab 164 may be subjected to embossing process. The shape for the tab 164 is not limited to any specific shape.

The scopes of the present invention, as indicated below, based on the sixth to the fourteenth embodiments can be considered.

1. A packaging container in which the tab has a projection formed by the upper film and the lower film being subjected to embossing process.

2. A packaging container in which the easy peel member of the upper film is formed by a polyester-based resin.

3. A packaging container in which the barrier film of the upper film is a film having an inorganic oxide vapor deposition film or a metal deposition film, or a film formed by an ethylene-vinylalcohol copolymer (EVOH), or a polyvinyl alcohol (PVA).

(Fifteenth Embodiment)

Figure 35:
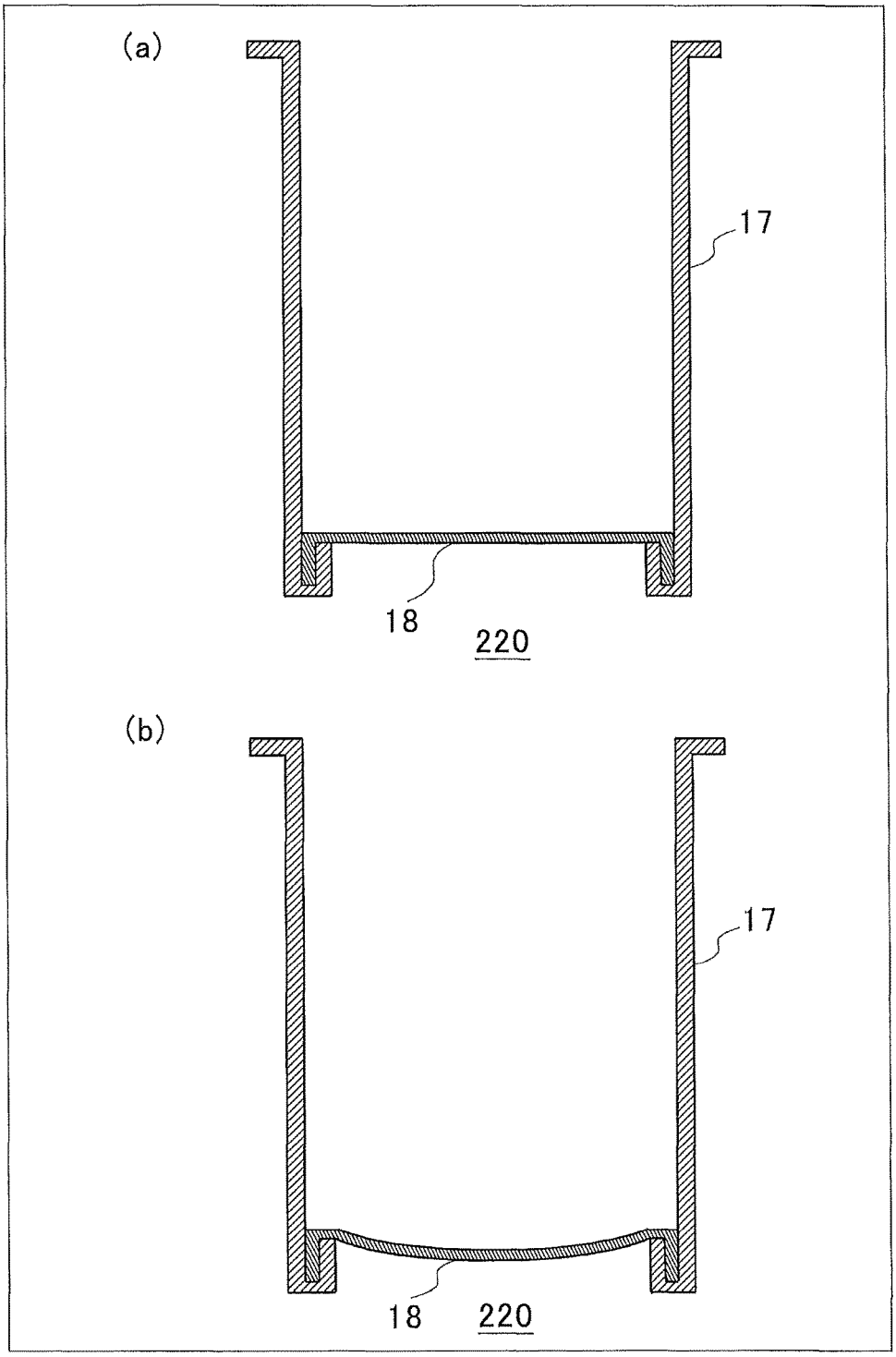
FIG. 35 is a schematic cross-sectional view of a packaging container according to a fifteenth embodiment of the present invention.

A packaging container 200 according to the present embodiment will be described. FIG. 35 is a schematic cross-sectional view of a container body 220 of the packaging container 200. An outline of the packaging container 200 of the present embodiment will be described with reference to FIG. 35. The packaging container 200 is the packaging container in which the container body 220 as described below is used as the container body 120 according to each of the first to the fourteenth embodiments.

The side wall 17 forms a cylindrical shape. The height of the side wall 17 is, for example, 180 mm, and the outer diameter of the side wall 17 is, for example, 95 mm. The bottom portion 18 is provided on the lower end side of the side wall 17. For example, the bottom portion 18 is provided so as to have a height that corresponds to a certain distant from the lower end of the side wall 17 toward the upper end side. More specifically, the bottom portion 18 is provided so as to be higher than the lower end of the side wall 17 by 8 mm in a direction toward the upper end side. The outer edge of the bottom portion 18 connects with the inner side surface of the side wall 17. In FIG. 35, an opening is formed at the upper portion of the container body 220. As in conventional packaging containers, when contents are packaged in the packaging container 200, the opening is sealed, whereby the inner portion of the packaging container 200 is hermetically sealed. In an example shown in (a) of FIG. 35, the bottom portion 18 forms a flat surface. In an example shown in (b) of FIG. 35, the center portion of the bottom portion 18 projects outward of the container body 220.

Figure 36:
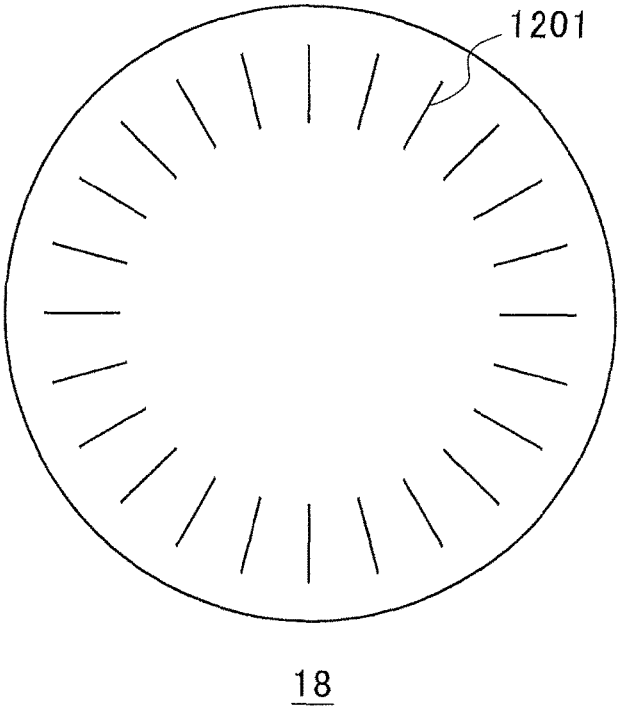
FIG. 36 is an external view of a bottom portion of the packaging container according to the fifteenth embodiment of the present invention, as viewed from the outside of the packaging container.

FIG. 36 is an external view of the bottom portion 18 shown in FIG. 35 as viewed from the outside of the container body 220. In an example shown in FIG. 36, 24 ruled lines 1201 are provided on the outer surface of the bottom portion 18 at regular intervals so as to radially extend as viewed from the center portion of the bottom portion 18. In this example, the length of each of the ruled lines 1201 is 12 mm. In FIG. 36, the solid lines in the circle represent the ruled lines. The number of the ruled lines is calculated such that each of the ruled lines that radially extend as viewed from the center portion of the bottom portion 18 is one ruled line. Namely, a set of the ruled lines that are point-symmetric with respect to the center of the bottom portion 18 is calculated as two ruled lines.

Figure 37:
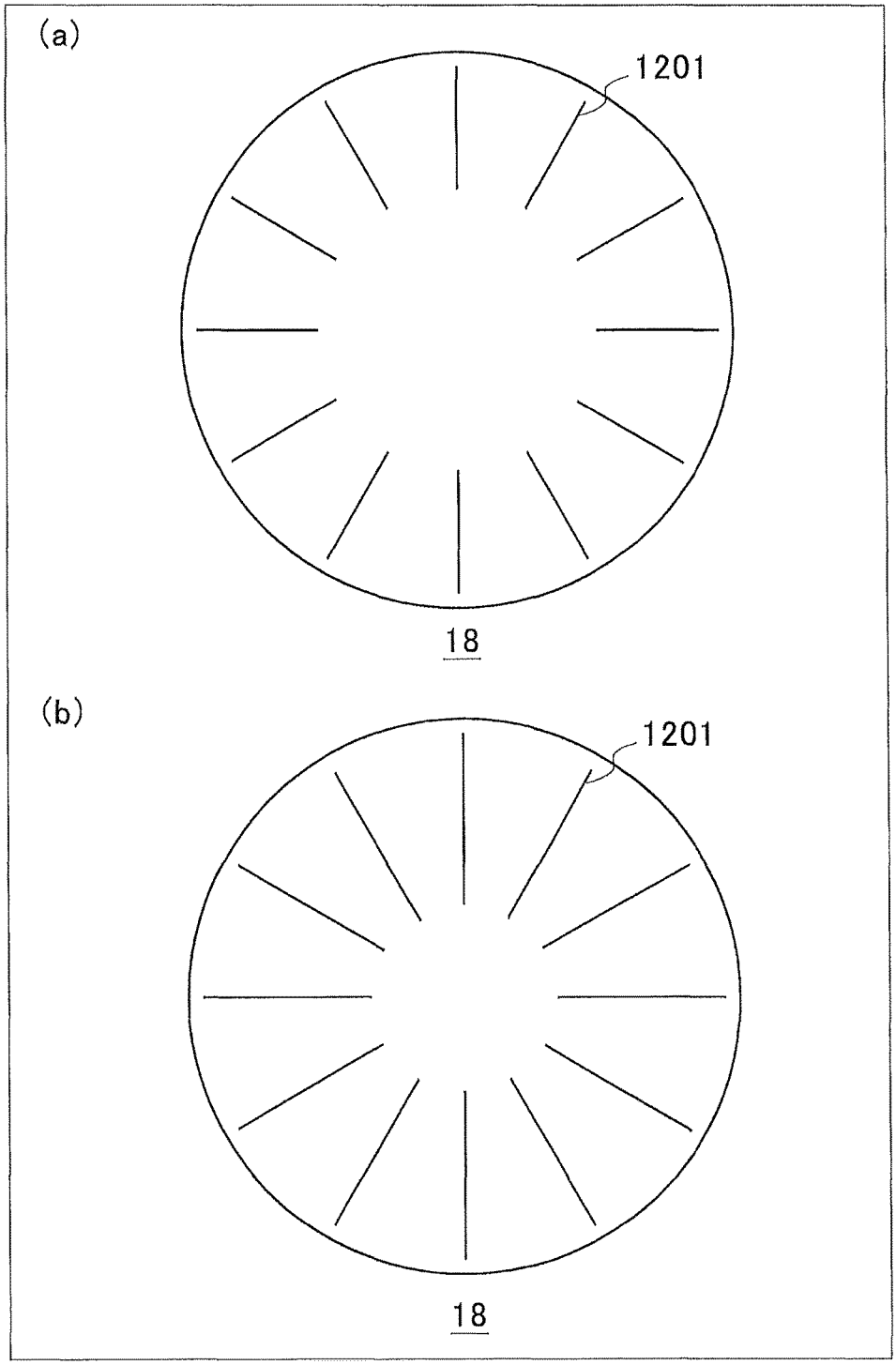
FIG. 37 is an external view of bottom portions of packaging containers according to a first modification and a second modification of the fifteenth embodiment of the present invention, as viewed from the outside of the packaging containers.

The number of the ruled lines 1201 and the length of each ruled line 1201 are not limited to the exemplary ones as shown in FIG. 36. As other examples, a first, second, and third modifications of the present embodiment are shown in FIG. 37 and FIG. 38. In an example shown in (a) of FIG. 37, 12 ruled lines 1201 are provided on the outer surface of the bottom portion 18 at regular intervals so as to radially extend as viewed from the center portion of the bottom portion 18. In this example, the length of each of the ruled lines 1201 is 22 mm. Further, in an example shown in (b) of FIG. 37, 12 ruled lines 1201 each having the length of 30 mm are provided on the outer surface of the bottom portion 18 at regular intervals. In an example shown in FIG. 38, 8 ruled lines 1201 each having the length of 12 mm and 8 ruled lines 1201 each having the length of 22 mm are provided on the outer surface of the bottom portion 18 at regular intervals such that the ruled line 1201 having the length of 12 mm and the ruled line 1201 having the length of 22 mm are alternately provided. The ruled lines may not be provided at regular intervals.

The length of each ruled line 1201 may be greater than or equal to 5 mm and less than 100 mm. The number of the ruled lines 1201 may be greater than or equal to 6 and less than 30. When the length of each ruled line 1201 is less than the above length, or the number of the ruled lines 1201 is less than the above number, crinkling is likely to occur. On the other hand, when the length of each ruled line 1201 is greater than the above length, or the number of the ruled lines 1201 is greater than the above number, rigidity of the bottom portion 18 is excessively reduced, and the strength of the packaging container is reduced. The number of the ruled lines 1201 is particularly preferably greater than or equal to 6, and less than 25.

Figure 39:
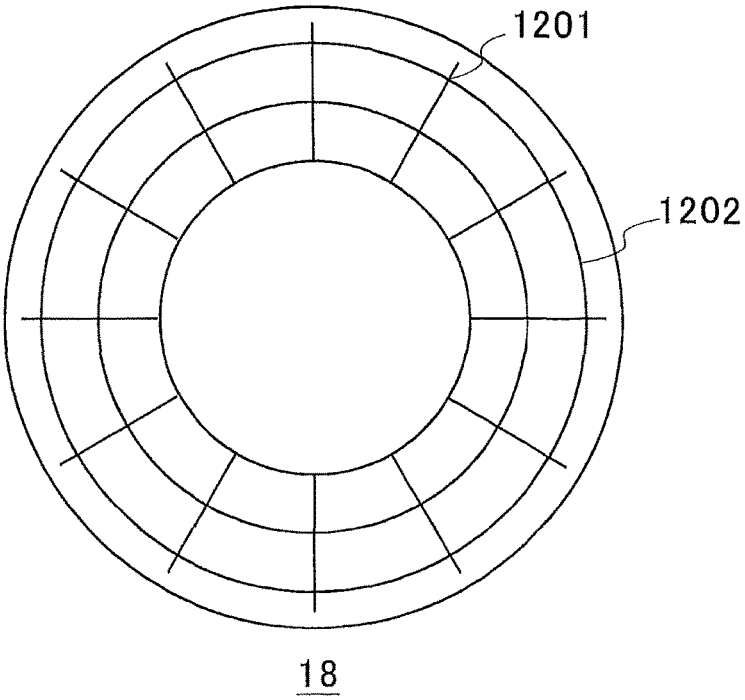
FIG. 39 is an external view of a bottom portion of a packaging container according to a fourth modification of the fifteenth embodiment of the present invention, as viewed from the outside of the packaging container.

Further, a fourth modification of the present embodiment may be implemented in which, in addition to the 12 ruled lines 1201, circular lines 1202 that intersect the 12 ruled lines 1201 may be provided, on the outer surface portion of the bottom portion 18, around the center portion of the bottom portion 18, which corresponds to the center of the circular shape formed by each circular line, as shown in FIG. 39.

In each of the above examples, the ruled lines 1201 are not formed in the center portion of the bottom portion 18. However, the ruled lines 1201 may pass through the center portion of the bottom portion 18.

Further, in each of the above examples, the bottom portion 18 is circular. However, the bottom portion 18 may be formed such that the upper and lower flat planes have a polygonal shape such as a square shape or a regular hexagon. Thus, the shape of the bottom portion 18 is not limited to any specific shape. The side wall 17 may have its inner side portion connected with the outer edge of the bottom portion 18.

Figure 40:
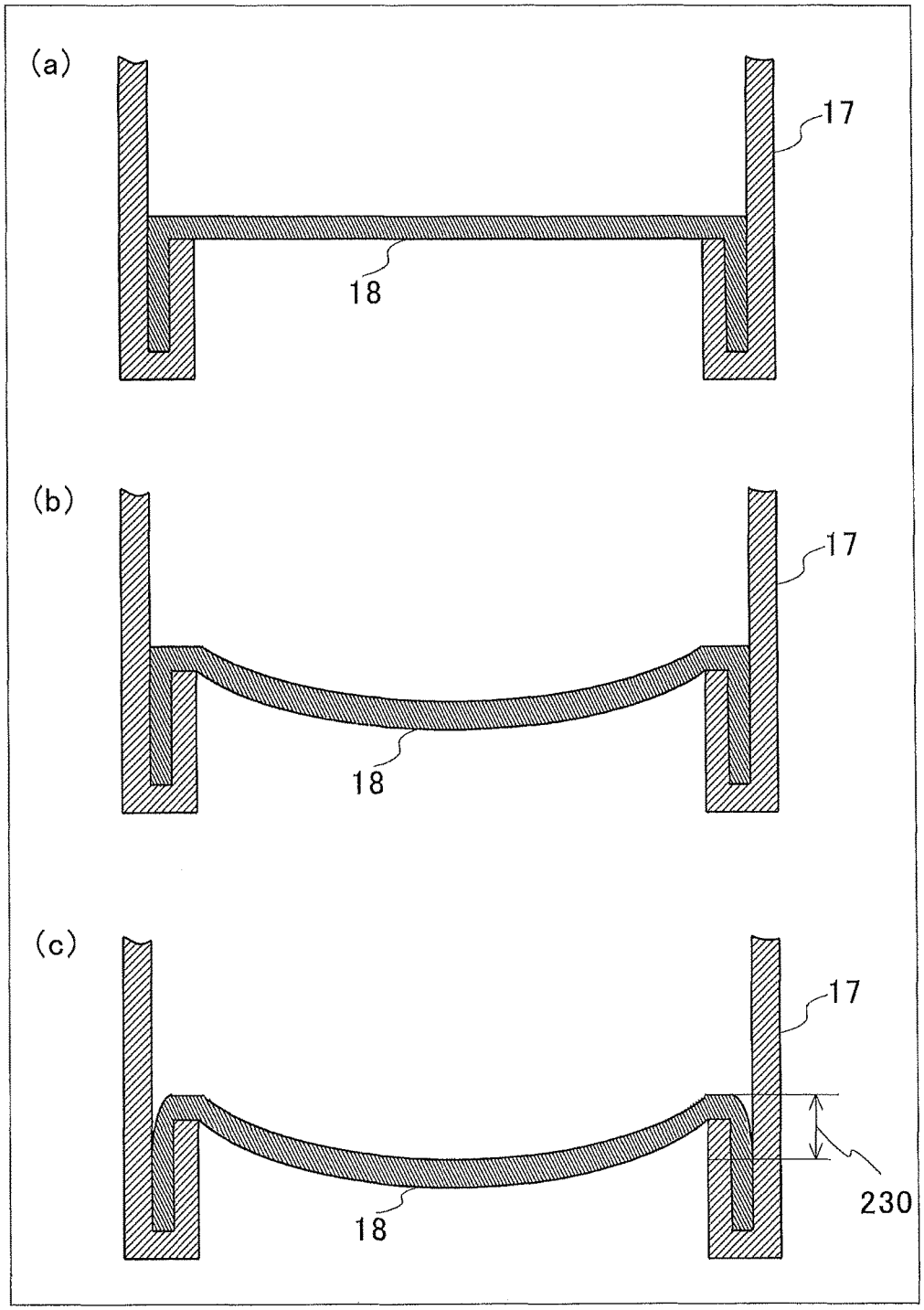
FIG. 40 is a schematic cross-sectional view of a portion near the bottom portion of the packaging container according to the fifteenth embodiment of the present invention.

(a) of FIG. 40 is a schematic cross-sectional view illustrating a portion near the bottom portion 18 of the packaging container 200 shown in (a) of FIG. 35. In the example shown in (a) of FIG. 35 and (a) of 40, the bottom portion 18 forms a flat surface without projecting, and the ruled lines 1201 (and/or the lines 1202) are simply formed. (b) of FIG. 40 is a schematic cross-sectional view illustrating a portion near the bottom portion 18 of the packaging container 200 shown in (b) of FIG. 35. In the example shown in (b) of FIG. 35 and (b) of FIG. 40, the center portion of the bottom portion 18 projects outward of the packaging container 200 by 5 mm as compared to the height of the outer edge of the bottom portion 18. As shown in FIG. 35 and FIG. 40, the lower end portion of the side wall 17 is bent inward, and a planar fixing portion that can be bent is provided outside the substantially outer edge of the bottom portion 18. The fixing portion is inserted into a gap formed by the side wall 17 having been bent, and the fixing portion and the side wall 17 are thereafter adhered to each other, to fix the bottom portion 18 to the side wall 17.

(c) of FIG. 40 is a schematic cross-sectional view illustrating a modification of a portion near the bottom portion 18 of the packaging container 200. In an example shown in (c) of FIG. 40, the fixing portion at the outer edge of the bottom portion 18 and the side wall 17 that sandwiches the fixing portion are adhered to each other so as to reach a predetermined height from a bending portion, of the side wall 17, which forms the lower end of the packaging container 200, thereby assuredly sealing the packaging container 200, and a non-sealed portion 230 in which no adhesion is performed is formed thereabove. In this example, the more greatly the center portion of the bottom portion 18 projects outward of the packaging container 200, the more greatly the non-sealed portion 230 of the fixing portion at the outer edge of the bottom portion 18 is deformed inward. Therefore, the bottom portion 18 is easily caused to project, and projection can be increased while crinkling that causes poor outer appearance as described below can be reduced with enhanced effectiveness. In a region where the fixing portion at the outer edge of the bottom portion 18, and the side wall 17 overlap each other, the length of the region in which the adhesion is performed preferably ranges from 1 mm to 15 mm, and particularly preferably ranges from 2 mm to 5 mm. Further, the length of the non-sealed portion 230 preferably ranges from 1 mm to 8 mm. When the length of the non-sealed portion 230 is less than or equal to 1 mm, an effect of reducing crinkling that causes poor outer appearance is reduced. When the length is greater than or equal to 8 mm, material cost and production efficiency of the packaging container 200 become worse.

Figure 41:
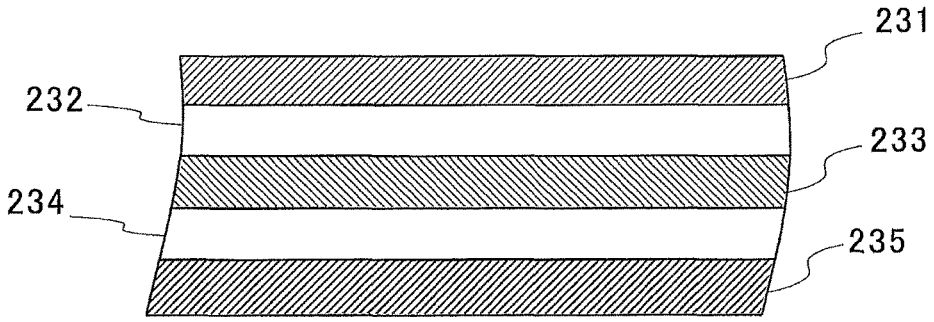
FIG. 41 illustrates a laminated structure of a side surface portion of the packaging container according to the fifteenth embodiment of the present invention.

FIG. 41 illustrates a laminated structure of the side wall 17. As shown in FIG. 41, the side wall 17 includes a polyethylene layer 231, a deposition film 232, a polyethylene terephthalate layer 233, paper 234, and a polyethylene layer 235 which are layered in order, respectively, from the inner side toward the outer side of the packaging container 200. The side wall 17 is formed by resin layers, film, and paper as described above. Therefore, the side wall 17 has rigidity and is deformable in the thickness direction or the like to some degree.

Figure 42:
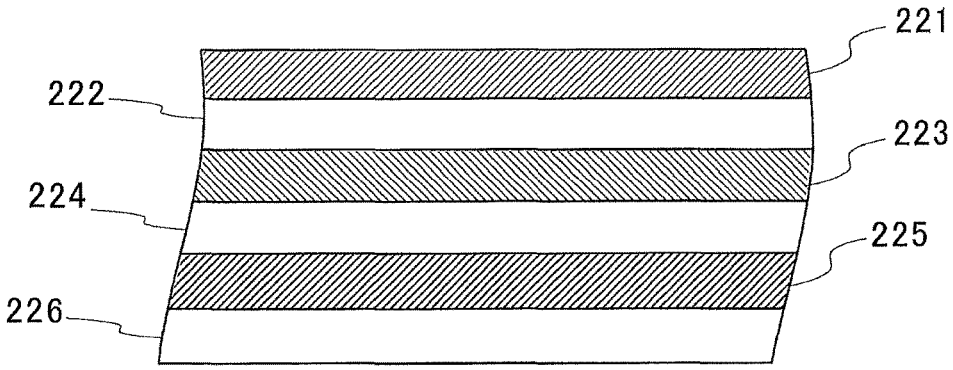
FIG. 42 illustrates a laminated structure of the bottom portion of the packaging container according to the fifteenth embodiment of the present invention.

FIG. 42 illustrates a laminated structure of the bottom portion 18. As shown in FIG. 42, the bottom portion 18 includes a polyethylene layer 221, a deposition film 222, a gas-sealing function resin layer 223, a polyethylene layer 224, paper 225, and a polyethylene layer 226 which are layered in order, respectively, from the inner side toward the outer side of the packaging container 200. The gas-sealing function resin layer is, for example, a resin layer formed by an ethylene-vinylalcohol copolymer. The bottom portion 18 is formed by the resin layers, film, and paper as described above. Therefore, the bottom portion 18 has rigidity, and is deformable in the thickness direction or the like to some degree.

Figure 43:
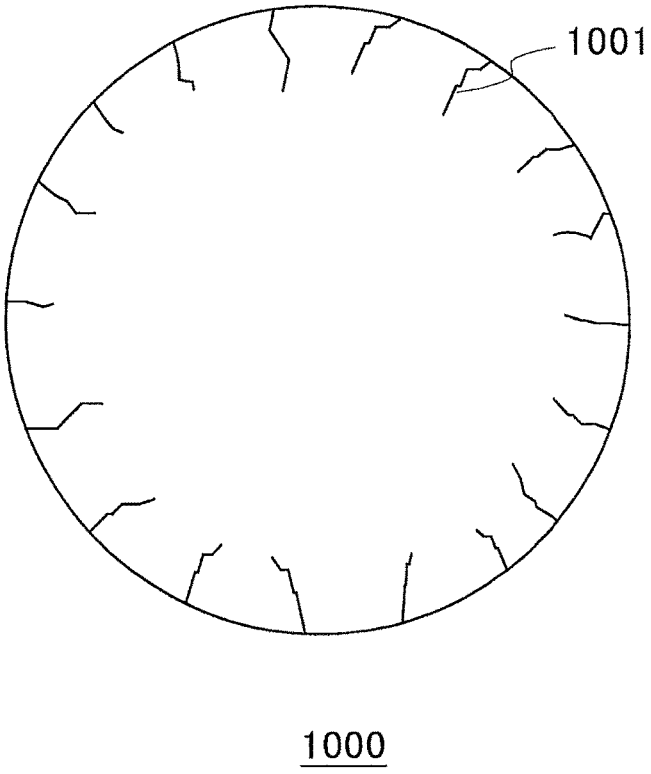
FIG. 43 illustrates a problem to be solved by the present invention.

In the examples shown in (b) of FIG. 35, and (b) and (c) of FIG. 40, when the bottom portion 18 is caused to project, stress generated near the outer edge of the bottom portion 18 is reduced by the ruled lines 1201 being compressed to reduce their widths, and the stress is dispersed over the entirety of the bottom portion 18. Further, when the ruled lines 1201 are provided, for example, crinkling occurs along the ruled lines 1201, whereby the crinkles are absorbed and become undistinguished. Thus, since generation of crinkles in the bottom portion 18 is reduced, the design of the packaging container 200 is prevented from being degraded and the bottom portion 18 can be caused to sufficiently project. On the other hand, when the ruled lines 1201 are not provided, since stress is concentrated on a portion near the outer edge of the bottom portion, crinkles 1001 are generated as in a bottom portion 1000 shown in FIG. 43, whereby the design is degraded, and projection becomes insufficient. In order to more assuredly reduce generation of crinkles, the non-sealed portion 230 may be provided as shown in (c) of FIG. 40. Further, in the bottom portion 18 shown in FIG. 39, the circular lines 1202 as well as the ruled lines 1201 enable reduction of the stress, and further enables absorption of crinkles.

Further, even in an environment in which air pressure outside the packaging container 200 is higher than air pressure thereinside, since the rigidity of the bottom portion 18 is lower than the rigidity of the side wall 17, projection of the bottom portion 18 is reduced or the bottom portion 18 is further recessed toward the inner side of the packaging container 200, thereby absorbing difference in air pressure. On the other hand, the side wall 17 having a distinguishable outer appearance is not deformed. Therefore, the design of the packaging container 200 is not degraded. For example, the packaging container 200 was filled with powdery substances of instant coffee at 30° C., and the opening was thereafter sealed, and the packaging container 200 was left as it was in an environment in which the temperature was 0° C. Namely, the packaging container 200 containing the contents was left as it was in an environment in which air pressure outside the packaging container 200 was higher than air pressure thereinside. In this case, projection of the bottom portion 18 was reduced, and the side wall 17 having a distinguishable outer appearance was not deformed. Namely, the design of the packaging container 200 was not degraded as a whole.

Thus, in the examples shown in (b) of FIG. 35 and (b) and (c) of FIG. 40, in a case where air pressure inside the packaging container 200 is lower than air pressure thereoutside, the difference in air pressure is absorbed. Therefore, the bottom portion 18 is caused to project outward of the packaging container in advance by, for example, supplying air. However, in a case where, as shown in (a) of FIG. 35 and (a) of FIG. 40, the bottom portion 18 is not caused to project in advance, when, for example, packaging containers in which contents are packaged in a place where the altitude is low are circulated and placed in a place where the altitude is high, and air pressure inside the packaging container becomes higher than air pressure thereoutside, the bottom portion 18 projects outward of the packaging container without generating crinkles to absorb difference in air pressure, and projection of the side wall 17 is prevented. Therefore, difference in air pressure can be absorbed without degrading the design of the packaging container.

Examples of the present embodiment will be described below. In a case where the bottom portion 18 of the container body 220 having no ruled lines and the bottom portions 18 of the container bodies 220 having the ruled lines shown in FIG. 36 to FIG. 39 were prepared, when air pressure inside the packaging containers 200 became lower than air pressure thereoutside, and the bottom portions were recessed, whether or not crinkles were generated in portions near the outer edges of the bottom portions, was determined. The determination results are as indicated below in a column of "crinkle that degraded outer appearance" in Table 2. In the column, "+" represents a state where no crinkles were generated, whereas "–" represents a state where crinkles were generated. In Table 2, a distance of projection of the center portion of the bottom portion 18 relative to the outer edge thereof is indicated as "depth of projection". Further, projection of the bottom portion 18 was formed by supplying air at 1 MPa for 0.2 seconds.

TABLE 2

| Whether or not ruled lines were provided | Depth of projection (mm) | Crinkle that degraded outer appearance |
|---|---|---|
| No ruled lines were provided (comparative example) | 3.5 | – |
| Ruled lines were provided (FIG. 36 24 ruled lines each having length of 12 mm) | 4.0 | + |
| Ruled lines were provided ((a) of FIG. 37 12 ruled lines each having length of 22 mm) | 5.0 | + |
| Ruled lines were provided ((b) of FIG. 37 12 ruled lines each having length of 30 mm) | 5.5 | + |
| Ruled lines were provided (FIG. 38 8 ruled lines each having length of 12 mm + 8 ruled lines each having length of 22 mm) | 5.4 | + |
| Ruled lines were provided (FIG. 39 12 ruled lines each having length of 22 mm + circular lines) | 6.0 | + |

As indicated in Table 2, in the bottom portion having no ruled lines, crinkles were generated near the outer edge of the bottom portion. On the other hand, in the bottom portions having the ruled lines shown in FIG. 36 to FIG. 39, no crinkles were generated near the outer edges of the bottom portions. Thus, it was confirmed that, when the ruled lines were provided on the outer surface portion of the bottom portion 18, even when air pressure inside the packaging container 200 became lower than air pressure thereoutside, and the bottom portion 18 was recessed, crinkles that degraded the design were not generated near the outer edge of the bottom portion 18.

Further, the scopes of the present invention, as indicated below, based on the present embodiment can be considered.

1. A packaging container in which the length of each ruled line is greater than or equal to 5 mm and less than 100 mm.

2. A packaging container in which the number of the ruled lines is greater than or equal to 6 and less than 30.

3. A packaging container in which the bottom portion is formed by a material in which a polyethylene layer, a deposition film, a gas-sealing function resin layer, a polyethylene layer, paper, and a polyethylene layer are layered in order, respectively, from the inner side toward the outer side of the packaging container.

4. A packaging container in which the side surface portion is formed by a material in which a polyethylene layer, a deposition film, a polyethylene terephthalate layer, paper, and a polyethylene layer are layered in order, respectively, from the inner side toward the outer side of the packaging container.

(Sixteenth Embodiment)

Figure 44:
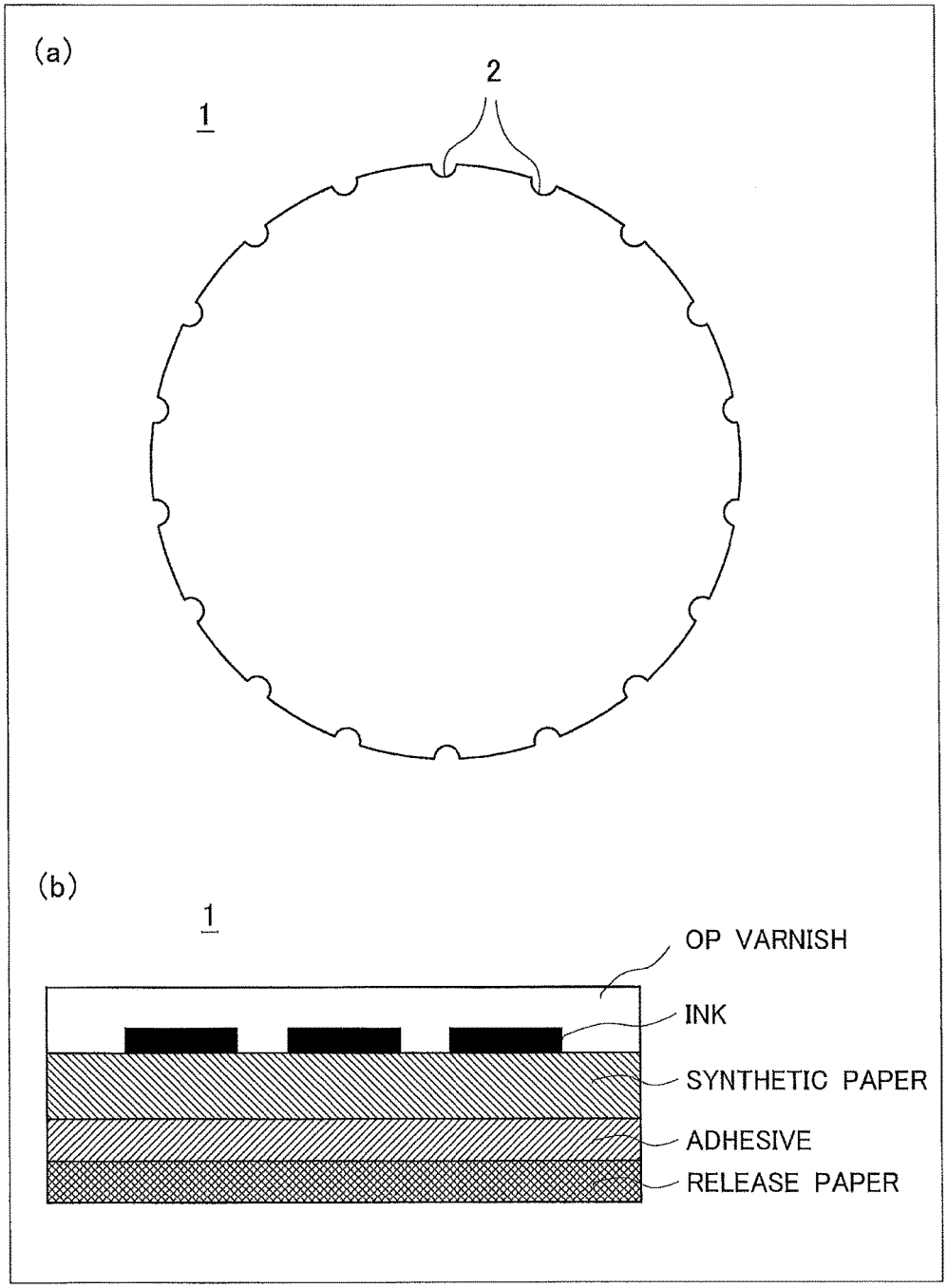
FIG. 44 is a plan view and a schematic cross-sectional view of a sticker label according to a sixteenth embodiment of the present invention.

A sixteenth embodiment of the present invention will be described below. (a) of FIG. 44 is a plan view of a sticker label 51 according to the present embodiment. Further, (b) of FIG. 44 is a schematic cross-sectional view illustrating a laminated structure of the sticker label 51. The sticker label 51 includes a plurality of recesses 52 formed by curved lines in a planer shape, at a plurality of portions in the circumferential edge portion. A packaging container 300 according to the present embodiment is obtained by the sticker label 51 being adhered to a surface of the sealing lid, which forms an outer side of the packaging container, in each of the packaging containers 100 and 200.

In an example shown in FIG. 44, the planar shape of the sticker label 51 is such that the circumferential edge of a circular member having the diameter of 68 mm is cut by 18 circles each having the radius of 1.5 mm at regular intervals, to form the recesses 52. The recesses 52 are each recessed by 1.5 mm from the circumferential edge of the circular member toward the center of the circular member.

As shown in (b) of FIG. 44, the sticker label 51 is formed by using synthetic paper as a base material. The sticker label 51 has, for example, a layer on which printing with ink is performed, and an OP (Over Print) varnish layer such that, on the synthetic paper, the OP varnish layer is layered over the layer on which printing with ink is performed. Further, below the synthetic paper, an adhesive layer is formed. The adhesive layer is protected by release paper during storage.

Figure 45:
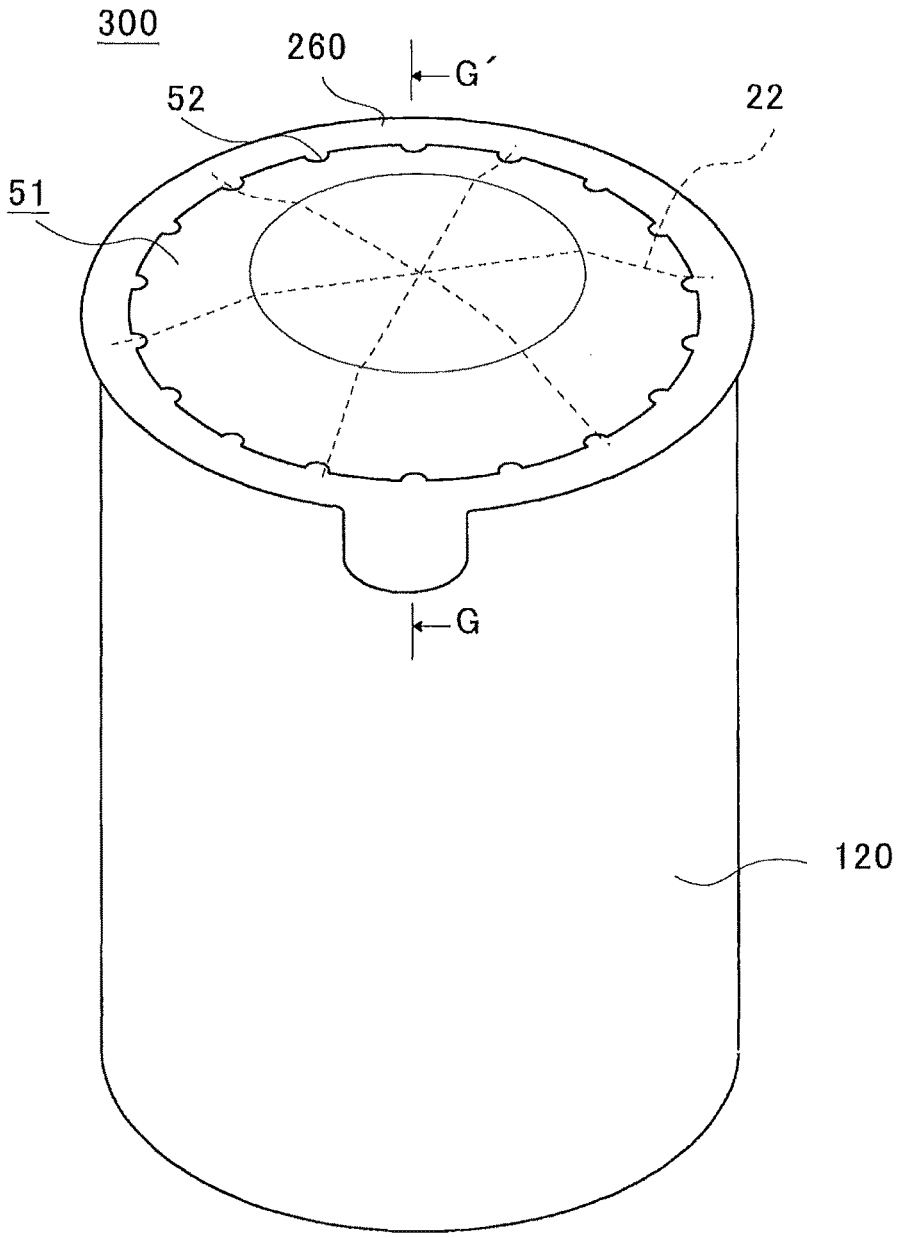
FIG. 45 is a perspective view of a packaging container according to the sixteenth embodiment of the present invention.
Figure 46:
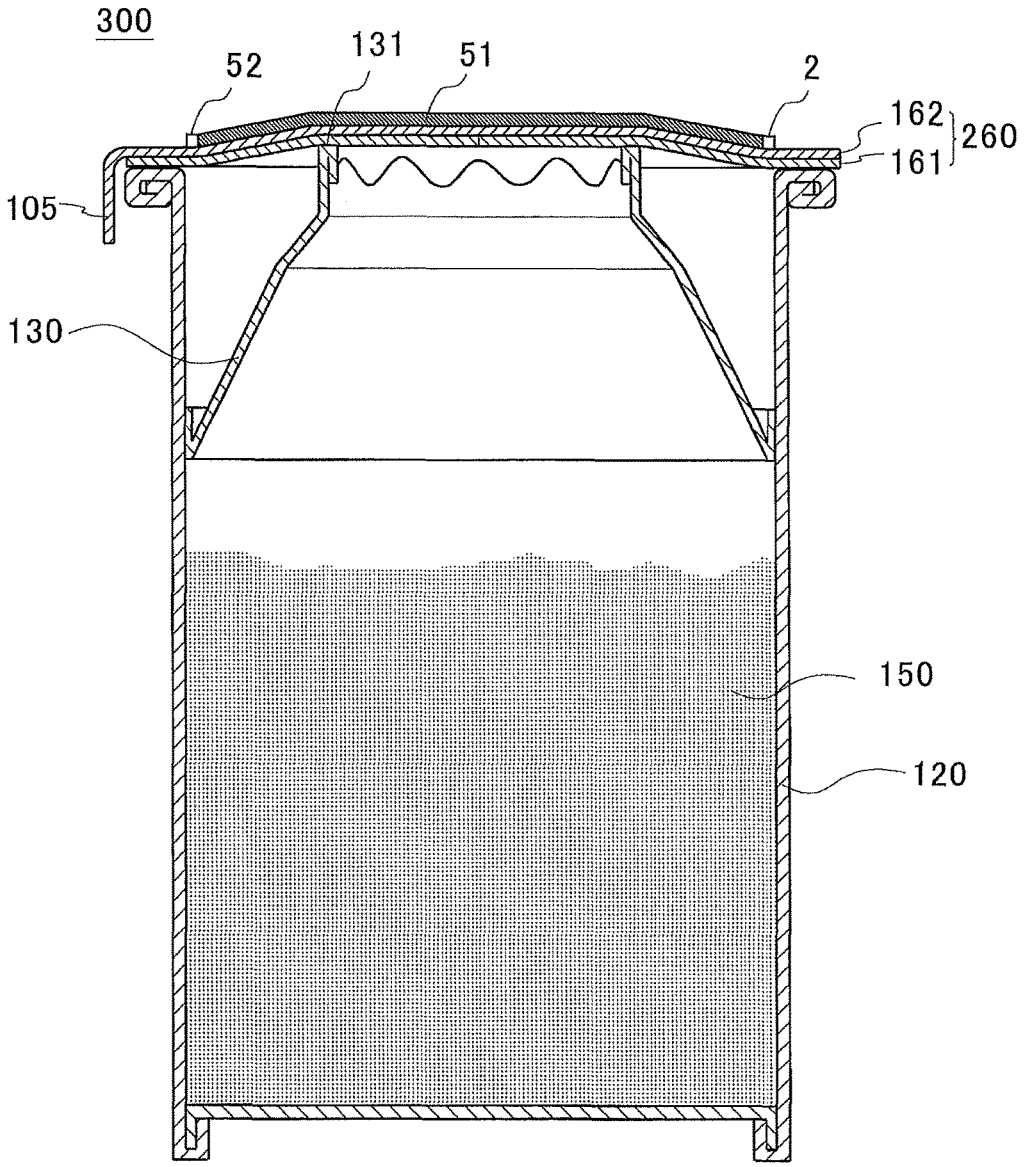
FIG. 46 is a vertical cross-sectional view of the packaging container according to the sixteenth embodiment of the present invention.
Figure 47:
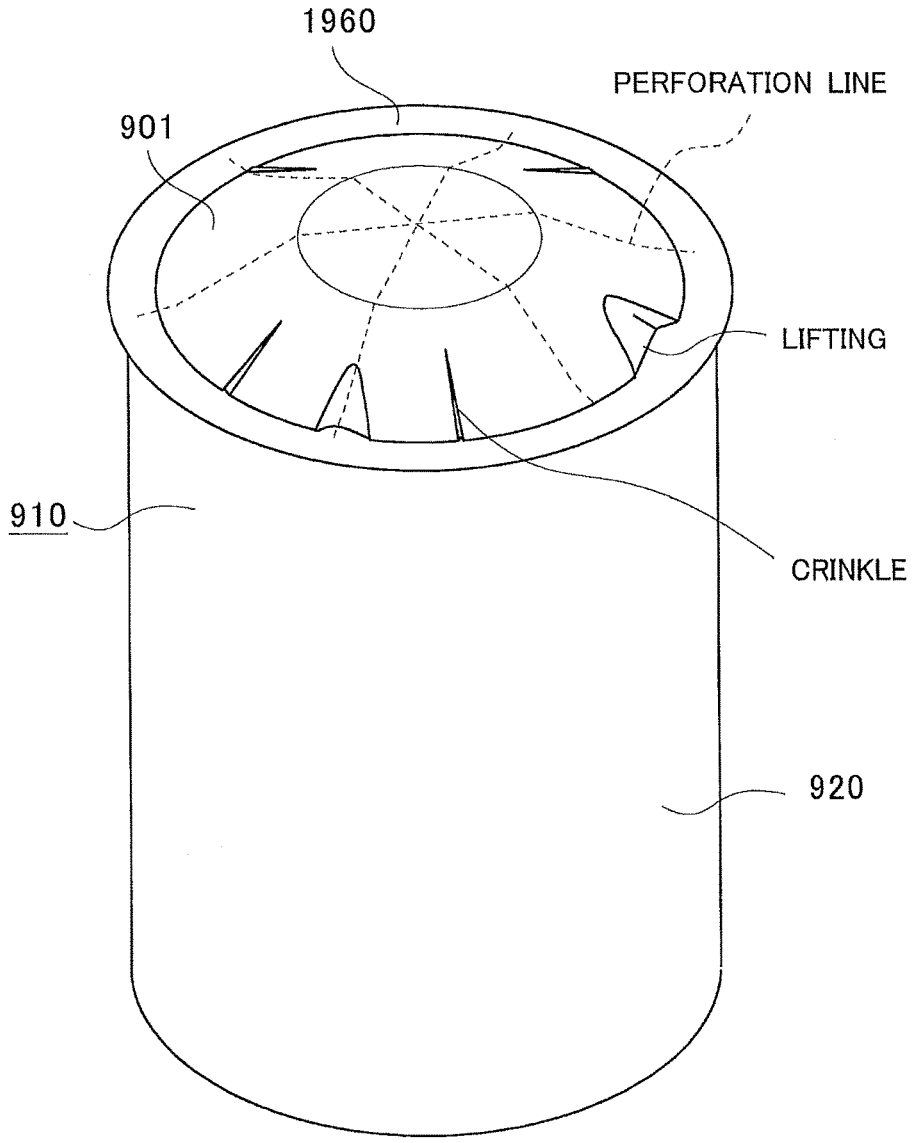
FIG. 47 is a perspective view of a packaging container to which a conventional sticker label is adhered.

FIG. 45 is a perspective view of the packaging container 300 in an exemplary case where the sticker label 51 is adhered to the packaging container 100 according to the sixth embodiment. FIG. 46 is a vertical cross-sectional view of the packaging container 300 taken along a line G-G' in FIG. 45.

In the present embodiment, the sealing lid 260 is pressed outward by the end portion, on the narrow opening side, of the funnel component 701, and projection having a height of, for example, 1 mm is formed concentrically with the sealing lid 260. The diameter of the sealing lid 260 is 85 mm, and the center of the sealing lid 260 and the center of the sticker label 51 overlap each other, and the sticker label 51 is adhered so as to cover the projection.

The sticker label 51 has such a shape as to extend downward from its center portion toward its circumferential edge portion along the sealing lid 260. In this case, a portion, outward of the projection, of the sticker label 51 is squeezed, and the widths of the recesses 52 in the circumferential direction of the sticker label 51, are reduced. Thus, the circumferential edge portion of the sticker label 51 is not folded and gathered, thereby reducing generation of crinkles. Further, repelling force against squeezing is reduced, and a state where the circumferential edge portion of the sticker label 51 is lifted without extending along the sealing lid 260 is less likely to occur. Since the recesses 52 are formed so as to be arc-shaped, stress due to squeezing is not concentrated on specific portions of the recesses 52, as compared to the triangular recesses or the like, whereby generation of crinkles at the recesses 52 can be further reduced.

As described above, even when the sticker label 51 is adhered to a non-flat surface including projections, generation of crinkles or lifting is reduced, whereby adhesion to the sealing lid 260 can be stably performed. Thus, information indicating function and design representing function of the sticker label 51 and protecting function for the sealing lid 260 can be obtained. The sticker label 51 is adhered to indicate information or represent design. Therefore, even for a small amount of production lots, information or design unique to the lots can be easily indicated by individual printing on the sticker labels. Further, since the sealing lid 260 is protected by the sticker label 51, strength of the sealing lid 260 can be reduced, thereby enabling reduction in cost. Furthermore, for the same reason as described above, even when the sticker label 51 is adhered to a non-flat surface including recesses, generation of crinkles or lifting can be similarly reduced.

The sticker label 51 can be adhered to the sealing lid 260 by using a typical sticker labeler. Since the recesses 52 are not formed into a straight line shape but are formed into an arc shape, the sticker label 51 is less likely to be caught by the sticker labeler as compared to a case where the recesses 52 are formed into rectangular shapes or the like. Therefore, failure in adhesion is less likely to occur.

The size and the shape of the sticker label 51 are not limited to those described above. When the diameter of the sealing lid 260 is greater than or equal to 50 mm and not greater than 100 mm, the diameter of the sticker label 51 is preferably greater than or equal to 40 mm and not greater than 100 mm, such that the size of the sticker label 51 is not greater than the size of the sealing lid 260.

The shape and the number of the recesses 52 of the sticker label 51 are not limited to those described above. The shape and the number thereof can be selected as appropriate depending on, for example, a degree of projection or recess of the sealing lid 260, the shape of the sealing lid 260, and the size of the sticker label 51. For example, when the sealing lid 260 includes a recess having a depth that is greater than or equal to 1 mm and not greater than 5 mm, or a projection having a height that is greater than or equal to 1 mm and not greater than 5 mm, the recesses 52 are preferably formed into arc shapes having an equal radius that is greater than or equal to 1 mm and not greater than 5 mm, in the case of the sticker label 51 being a circular member having a diameter that is greater than or equal to 40 mm and not greater than 100 mm. Further, from the viewpoint of the number of the recesses 52, the number of the recesses 52 is preferably greater than or equal to 8 and not greater than 24. From the viewpoint of intervals for positioning, the recesses 52 are preferably spaced from each other along the circumferential edge of the sticker label 51 at regular intervals such that the recesses 52 are spaced from each other by a distance that is greater than or equal to 5 mm and not greater than 10 mm. When the radius of each recess 52 or the number of the recesses 52 is reduced so as to be less than that described above, or the intervals for positioning is increased so as to be greater than those described above, the effect is less likely to be obtained. When the radius of each recess 52 or the number of the recesses 52 is increased so as to be greater than that described above, or the intervals for positioning are reduced so as to be less than those described above, the area of the sticker label 51 is reduced, and an indication region by printing is reduced. Further, the recessed width of each recess 52 from the circumferential edge of the circular member toward the center of the circular member is preferably equal to about the radius of the arc of each recess 52. Thus, the width of each recess 52 along the circumferential direction of the circular member can be increased, and the width squeezed when the sticker label 51 is adhered can be increased. The recesses 52 of the sticker label 51 may be formed into a curved-line shape, other than an arc shape, by which stress is less likely to be concentrated and the recess is less likely to be caught by a sticker labeler.

The sticker label 51 is preferably formed by using, as a base material, synthetic paper the size of which is less than or equal to 100 μm, so as to extend well along the projection or recess of the sealing lid 260. For example, YUPO (registered trademark) synthetic paper, manufactured by YUPO CORPORATION, having the thickness of 80 μm can be used, and, for example, a high-adhesion type adhesive PAT1 can be used as the adhesive layer. The synthetic paper is more rigid and stretchable than paper or resin films, and is preferably used as a base material of the sticker label 51 to be adhered to a surface including projection or recess.

The packaging container to which the sticker label 51 is to be adhered is not limited to the packaging container 300 described above. The sticker label 51 may be adhered to other packaging containers or objects other than packaging containers when the sticker label 51 can be adhered by an adhesive of the sticker label 51. Further, the sticker label 51 can be adhered to flat surfaces.

Further, the scopes of the present invention, as indicated below, based on the present embodiment can be considered.

1. A packaging container in which a planar shape of the sticker label is such that recesses are formed into arc shapes having an equal radius that is greater than or equal to 1 mm and not greater than 5 mm, and the recesses are formed in a circumferential edge of a circular member having a diameter that is greater than or equal to 40 mm and not greater than 100 mm such that the recesses are spaced from each other at regular intervals by a distance that is greater than or equal to 5 mm and not greater than 10 mm.

2. A packaging container in which a planar shape of the sticker label is such that recesses are formed into arc shapes having an equal radius that is greater than or equal to 1 mm and not greater than 5 mm, and the recesses are formed in a circumferential edge of a circular member having a diameter that is greater than or equal to 40 mm and not greater than 100 mm, and the number of the recesses is greater than or equal to 8 and not greater than 24.

The embodiments of the present invention have been described above. However, in each of the embodiments, modification, replacements, additions, and omissions of the components can be made as appropriate. In addition, components described in each embodiment can be combined to provide a new embodiment.

INDUSTRIAL APPLICABILITY

The present invention is, for example, useful for packaging containers used for transferring fluid substances such as powdery, granular, and liquid substances from one case to another case, and for funnel components for use in the packaging containers.

DESCRIPTION OF THE REFERENCE CHARACTERS

12 flange portion
17 side wall
18 bottom portion
20 plate member
21 circumferential portion
22 perforation line
24 contact portion
25 adhesion portion
51 sticker label
52 recess
100 packaging container
101 funnel component
102 funnel portion
103 discharge portion
104 side wall portion
105 opening
106 opening portion
107 ruled line
120 container body
133 funnel inner diameter
150 contents
160 sealing lid
160B sealing lid
161 upper film
162 lower film
163 adhesion region
164 tab

165 cut
166 circumferential edge portion
167 circumferential edge portion
168 region
169 adhesion region
170 recess
171 upper-side film member
172 lower-side film member
191 increased width portion
192 air slit
200 packaging container
203 intermediate product
206 folded portion
220 container body
221 polyethylene layer
222 deposition film
223 gas-sealing function resin layer
224 polyethylene layer
225 paper
226 polyethylene layer
230 non-sealed portion
231 polyethylene layer
232 deposition film
233 polyethylene terephthalate layer
234 paper
235 polyethylene layer
260 sealing lid
300 packaging container
301 funnel component
360 sealing lid
406 folded portion
460 sealing lid
501 funnel component
502 funnel portion
503 discharge portion
504 side wall portion
506 opening portion
508 groove
512 first tapered portion
522 second tapered portion
560 sealing lid
606 folded portion
660 sealing lid
701 funnel component
704 side wall portion
707 ruled line
710 tank
711 opening
712 rubber member
713 opening member
760 sealing lid
860 sealing lid
901 sticker label
910 packaging container
920 container body
960 sealing lid
1000 bottom portion
1001 crinkle
1012 flange portion
1060 sealing lid
1120 container body
1160 sealing lid
1161 upper film
1162 lower film
1163 adhesion region
1164 tab
1165 half cut
1169 separation layer
1201 ruled line
1202 line
1960 sealing lid

The invention claimed is:

1. A packaging container, comprising:

a cylindrical container body having an open end, a bottom portion, and a side wall;

a funnel component fitted into the container body such that a narrow opening side portion is directed toward an open end side of the container body, the funnel component comprising:

a funnel portion having a diameter that is increased from a narrow opening side toward a wide opening side, a tubular discharge portion that connects with an end portion on the narrow opening side, and a cylindrical side wall portion that surrounds an opening portion, on the wide opening side, of the funnel portion, connects with the funnel portion, and is fitted into the container body, wherein the funnel portion, the discharge portion, and the side wall portion are integrally formed by using a sheet member including paper and a sealant layer, and a folded portion formed by the sheet member being folded back and welded over an entire circumference is provided at an opening portion of the discharge portion; and a sealing lid that seals the open end of the container body, includes perforation lines, and is cut by an external pressing force, the sealing lid including a lower film that has a circumferential edge portion which is sealed to an opening portion of the container body to seal the container body, that has the perforation lines which are provided in a center portion other than the circumferential edge portion so as to radially extend, and that is to be cut by being externally pressed, and an upper film that covers the perforation lines of the lower film, and is adhered to a surface of the lower film over the entire circumference of the circumferential edge portion of the lower film and in at least one adhesion region that is partially formed in a region which does not include the perforation lines of the center portion, such that the upper film is separable from the lower film, wherein the surface of the lower film has a non-adhered annular region that is underlying the upper film but is not adhered to the upper film at any portion of the non-adhered annular region, the non-adhered annular region being inside the circumferential edge portion and surrounding the perforation lines.

2. The packaging container according to claim 1, wherein the funnel portion includes a first tapered portion on the wide opening side, and a second tapered portion that is closer to the narrow opening side than the first tapered portion is, and a taper angle of the second tapered portion is greater than a taper angle of the first tapered portion.

3. The packaging container according to claim 1, wherein the folded portion of the sheet member has a corrugated edge.

4. The packaging container according to claim 1, wherein an opening portion, on the narrow opening side, of the funnel component projects from a plane of the container body including the open end of the container body, and a projecting distance is greater than 0 mm and less than or equal to 2 mm.

5. The packaging container according to claim 1, wherein adhesion portions are formed in regions each of which is between the perforation lines, and is not on the perforation lines formed on the sealing lid, and, at the adhesion portions, the opening portion, on the narrow opening side, of the funnel portion is partially adhered to the sealing lid.

6. The packaging container according to claim 1, wherein the adhesion region for the sealing lid includes a plurality of circular regions that are point-symmetric with respect to a center meeting portion of the perforation lines.

7. A packaging container comprising:

a cylindrical container body having an open end, a bottom portion, and a side wall;

a funnel component fitted into the container body such that a narrow opening side portion is directed toward an open end side of the container body, the funnel component comprising:

a funnel portion having a diameter that is increased from a narrow opening side toward a wide opening side, a tubular discharge portion that connects with an end portion on the narrow opening side, and a cylindrical side wall portion that surrounds an opening portion, on the wide opening side, of the funnel portion, connects with the funnel portion, and is fitted into the container body, wherein the funnel portion, the discharge portion, and the side wall portion are integrally formed by using a sheet member including paper and a sealant layer, and a folded portion formed by the sheet member being folded back and welded over an entire circumference is provided at an opening portion of the discharge portion; and a sealing lid that seals the open end of the container body, includes perforation lines, and is cut by an external pressing force, the sealing lid including a lower film that has a circumferential edge portion which is sealed to an opening portion of the container body to seal the container body, that has the perforation lines which are provided in a center portion other than the circumferential edge portion so as to radially extend, and that is to be cut by being externally pressed, and an upper film that covers the perforation lines of the lower film, and is adhered to a surface of the lower film over the entire circumference of the circumferential edge portion of the lower film and in at least one adhesion region that is formed in at least a portion of a region which includes the perforation lines of the center portion, such that the upper film is separable from the lower film, wherein the surface of the lower film has a non-adhered annular region that is underlying the upper film but is not adhered to the upper film at any portion of the non-adhered annular region, the non-adhered annular region being inside the circumferential edge portion and surrounding the perforation lines.

8. The packaging container according to claim 1, wherein the adhesion region for the sealing lid includes an annular region that surrounds the perforation lines.

9. The packaging container according to claim 8, wherein the annular region includes an increased width portion in which a width is partially greater than another portion, and the upper film has an air slit that passes through an inner circumferential edge portion of the increased width portion.

10. The packaging container according to claim 8, wherein the adhesion region for the sealing lid further includes a circular region that has, as a center thereof, the center meeting portion of the perforation lines, and a plurality of circular regions that are on the perforation lines inside an inner diameter of the funnel component and that are point-symmetric with respect to the center meeting portion of the perforation lines.

11. The packaging container according to claim 8, wherein the adhesion region for the sealing lid further includes a circular region that has, as a center thereof, the center meeting portion of the perforation lines, and one region formed on each perforation line inside an inner diameter of the funnel component and one region formed on each perforation line outside the inner diameter of the funnel component, such that the regions formed on each perforation line inside and outside the inner diameter of the funnel component are point-symmetric with respect to the center meeting portion of the perforation lines.

12. The packaging container according to claim 8, wherein the adhesion region for the sealing lid further includes a circular region that has, as a center thereof, the center meeting portion of the perforation lines, and two regions formed on each perforation line inside an inner diameter of the funnel component and one region formed on each perforation line outside the inner diameter of the funnel component, such that the regions formed on each perforation line inside and outside the inner diameter of the funnel component are point-symmetric with respect to the center meeting portion of the perforation lines.

13. The packaging container according to claim 1, wherein the sealing lid further includes a tab that extends from a portion of the circumferential edge portion, and the upper film and the lower film are adhered to each other in a first part of the tab including a tip thereof, and the lower film is cut across the tab in a second part of the tab other than the first part.

14. The packaging container according to claim 13, wherein the tab is welded to the side wall of the container body.

15. The packaging container according to claim 1, wherein the upper film includes a laminated structure having a barrier film and an easy peel member, and the lower film includes a laminated structure having a polyethylene terephthalate layer and a polyethylene layer.

16. The packaging container according to claim 15, wherein the sealing lid is pressed along an outer edge of the opening portion of the container body and welded to the opening portion.

17. The packaging container according to claim 16, wherein the sealing lid includes a region in which the upper film and the lower film are not welded to each other, in a portion outward of a region where the sealing lid and the opening portion of the container body are welded to each other.

18. The packaging container according to claim 1, wherein a rigidity of the side wall is higher than a rigidity of the bottom portion, and a plurality of ruled lines are provided on an outer surface portion of the bottom portion so as to radially extend as viewed from a center portion of the bottom portion.

19. The packaging container according to claim 18, wherein the bottom portion projects outward of the packaging container.

20. The packaging container according to claim 18, wherein an outer edge portion of the bottom portion and a lower end portion of the side wall overlap each other in a state where the lower end portion of the side wall is folded back inward to sandwich the outer edge portion of the bottom portion, and includes a non-sealed portion that is formed such that a portion, of an overlapping region, which is higher than a predetermined height is not sealed in a state where a portion, of the overlapping region, ranging from a folding-back position to the predetermined height is sealed.

21. The packaging container according to claim 18, wherein the ruled lines are equally spaced from each other.

22. The packaging container according to claim 1, further comprising a sticker label having, in a part of a circumferential edge portion, a plurality of recesses each formed in a curved line in a planer shape, and the sticker label is adhered to a surface of the sealing lid, which forms an outer side of the packaging container.

23. The packaging container according to claim 7, wherein the adhesion region for the sealing lid includes a second annular region that surrounds the perforation lines.

24. The packaging container according to claim 23, wherein the second annular region includes an increased width portion in which a width is partially greater than another portion, and the upper film has an air slit that passes through an inner circumferential edge portion of the increased width portion.

25. The packaging container according to claim 23, wherein the adhesion region for the sealing lid further includes a circular region that has, as a center thereof, the center meeting portion of the perforation lines, and a plurality of circular regions that are on the perforation lines inside an inner diameter of the funnel component and that are point-symmetric with respect to the center meeting portion of the perforation lines.

* * * * *